US009065221B2

(12) United States Patent
Kimura

(10) Patent No.: US 9,065,221 B2
(45) Date of Patent: Jun. 23, 2015

(54) CONNECTOR WITH METAL PLATE FOR ELECTRO-STATIC DISCHARGE PROTECTION

(71) Applicant: JAPAN AVIATION ELECTRONICS INDUSTRY, LIMITED, Shibuya-ku, Tokyo (JP)

(72) Inventor: Masaki Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 174 days.

(21) Appl. No.: 13/846,487

(22) Filed: Mar. 18, 2013

(65) Prior Publication Data

US 2013/0323971 A1 Dec. 5, 2013

(30) Foreign Application Priority Data

Jun. 4, 2012 (JP) ..... 2012-126886

(51) Int. Cl.
*H01R 24/00* (2011.01)
*H01R 12/71* (2011.01)
*H01R 13/648* (2006.01)

(52) U.S. Cl.
CPC ..... *H01R 12/71* (2013.01); *H01R 24/00* (2013.01); *H01R 12/714* (2013.01); *H01R 13/6485* (2013.01)

(58) Field of Classification Search
USPC ..... 439/660, 74, 939, 941, 607.07, 607.09, 439/607.35, 607.05, 607.34, 607.01
See application file for complete search history.

(56) References Cited

U.S. PATENT DOCUMENTS

| | | | | |
|---|---|---|---|---|
| 5,057,028 | A * | 10/1991 | Lemke et al. | 439/101 |
| 5,567,169 | A | 10/1996 | McCleerey et al. | |
| 5,697,799 | A | 12/1997 | Consoli et al. | |
| 6,074,225 | A * | 6/2000 | Wu et al. | 439/101 |
| 6,942,509 | B2 | 9/2005 | Sasame et al. | |
| 6,984,137 | B2 | 1/2006 | Akasaka et al. | |
| 7,008,267 | B2 * | 3/2006 | Fan | 439/607.35 |
| 7,670,156 | B2 * | 3/2010 | Chen | 439/108 |
| 8,109,795 | B2 * | 2/2012 | Lin et al. | 439/660 |
| 2013/0273780 | A1 * | 10/2013 | Kimura et al. | 439/626 |

FOREIGN PATENT DOCUMENTS

| | | | |
|---|---|---|---|
| JP | 2000-516028 | A | 11/2000 |
| JP | 2004-063389 | A | 2/2004 |
| JP | 2005-190818 | A | 7/2005 |

OTHER PUBLICATIONS

Chinese Office Action dated Mar. 26, 2015, issued in counterpart Chinese Application No. 201310142290.9.

* cited by examiner

*Primary Examiner* — Abdullah Riyami
*Assistant Examiner* — Harshad Patel
(74) *Attorney, Agent, or Firm* — Holtz, Holtz, Goodman & Chick PC

(57) ABSTRACT

A connector is fixable to an object such as a circuit board. The connector comprises a housing having a land extending long in a lengthwise direction, a power contact, a metal plate for protecting the connector from ESD, a shell (connection member) configured to be fixed and connected to the circuit board, and a coupling member coupling the metal plate and the shell with each other. The metal plate is inserted in and held by the land. The connector is thus configured so that a static electricity is grounded to the circuit board through the metal plate, the coupling member and the shell. Moreover, the power contact is locatable at an end of the land in the lengthwise direction so that it is possible to reduce the size of the connector.

11 Claims, 51 Drawing Sheets

CONNECTOR WITH METAL PLATE FOR ELECTRO-STATIC DISCHARGE PROTECTION

CROSS REFERENCE TO RELATED APPLICATIONS

Applicants claim priority under 35 U.S.C. §119 of Japanese Patent Applications No. JP2012-126886 filed Jun. 4, 2012.

BACKGROUND OF THE INVENTION

This invention relates to a connector configured so as to be protected from Electro-Static Discharge (ESD).

For example, a connector which is configured so as to be protected from ESD is disclosed in JP-A2000-516028 (Patent Document 1) and U.S. Pat. No. 5,567,169 (Patent Document 2), contents of which are incorporated herein by reference.

As shown in FIG. 83, the connector of Patent Document 1 comprises a plug (land) made of an insulating material, a shell made of a metal and a wire made of a metal. The plug (i.e. insulating body) is surrounded by the shell so as to be apart from the shell. The plug has a mating-side end which is formed with a ditch. The wire is held in the ditch so as to be connected to the shell.

As shown in FIG. 84, the connector of Patent Document 2 comprises a fin made of an insulating material and a wire made of a metal. The fin (i.e. insulating body) has a mating end which is formed with a ditch. The wire is held in the ditch so as to be connected to a shell (not shown) made of a metal.

The connector of each of Patent Document 1 and 2 is thus configured so that the connector is protected from ESD. For example, when a user having static electricity moves its finger to the mating end of the insulating body, the static electricity is grounded through the wire. Accordingly, the connector (more specifically, signal contacts of the connector and circuits connected to the signal contacts) is protected from the static electricity.

By the way, a connector is used in various electronic equipments. For example, a connector is used in a docking station which is configured to be connected to a portable information device such as a notebook PC (Personal Computer), a slate PC, a tablet terminal or a smart phone. The connector of the docking station is required to have a reduced size while comprising a power contact which supplies an electric power for charging the portable information device.

However, the power contact generally has a large size as compared with the signal contact. When the connector comprising a power contact (for example, the connector of the docking station) is required to be protected from ESD, it is necessary to prevent the power contact from enlarging the connector.

SUMMARY OF THE INVENTION

It is therefore an object of the present invention to provide a connector which comprises a power contact while having a structure which is capable of preventing the connector from having a large size.

The present inventor has invented a connector described below in order to prevent the connector from having a large size. The invented connector comprises a land made of an insulating material and a shell surrounding the land. The land extends long in a lengthwise direction (first direction). The power contact is arranged at an end of the land in the first direction. The connector is thus configured so that the connector is able to comprise the power contact while having as small a size as possible.

If a wire, which is similar to the wire of Patent Document 1 or 2, is used to protect the aforementioned connector from ESD, the wire should be connected to the shell at opposite sides of the land in the first direction. However, the power contact interferes with the wire so that it is difficult to extend the wire to the shell beyond the power contact. In other words, if the connector comprises the wire similar to Patent Document 1 and 2, it is impossible to arrange the power contact at the end of the land in the first direction.

Accordingly, the present inventor has improved the invented connector as described below. The improved connector comprises a metal plate instead of the wire. The metal plate extends in a direction perpendicular to the first direction to be electrically connected to a part of the connector. Accordingly, it is possible to arrange the power contact at the end of the land in the first direction.

More specifically, the present invention provides the connector described below so as to solve the problems described above.

One aspect of the present invention provides a connector fixable to an object. The connector comprises a housing, a signal contact, a power contact, a metal plate, a connection member and a coupling member. The housing has a land and a long wall. The land extends long in a first direction while having a mating end in a second direction perpendicular to the first direction. The land and the long wall are provided so as to have a recess therebetween in a third direction perpendicular to both the first direction and the second direction. The signal contact has a contact-point part. The signal contact is held by the housing so that the contact-point part is exposed in the recess. The power contact is provided at an end of the land in the first direction. The metal plate is for ESD protection. The metal plate is insulated from the signal contact and the power contact. The metal plate is at least partially inserted in and held by the land so that a part of the metal plate, which is located on or in the mating end, is visible when seen along the second direction. The connection member is configured to be fixed and connected to the object at outside of the recess in the third direction. The coupling member couples the metal plate and the connection member with each other while being insulated from the signal contact and the power contact.

An appreciation of the objectives of the present invention and a more complete understanding of its structure may be had by studying the following description of the preferred embodiment and by referring to the accompanying drawings.

Figure 1:
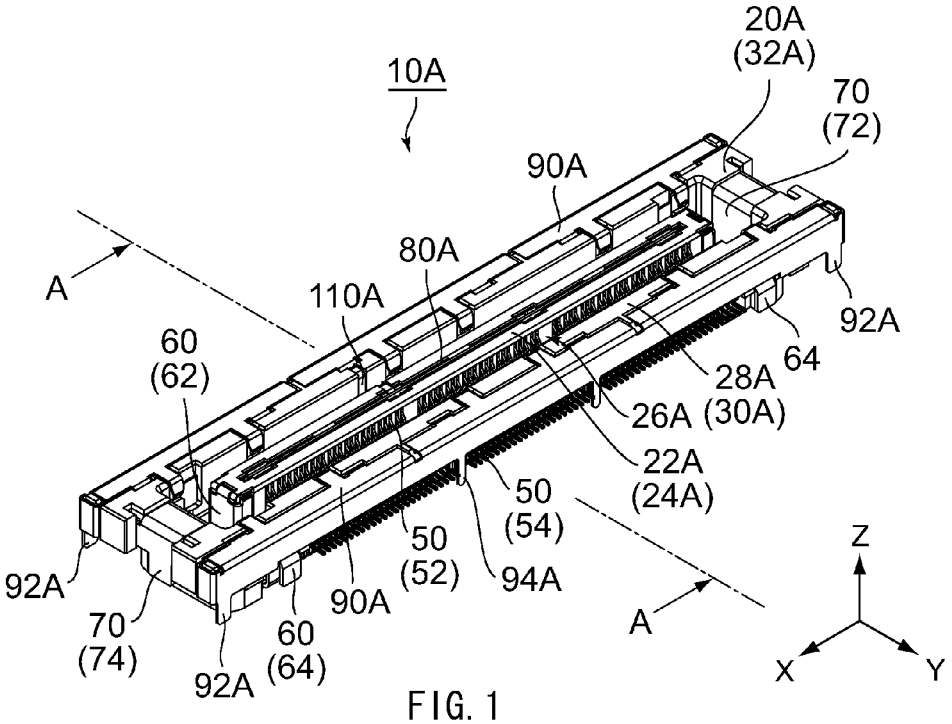
FIG. 1 is a top, perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
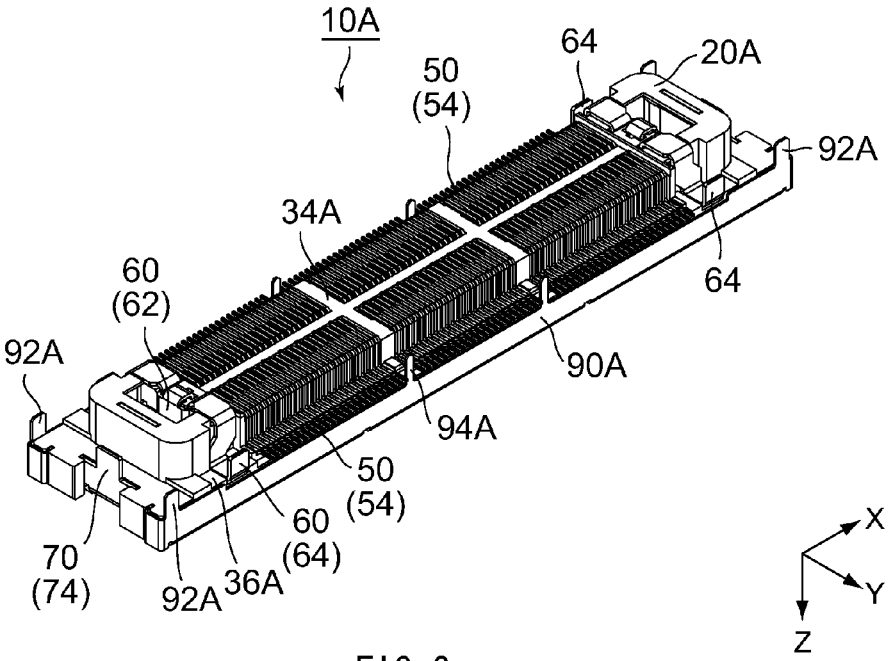
FIG. 2 is a bottom, perspective view showing the connector of FIG. 1.
Figure 3:
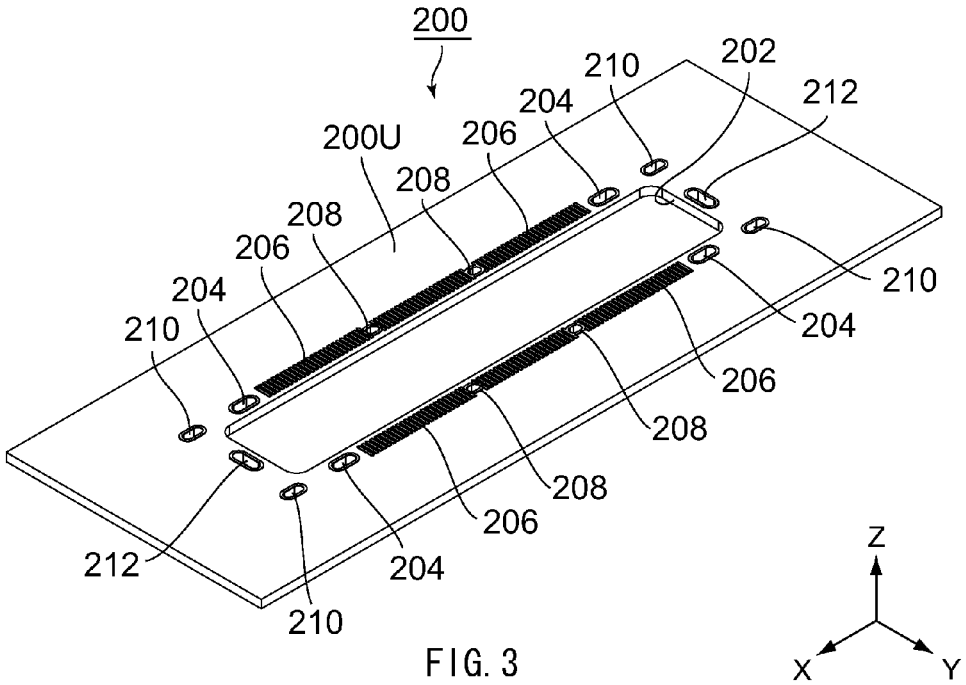
FIG. 3 is a perspective view showing a circuit board where the connector of FIG. 1 is mountable and fixable.
Figure 4:
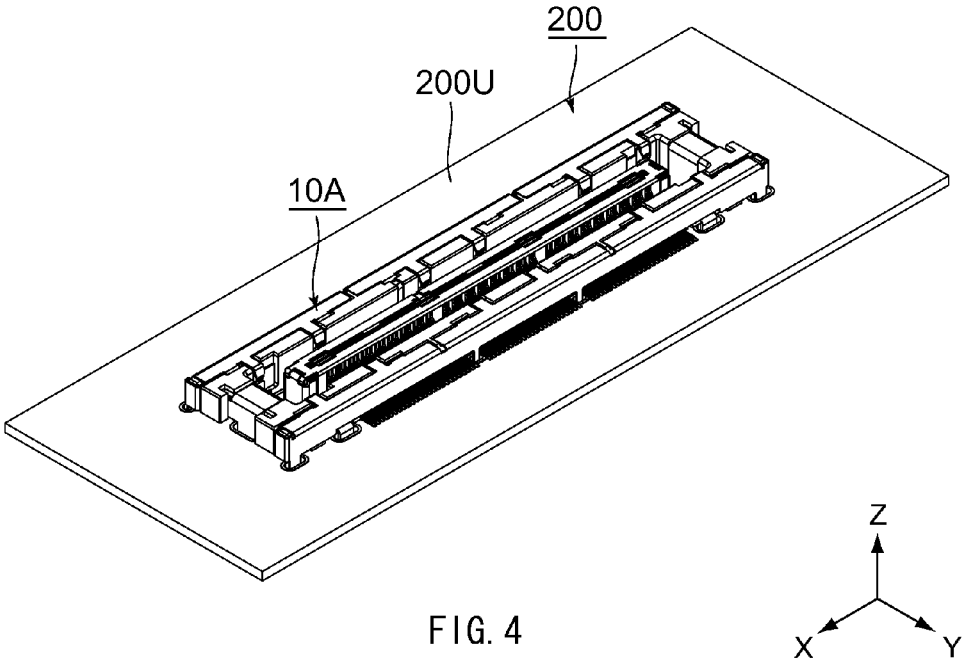
FIG. 4 is a top, perspective view showing the connector of FIG. 1 mounted on the circuit board of FIG. 3.
Figure 5:
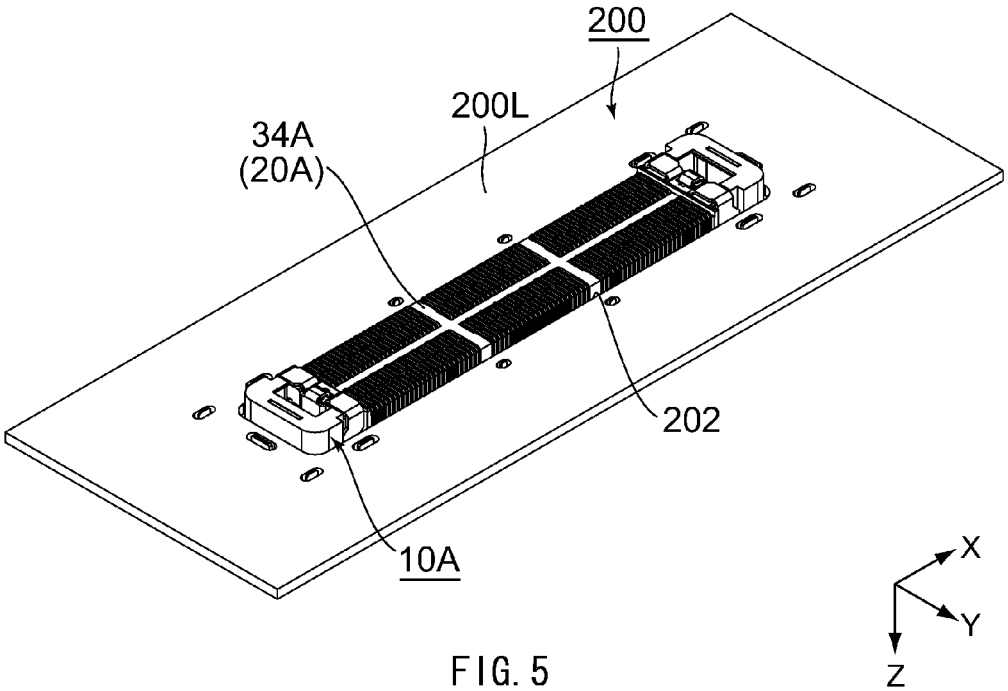
FIG. 5 is a bottom, perspective view showing the connector of FIG. 1 mounted on the circuit board of FIG. 3.

Referring to FIGS. 1 to 5, a connector 10A according to a first embodiment of the present invention is a so-called drop-in connector fixable to an object. More specifically, the connector 10A is configured to be partially received and fixed in an opening 202 formed in a circuit board (object) 200. As shown in FIG. 3, the opening 202 of the circuit board 200 extends long in the X-direction (first direction) so as to have opposite long edges extending in the X-direction. The circuit board 200 according to the present embodiment is provided with four through holes 204 for connection to respective power contacts described later, a plurality of soldered portions 206, four through holes 208 for connection to a shell described later, four through holes 210 for connection to the shell described later and two through holes 212 for connection to respective other power contacts described later. In detail, two through holes 204 are formed at each of the long edges of the opening 202. The circuit board 200 has an upper surface 200U and a lower surface 200L in the Z-direction (second direction perpendicular to the first direction). The soldered portions 206 are formed on the upper surface 200U of the circuit board 200 so as to be located between two through holes 204 in the X-direction. The soldered portions 206 arranged in the X-direction are divided into three soldered groups. Each of the through holes 208 is formed between the two soldered groups adjacent to each other in the X-direction. The through holes 210 are formed in the vicinity of respective corners of the opening 202. Each of the through holes 212 is formed between two through holes 210 in the Y-direction (third direction perpendicular to both the first direction and the second direction).

Figure 6:
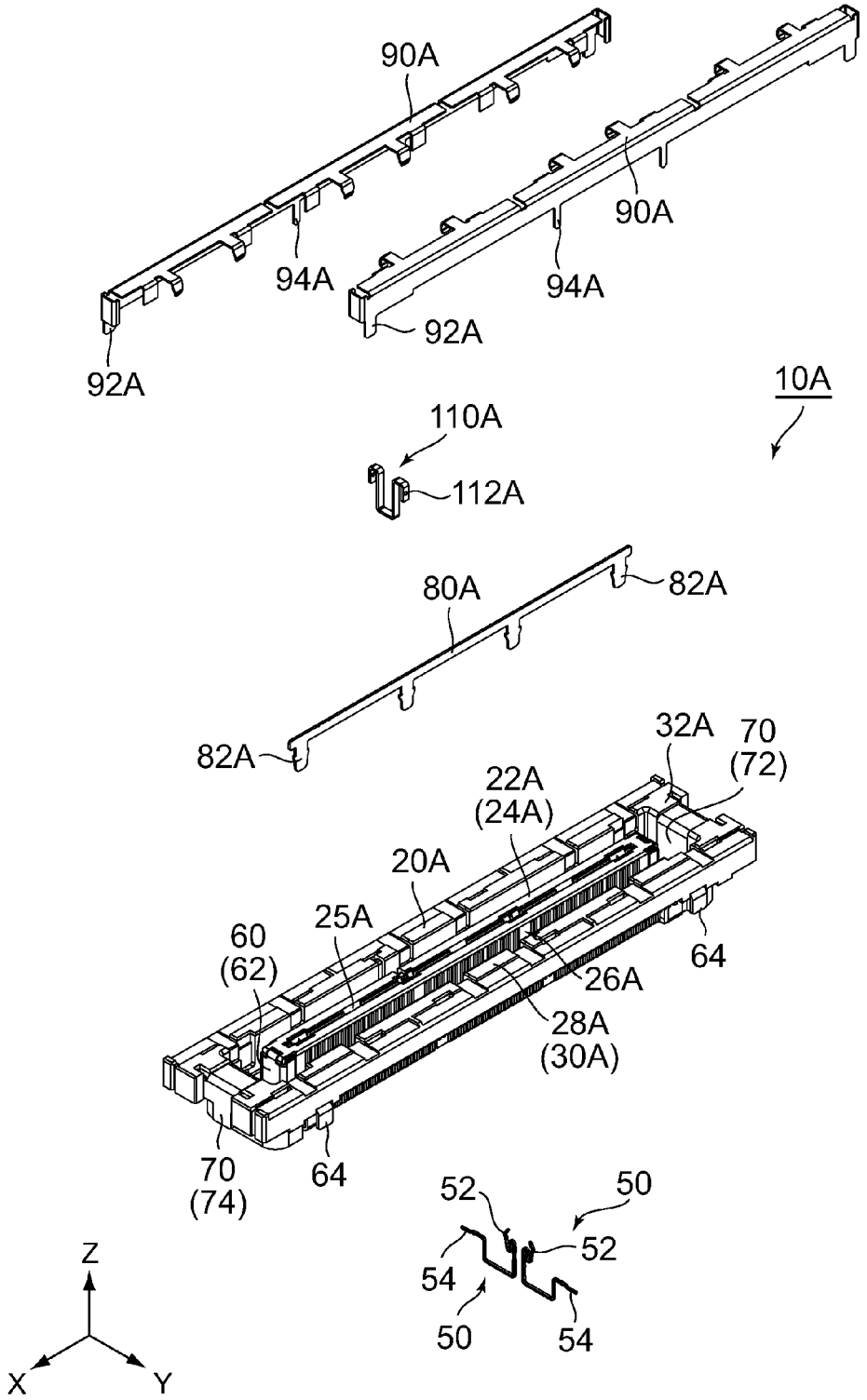
FIG. 6 is a partially exploded, perspective view showing the connector of FIG. 1.

Referring to FIGS. 1, 2 and 6, the connector 10A according to the present embodiment comprises a housing 20A made of an insulating material, a plurality of signal contacts 50 each made of a conductive material, two power contacts 60 and two power contacts 70 each made of a conductive material, a metal plate 80A, a shell (connection member) 90A made of a metal and a coupling member 110A made of a metal. The metal plate 80A is configured to protect the connector 10A from ESD. In other words, the metal plate 80A is for ESD protection.

As shown in FIGS. 1 and 6 to 10, the housing 20A has a land 22A, a recess 26A and a peripheral portion 28A. The land 22A extends long in the X-direction (first direction) while having a mating end 24A in the Z-direction (second direction). The recess 26A is formed so as to surround the land 22A in the XY-plane. The peripheral portion 28A is formed so as to surround the recess 26A in the XY-plane. The land 22A is formed with a slit-like holding portion 25A. The holding portion 25A extends in the X-direction in the mating end 24A while extending from the mating end 24A along the negative Z-direction. The holding portion 25A does not reach at any one of opposite ends of the land 22A in the X-direction so that a size of the holding portion 25A in the X-direction is smaller than a size of the land 22A in the X-direction. The recess 26A is recessed in the negative Z-direction. The peripheral portion 28A has two long walls 30A extending along the X-direction and two short walls 32A extending along the Y-direction (third direction). Each of the long walls 30A couples the short walls 32A with each other in the X-direction. In other words, each of the short walls 32A couples the long walls 30A with each other in the Y-direction. In detail, each of the long walls 30A couples corresponding two ends in the Y-direction (i.e. two ends which are located at the same position in the Y-direction) of the short walls 32A with each other. Each of the short walls 32A couples corresponding two ends in the X-direction (i.e. two ends which are located at the same position in the X-direction) of the long walls 30A with each other. The recess 26A is located between the long wall 30A and the land 22A in the Y-direction. In other words, the land 22A and the long wall 30A are provided so as to have the recess 26A therebetween in the Y-direction. Similarly, the recess 26A is located between the short wall 32A and the land 22A in the X-direction.

Figure 10:
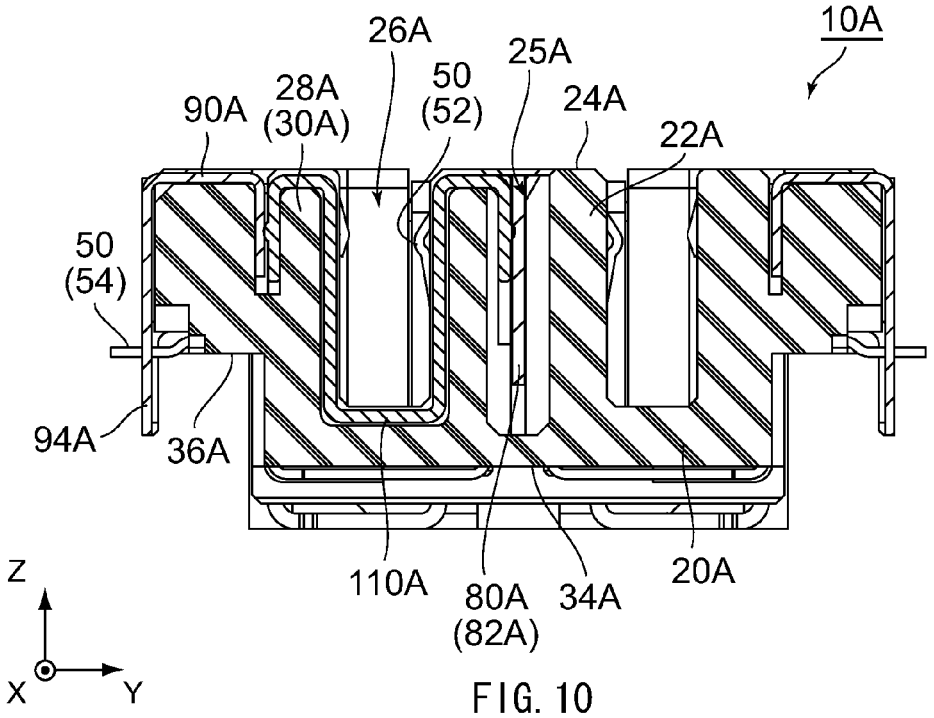
FIG. 10 is a cross-sectional view showing the connector of FIG. 1, taken along A-A lines.

As can be seen from FIGS. 2, 4, 5 and 10, the housing 20A has a bottom portion which is mostly comprised of two portions, namely, a central bottom 34A and a peripheral bottom 36A. The central bottom 34A and the peripheral bottom 36A are located at a lower side of the housing 20A in the Z-direction. The peripheral bottom 36A is located so as to surround the central bottom 34A. As can be seen from FIG. 10, as seen along the Z-direction, the land 22A and the recess 26A are located within a region corresponding to the central bottom 34A. As shown in FIGS. 2 and 10, the peripheral bottom 36A is located at the positive Z-side of the bottom portion of the housing 20A while the central bottom 34A is located at the negative Z-side of the bottom portion. In other words, the central bottom 34A is located below the peripheral bottom 36A. Accordingly, a distance between the central bottom 34A and the mating end 24A in the Z-direction is larger than a distance between the peripheral bottom 36A and the mating end 24A in the Z-direction. As can be seen from FIGS. 2 to 5, the central bottom 34A is located below the upper surface 200U of the circuit board 200 when the connector 10A is fixed to the circuit board 200. The peripheral bottom 36A is located on or above the upper surface 200U of the circuit board 200 when the connector 10A is fixed to the circuit board 200.

As can be seen from FIGS. 6 to 10, the land 22A is formed with accommodate portions, each of which is a space which accommodates a part of the signal contact 50. The accommodate portion of the land 22A does not reach at the mating end 24A. Accordingly, when the housing 20A is seen along the negative Z-direction, an upmost part (i.e. the positive Z-side end) of the signal contact 50 is hidden behind the mating end 24A. The upmost part of the signal contact 50 is therefore invisible when seen along the negative Z-direction. In other words, when the housing 20A is seen along the negative Z-direction, the signal contact 50 is visible at the outside of a region occupied by the land 22A (i.e. the mating end 24A) in the XY-plane visible at the inside of the recess 26A) while invisible at the inside of the region occupied by the land 22A (i.e. the mating end 24A) in the XY-plane.

As can be seen from FIGS. 6 to 10, the land 22A is formed with accommodate portions each is a space which accommodates a part of the signal contact 50. The accommodate portion of the land 22A does not reach at the mating end 24A. Accordingly, when the housing 20A is seen along the negative Z-direction, an upmost part (i.e. the positive Z-side end) of the signal contact 50 is hidden behind the mating end 24A. The upmost part of the signal contact 50 is therefore invisible when seen along the negative Z-direction. In other words, when the housing 20A is seen along the negative Z-direction, the signal contact 50 is visible at the outside of a region occupied by the land 22A (i.e. the mating end 24A) in the XY-plane visible at the inside of the recess 26A) while invisible at the inside of the region occupied by the land 22A (i.e. the mating end 24A) in the XY-plane.

Figure 7:
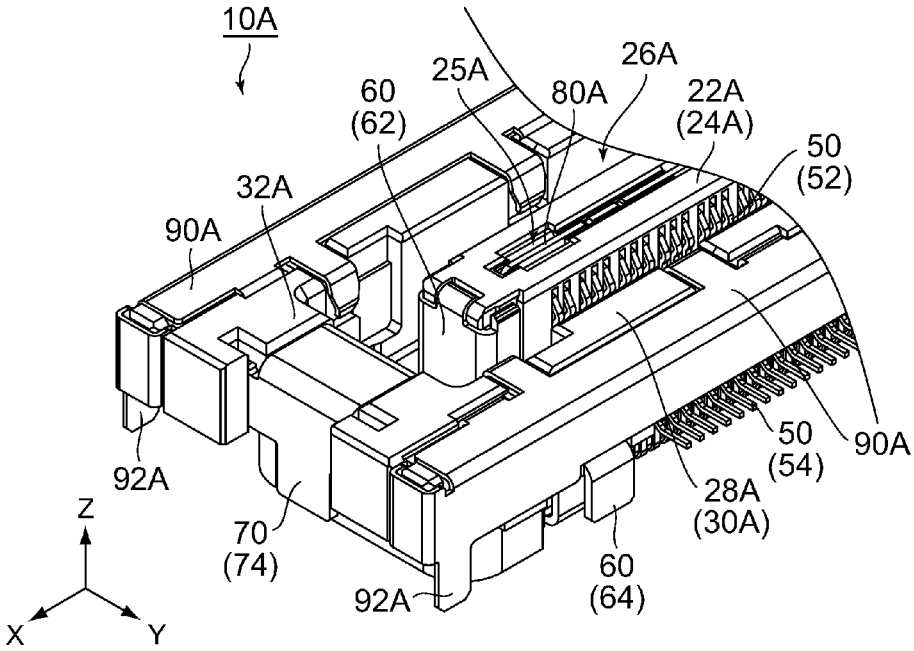
FIG. 7 is a partially enlarged, top, perspective view showing a part of the connector of FIG. 1.
Figure 8:
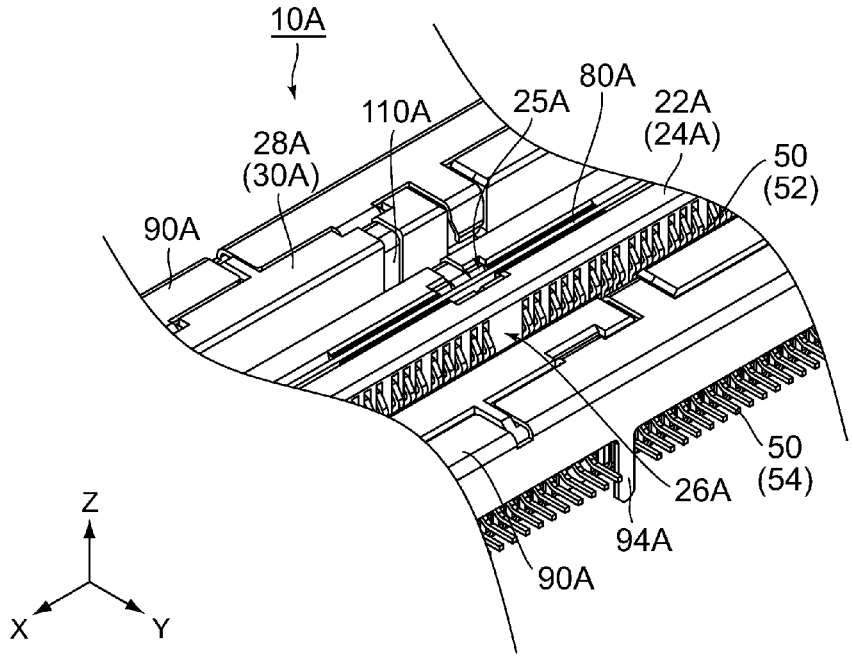
FIG. 8 is a partially enlarged, top, perspective view showing another part of the connector of FIG. 1.
Figure 9:
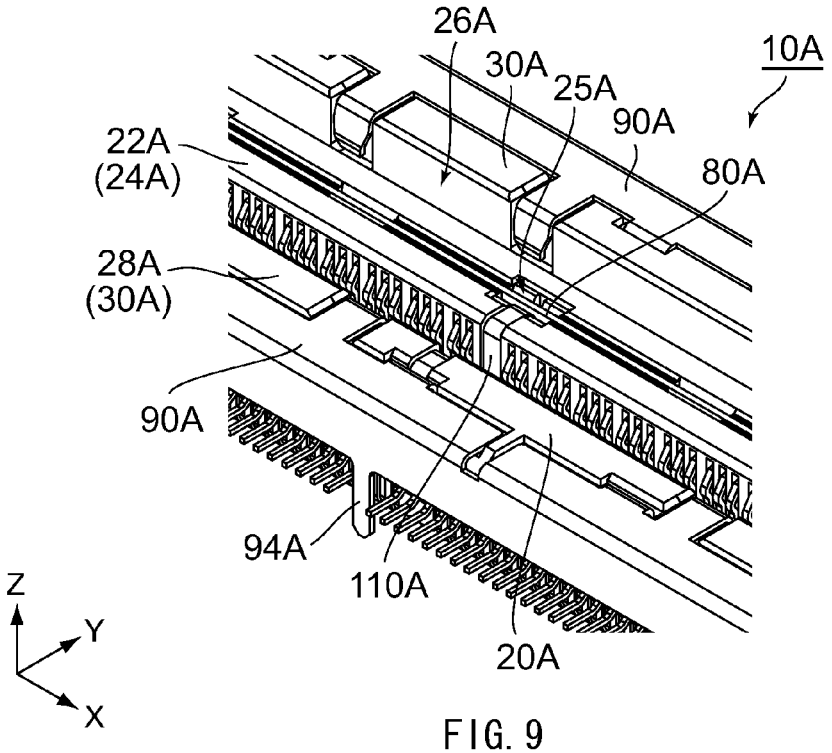
FIG. 9 is a top, perspective view showing the connector of FIG. 8 along another direction.

As shown in FIGS. 1, 2, 6 and 7, the connector 10A according to the present embodiment comprises the two power contacts 60. The power contacts 60 are provided at the opposite ends of the land 22A in the X-direction, respectively. Each of the power contacts 60 has a contact-point part 62 and two connection portions 64. The contact-point part 62 is brought into contact with a mating power contact (not shown) under the mating state of the connector 10A with the mating connector (not shown). The connection portion 64 is connected to the through hole 204 (see FIG. 3) when the connector 10A is mounted on and fixed to the circuit board 200. As shown in FIG. 7, the contact-point part 62 of the power contact 60 is provided in the recess 26A so as to cover the end of the land 22A in the X-direction. A width (i.e. a size in the Y-direction) of the contact-point part 62 of the power contacts 60 according to the present embodiment is slightly smaller than a width (i.e. a size in the Y-direction) of the land 22A. More specifically, the contact-point part 62 of the power contact 60 according to the present embodiment is located between opposite ends of the land 22A in the Y-direction. As shown in FIGS. 1, 2 and 7, each of the power contacts 60 is provided with the two connection portions 64. Each of the connection portions 64 extends to the outside of the connector 10A along the Y-direction.

As shown in FIGS. 1, 2, 6 and 7, the connector 10A according to the present embodiment comprises the two power contacts 70. The power contacts 70 are provided so as to straddle the short walls 32A, respectively. Each of the power contacts 70 has a contact-point part 72 and a connection portion 74. The contact-point part 72 is brought into contact with a mating power contact (not shown) under the mating state of the connector 10A with the mating connector (not shown). The connection portion 74 is connected to the through hole 212 (see FIG. 3) when the connector 10A is mounted on and fixed to the circuit board 200. As shown in FIG. 1, the contact-point part 72 of the power contact 70 is provided in the recess 26A so as to face the contact-point part 62 of the power contact 60. In other words, the contact-point part 72 is arranged on an inner surface of the short wall 32A which is located inward in the X-direction. As shown in FIGS. 1 and 7, the connection portion 74 of the power contact 70 is located at the outside of the short wall 32A in the X-direction. The connection portion 74 extends toward the negative Z-side of the connector 10A. As can be seen from FIG. 1, according to the present embodiment, the four power contacts 60 and 70 in all are arranged in the X-direction.

As shown in FIG. 6, the metal plate 80A roughly has a slender plate-like shape extending long in the X-direction. The metal plate 80A has a plurality of press-fit portions 82A extending in the negative Z-direction. As can be seen from FIGS. 7 to 10, the metal plate 80A is press-fitted in the holding portion 25A from the mating end 24A of the land 22A to be held by the holding portion 25A. As can be seen from the above description, a size of the metal plate 80A in the X-direction is designed so that the holding portion 25A is able to accommodate the metal plate 80A. More specifically, the size of the metal plate 80A in the X-direction is smaller than a size of the land 22A in the X-direction. Accordingly, the metal plate 80A is insulated from the power contact 60. Moreover, the metal plate 80A according to the present embodiment is insulated from the signal contact 50. The metal plate 80A is buried (i.e. inserted) in and held by the land 22A so that a part of the metal plate 80A, which is located in the mating end 24A, is visible when seen along the Z-direction. In other words, the metal plate 80A is wholly inserted within the land 22A. A distance between the metal plate 80A and the mating end 24A of the land 22A in the Z-direction is smaller than a distance between the signal contact 50 and the mating end 24A of the land 22A in the Z-direction. However, the metal plate 80A may be configured differently. For example, a part of the metal plate 80A may protrude above the land 22A. In other words, the metal plate 80A may be at least partially inserted in and held by the land 22A. In this case, a part of the metal plate 80A, which is located on the mating end 24A, is visible when seen along the Z-direction.

As previously described, when the housing 20A is seen along the negative Z-direction, the signal contact 50 is invisible at the inside of the region occupied by the land 22A (i.e. the mating end 24A) in the XY-plane. On the contrary, the metal plate 80A is visible through the mating end 24A. As can be seen from the above description, a creeping distance between the mating end 24A and the signal contact 50 is longer than a creeping distance between the mating end 24A and the metal plate 80A. Accordingly, when a user having static electricity moves, for example, its finger to the land 22A, the static electricity flows not to the signal contact 50 but surety to the metal plate 80A.

As shown in FIGS. 1 and 6 to 9, the shell (connection member) 90A according to the present embodiment is comprised of two members having similar shapes to each other. The two members of the shell 90A cover the long walls 30A of the peripheral portion 28A, respectively. Thus, the shell 90A according to the present embodiment is located apart from the metal plate 80A in the Y-direction. The shell 90A according to the present embodiment does not cover the short wall 32A. However, if the connector 10A does not comprise the power contact 70, the shell 90A may cover the short wall 32A. Moreover, if an electric potential of the power contact 70 is designed to be equal to an electric potential (for example, a ground potential) of the shell 90A, the power contact 70 and the shell 90A may be formed integrally. The shell 90A has a plurality of fixed portions 92A and a plurality of fixed portions 94A. When the connector 10A is mounted on and fixed to the circuit board 200, the fixed portions 92A are connected to the through holes 210 (see FIG. 3), respectively, while the fixed portions 94A are connected to the through holes 208 (see FIG. 3), respectively. As can be seen from FIGS. 1 and 7 to 9, the fixed portions 94A are arranged to be fixed and connected to the through holes 208 of the circuit board 200 at the outside of the recess 26A in the Y-direction. In other words, the shell 90A is configured to be fixed and connected to the circuit board 200 at the outside of the recess 26A in the Y-direction.

Figure 11:
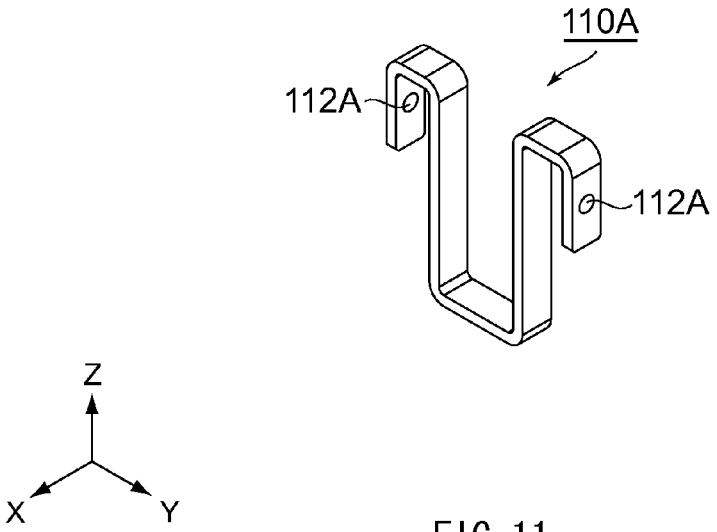
FIG. 11 is a perspective view showing a coupling member of the connector of FIG. 1.
Figure 12:
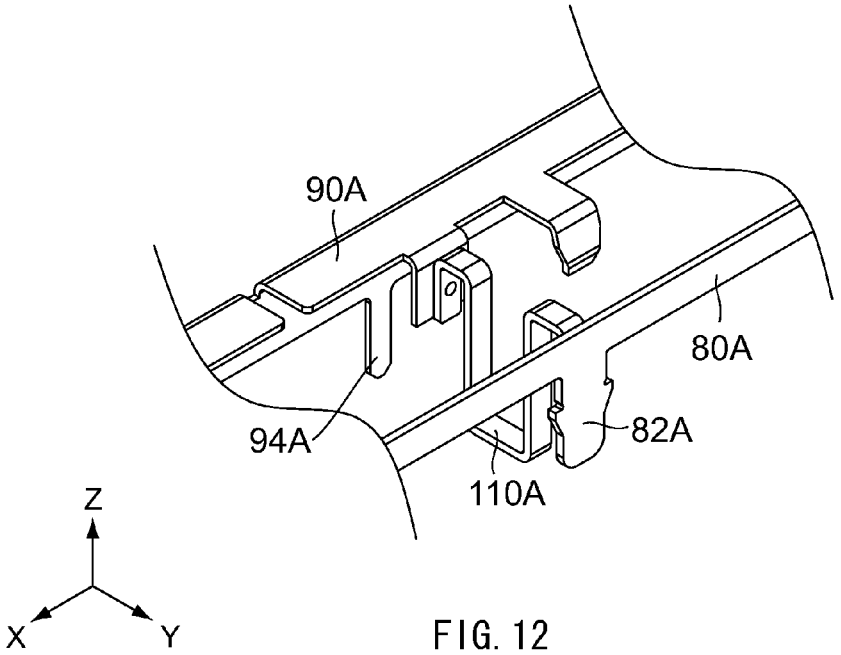
FIG. 12 is a partially enlarged, perspective view showing a metal plate, the coupling member and a shell of the connector of FIG. 1 in a state where the metal plate, the coupling member and the shell are connected to one another.
Figure 13:
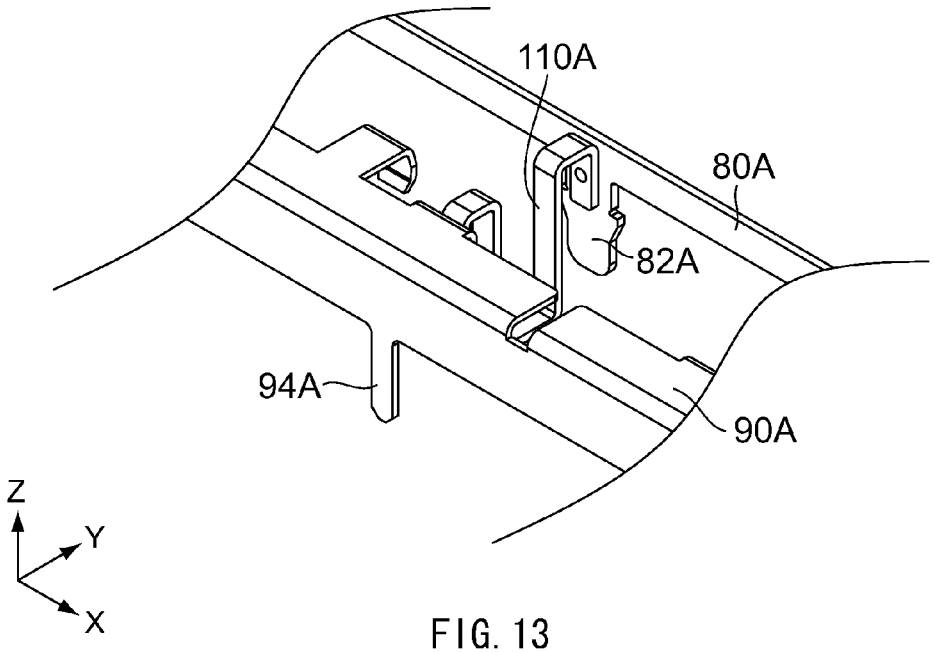
FIG. 13 is a perspective view showing the metal plate, the coupling member and the shell of FIG. 12 along another direction.

As shown in FIGS. 6 to 10, the coupling member 110A according to the present embodiment is inserted in the housing 20A from the mating end 24A (i.e. from the positive Z-side of the housing 20A) so that the coupling member 110A is held by the housing 20A. As can be seen from FIG. 1, the coupling member 110A is located far apart from the power contacts 60 and the power contacts 70. More specifically, the coupling member 110A is located near the middle part of the land 22A in the X-direction. As can be seen from FIGS. 9 and 10, the coupling member 110A is also apart from the signal contacts 50. In other words, the coupling member 110A is insulated from the signal contacts 50, the power contacts 60 and the power contacts 70. As shown in FIG. 11, the coupling member 110A according to the present embodiment has two dowels 112A.

As shown in FIGS. 7 to 10, 12 and 13, the coupling member 110A couples the metal plate 80A and the shell (connection member) 90A with each other in the Y-direction. More specifically, the coupling member 110A couples the metal plate 80A with the shell (connection member) 90A while extending along an inner surface of the recess 26A (see FIG. 10). Accordingly, when a user having static electricity moves its finger to the land 22A, it is possible to ground the static electricity to the circuit board 200 through the metal plate 80A, the coupling members 110A and the shell 90A. According to the present embodiment, one of the dowels 112A of the coupling member 110A is formed between the metal plate 80A and the coupling member 110A while another one of the dowels 112A is formed between the shell 90A and the coupling member 110A. Accordingly, it is possible to secure a sufficient contact pressure not only between the coupling member 110A and the metal plate 80A but also between the coupling member 110A and the shell 90A.

Figure 83:
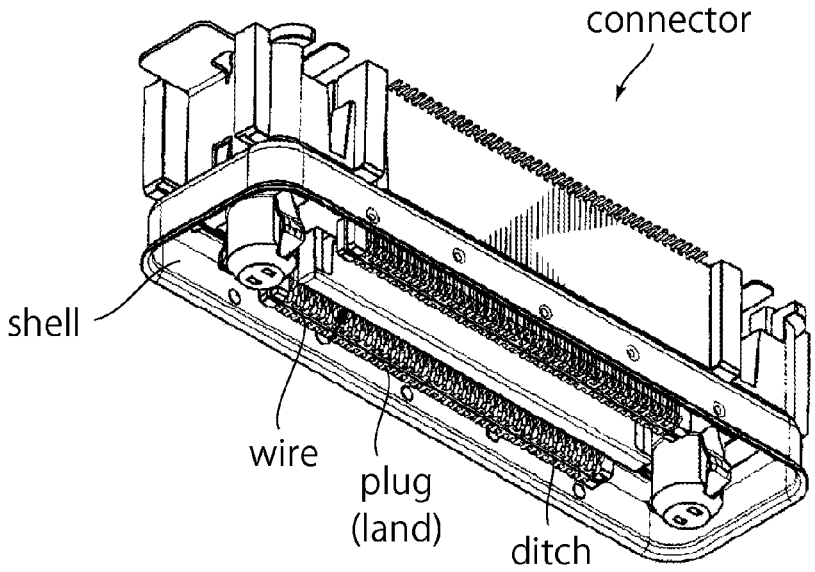
PRIOR ART FIG. 83
FIG. 83 is a perspective view showing an existing connector.
Figure 84:
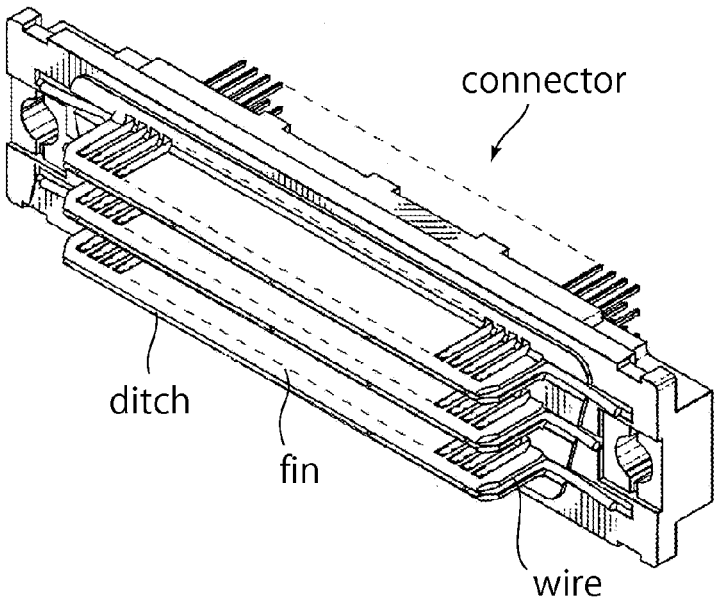
PRIOR ART FIG. 84
FIG. 84 is a perspective view showing another existing connector.

As can be seen from FIG. 1, the coupling member 110A according to the present embodiment is located apart from the opposite ends of the land 22A in the X-direction. As can be seen from the above description, according to the present embodiment, the static electricity is grounded to the circuit board 200 through a ground route which is different from the ground route of the existing connectors shown in FIGS. 83 and 84. More specifically, according to the present embodiment, the metal plate 80A, the coupling member 110A and the shell 90A constitute the ground route of the static electricity so that the ground route does not pass through the end of the land 22A in the X-direction. Accordingly, it is possible to provide the power contacts 60 at the ends of the land 22A of the housing 20A in the X-direction. It is therefore possible to reduce the size of the connector 10A. Moreover, although the connector 10A according to the present embodiment has the power contacts 70 in addition to the power contacts 60, the power contact 70 is provided by using the short wall 32A efficiently. Accordingly, it is possible to prevent the connector 10A from becoming large while the connector 10A has the four power contacts 60 and 70 in all.

According to the present embodiment, the signal contact 50 is press-fitted in the housing 20A, which has the recess 26A at the upper side, from below the housing 20A (i.e. from a side opposite to the mating end 24A of the housing 20A) so that only a part of the signal contact 50 is exposed in the recess 26A. Accordingly, even if a metal component such as a wire is unintentionally inserted into the recess 26A, a possibility that the metal component is brought into contact with the signal contact 50 is small. According to the present embodiment, it is possible to protect the connector 10A from ESD more securely than the existing connectors.

Moreover, the signal contact 50 is press-fitted in the housing 20A from the side opposite to the mating end 24A so that it is possible to lengthen the creeping distance between the mating end 24A and the signal contact 50. Accordingly, it is possible to protect the connector 10A from ESD by the metal plate 80A more securely.

Moreover, the connector 10A is a drop-in connector. More specifically, the housing 20A of the connector 10A has the central bottom 34A configured to be located below the upper surface 200U of the circuit board, and the peripheral bottom 36A configured to be located on the upper surface 200U. Accordingly, when the connector 10A is installed to the circuit board, a height of the connector 10A is lower than the existing connectors. It is possible to further reduce the size of the connector 10A by protecting the connector 10A from ESD according to the present embodiment.

Second Embodiment

Referring to FIGS. 14 to 17, a connector 10B according to a second embodiment of the present invention is a so-called drop-in connector fixable to an object. The connector 10B is a modification of the connector 10A according to the aforementioned first embodiment so that the connector 10B has the almost same structure as the connector 10A. Accordingly, in Figures and the following description, similar or same reference signs are used to designate the elements (for example, parts, portions or members) of the connector 10B which are similar to or same as (i.e. corresponding to) the elements of the connector 10A, respectively. It is not described or simply described about the similar or same elements in the following description while it is mainly described about differences of the connector 10B from the connector 10A.

Figure 14:
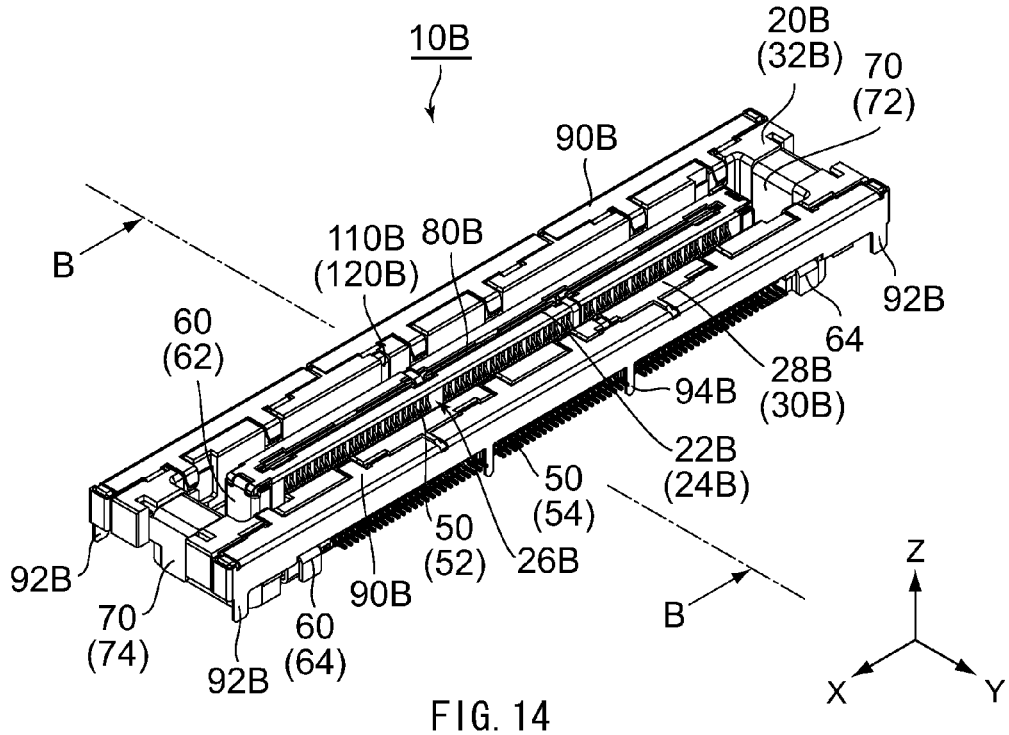
FIG. 14 is a top, perspective view showing a connector according to a second embodiment of the present invention.
Figure 16:
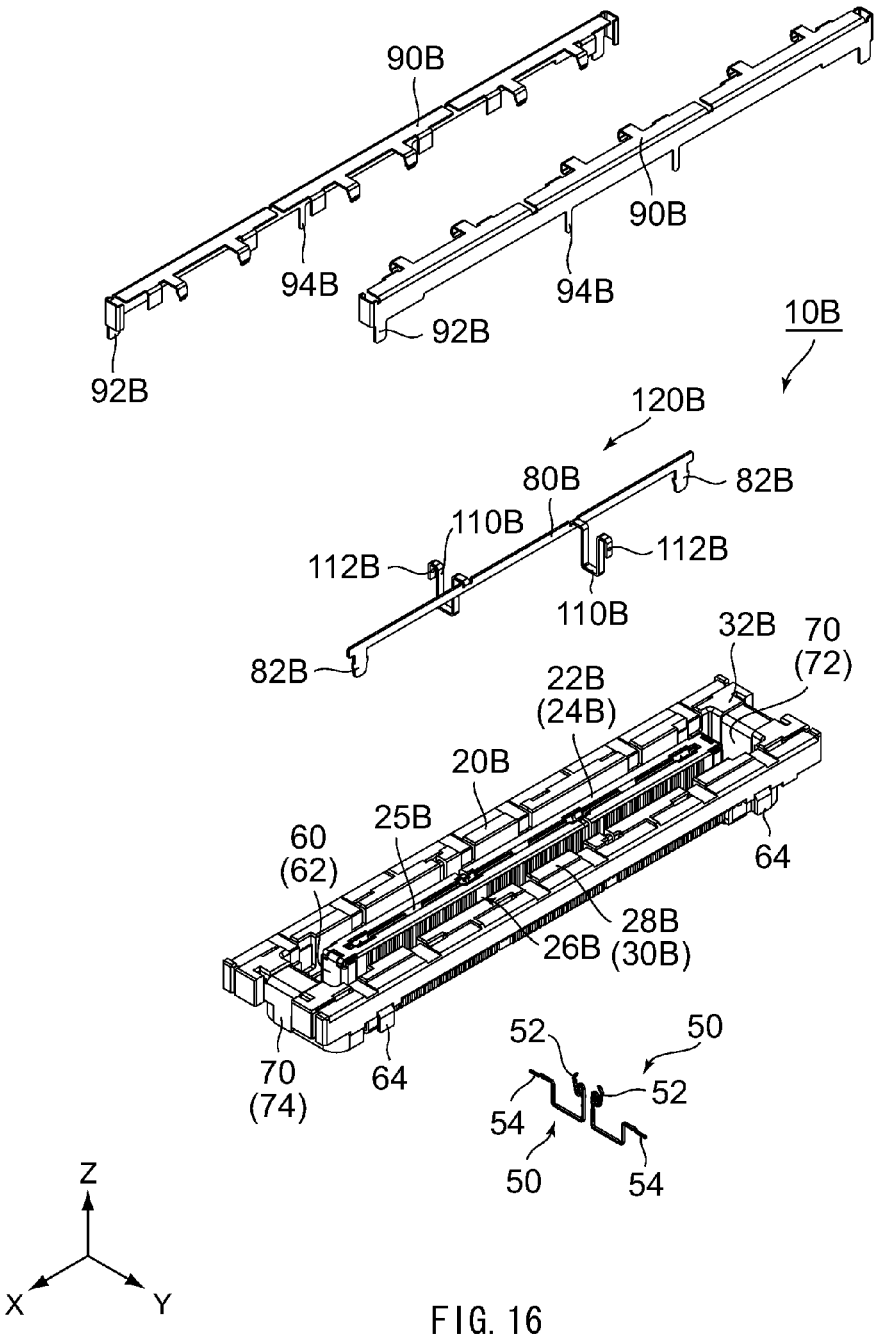
FIG. 16 is a partially exploded, perspective view showing the connector of FIG. 14.
Figure 17:
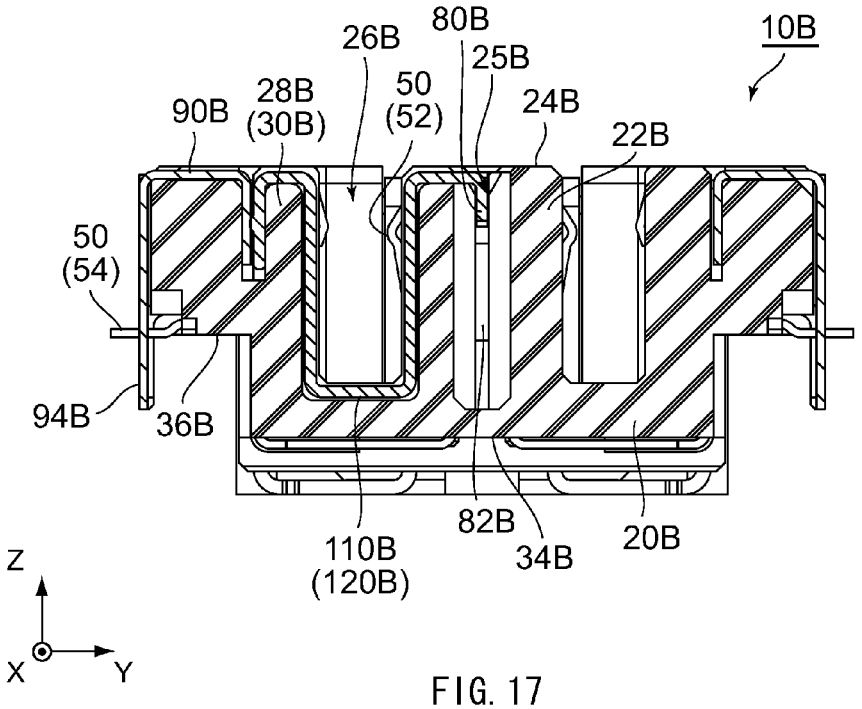
FIG. 17 is a cross-sectional view showing the connector of FIG. 14, taken along BB lines.
Figure 18:
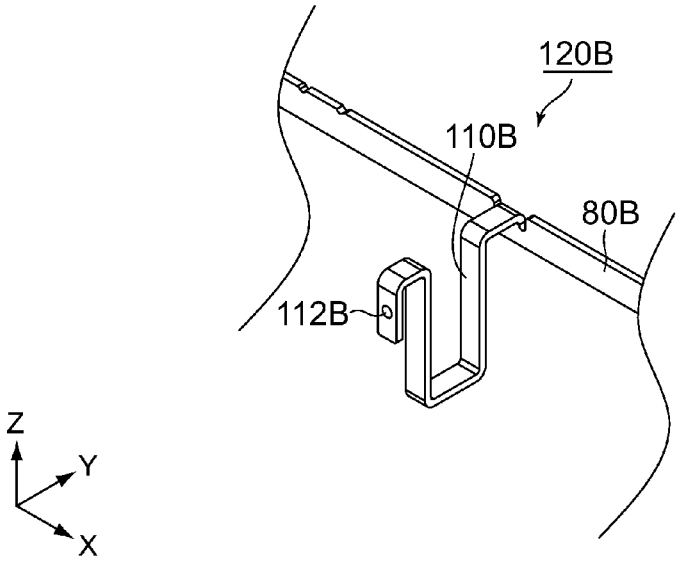
FIG. 18 is a partially enlarged, perspective view showing a metal member of the connector of FIG. 14.

Referring to FIGS. 14, 16 and 17, the connector 10B according to the present embodiment comprises a housing 20B made of an insulating material, a plurality of the signal contacts 50 each made of the conductive material, the power contacts 60 and the power contacts 70 each made of the conductive material, a metal member 120B and a shell (connection member) 90B made of a metal.

As shown in FIGS. 14, 16 and 17, the housing 20B has a land 22B, a recess 26B and a peripheral portion 28B. The land 22B extends long in the X-direction (first direction) while having a mating end 24B in the Z-direction (second direction). The recess 26B is formed so as to surround the land 22B in the XY-plane. The peripheral portion 28B is formed so as to surround the recess 26B in the XY-plane. The land 22B is formed with a slit-like holding portion 25B. The holding portion 25B extends in the X-direction in the mating end 24B while extending from the mating end 24B along the negative Z-direction. The recess 26B is recessed in the negative Z-direction. The peripheral portion 28B has two long walls 30B extending along the X-direction and two short walls 32B extending along the Y-direction (third direction). The recess 26B is located between the long wall 30B and the land 22B in the Y-direction. In other words, the land 22B and the long wall 30B are provided so as to have the recess 26B therebetween in the Y-direction. Similarly, the recess 26B is located between the short wall 32B and the land 22B in the X-direction.

Figure 15:
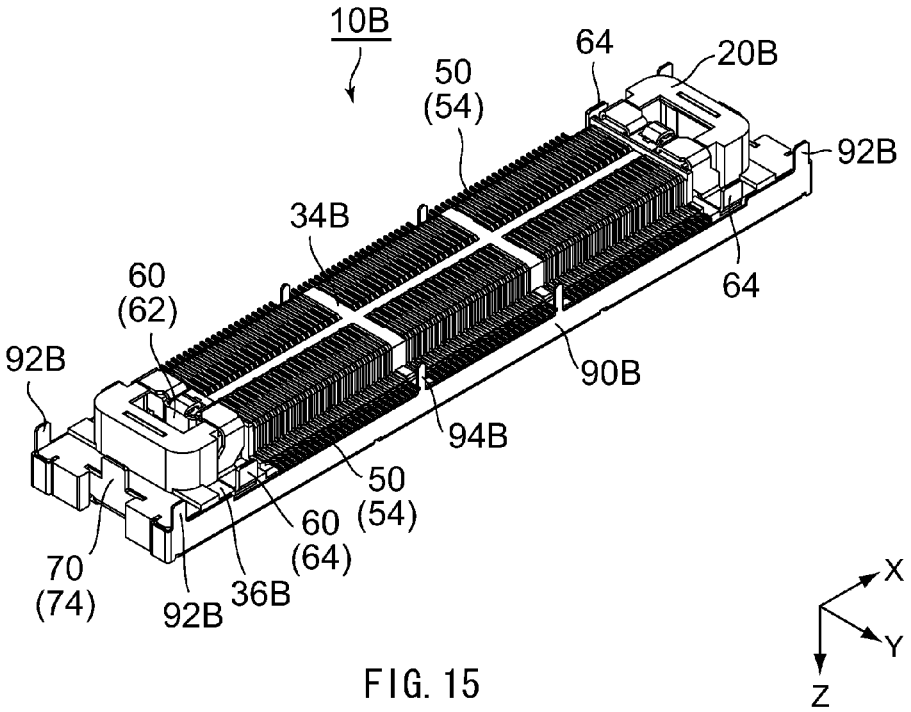
FIG. 15 is a bottom, perspective view showing the connector of FIG. 14.

As can be seen from FIGS. 15 and 17, the housing 20B has a bottom portion which is mostly comprised of a central bottom 34B and a peripheral bottom 36B. The central bottom 34B and the peripheral bottom 36B are located at a lower side of the housing 20B in the Z-direction. The peripheral bottom 36B is located so as to surround the central bottom 34B. As can be seen from FIG. 17, as seen along the Z-direction, the land 22B and the recess 26B are located within a region corresponding to the central bottom 34B.

As shown in FIGS. 14 and 15, the signal contacts 50, the power contacts 60 and the power contacts 70 are held by the housing 20B. The signal contact 50 is press-fitted in the housing 20B from a side opposite to the mating end 24B (i.e. from the bottom portion which is located at the negative Z-side of the housing 20B). The signal contact 50 is held by the housing 20B so that the contact-point part 52 is exposed in the recess 26B. As shown in FIG. 14, the contact-point part 62 of each of the power contacts 60 is provided in the recess 26B so as to cover the end of the land 22B in the X-direction. As shown in FIG. 14, the connector 10B according to the present embodiment comprises the two power contacts 70. The power contacts 70 are provided so as to straddle the short walls 32B, respectively. The contact-point part 72 of the power contact 70 is provided in the recess 26B so as to face the contact-point part 62 of the power contact 60.

As shown in FIGS. 16 to 20, the metal member 120B according to the present embodiment is integrally formed from a metal plate 80B for ESD protection and a plurality of coupling members 110B each made of a metal. In other words, the coupling member 110B according to the present embodiment is integrally formed with the metal plate 80B. More specifically, the metal member 120B is formed by pressing and bending a single base metal plate. The metal plate 80B is provided with a plurality of press-fit portions 82B while each of the coupling members 110B is provided with a dowel 112B. As can be seen from FIGS. 14, 16 and 17, the metal member 120B (i.e. the metal plate 80B and the coupling members 110B) is press-fitted in the housing 20B from the mating end 24B (i.e. from the positive Z-side of the housing 20B) to be held by the housing 20B. In detail, the metal plate 80B is held by the land 22B so as to be visible from the mating end 24B. The coupling member 110B passes through the recess 26B to extend to the long wall 30B of the peripheral portion 28B.

As shown in FIGS. 14 and 16, the shell (connection member) 90B according to the present embodiment is comprised of two members having similar shapes to each other. The two members of the shell 90B cover the long walls 30B of the peripheral portion 28B, respectively. The shell 90B has a plurality of fixed portions 92B and a plurality of fixed portions 94B. When the connector 10B is mounted on and fixed to the circuit board 200, the fixed portions 92B are connected to the through holes 210 (see FIG. 3), respectively, while the fixed portions 94B are connected to the through holes 208 (see FIG. 3), respectively.

Figure 19:
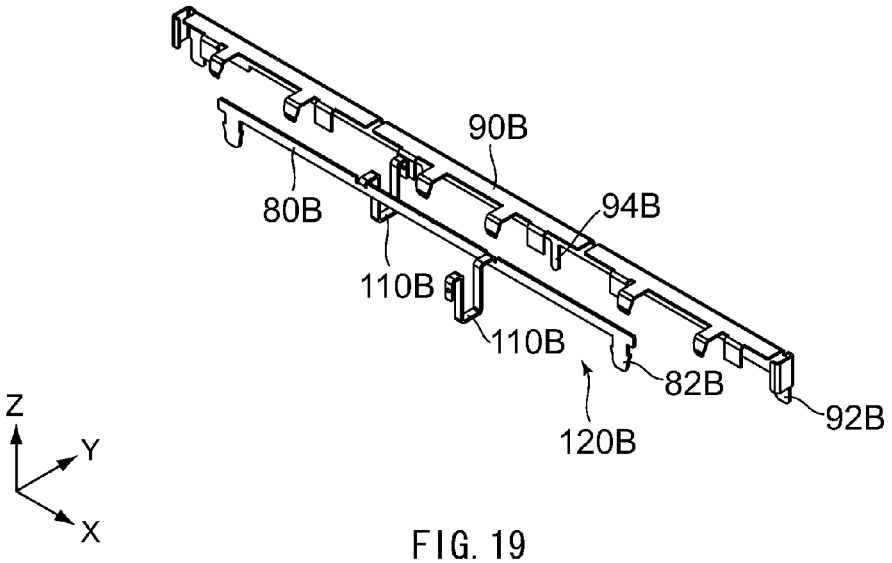
FIG. 19 is a perspective view showing the metal member and a shell of the connector of FIG. 14 in a state where the metal member and the shell are connected to each other.
Figure 20:
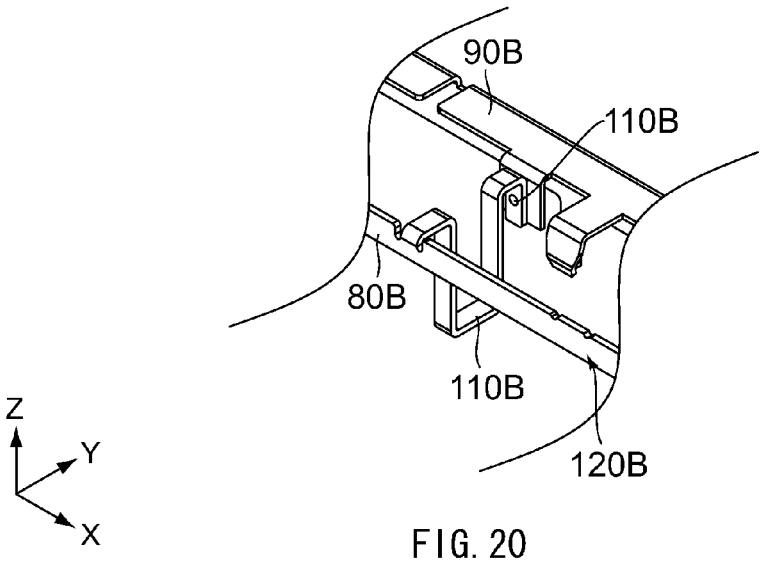
FIG. 20 is a partially enlarged, perspective view showing the metal member and the shell of FIG. 19.

As shown in FIGS. 17, 19 and 20, the metal member 120B and the shell 90B are connected to each other. More specifically, the dowel 112B of the coupling member 110B of the metal member 120B is pressed against and brought into contact with the shell 90B so that the metal member 120B and the shell 90B are electrically connected to each other. In other words, the coupling member 110B couples the metal plate 80B and the shell 90B with each other. Similar to the first embodiment, the metal member 120B and the shell 90B are connected at a position which is apart from any one of the opposite ends of the land 22B in a lengthwise direction (the X-direction or the first direction). Accordingly, according to the present embodiment, similar to the first embodiment, it is possible to efficiently use the opposite ends of the land 22B in the lengthwise direction. It is therefore possible to provide the power contacts 60 and the power contacts 70 while preventing the connector 10B becoming large.

Third Embodiment

Referring to FIGS. 21 to 24, a connector 100 according to a third embodiment of the present invention is a so-called drop-in connector fixable to an object. The connector 10C is a modification of the connector 10A according to the previously described first embodiment so that the connector 100 has the almost same structure as the connector 10A. Accordingly, in Figures and the following description, similar or same reference signs are used to designate the elements of the connector 10C which are similar to or same as the elements of the connector 10A, respectively. It is not described or simply described about the similar or same elements in the following description while it is mainly described about differences of the connector 10C from the connector 10A.

Figure 21:
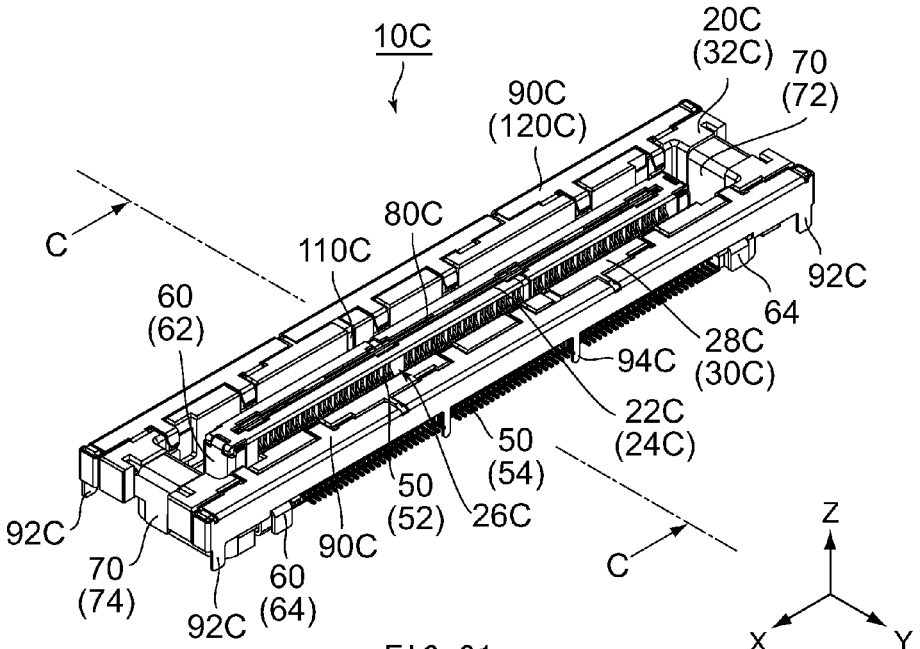
FIG. 21 is a top, perspective view showing a connector according to a third embodiment of the present invention.
Figure 23:
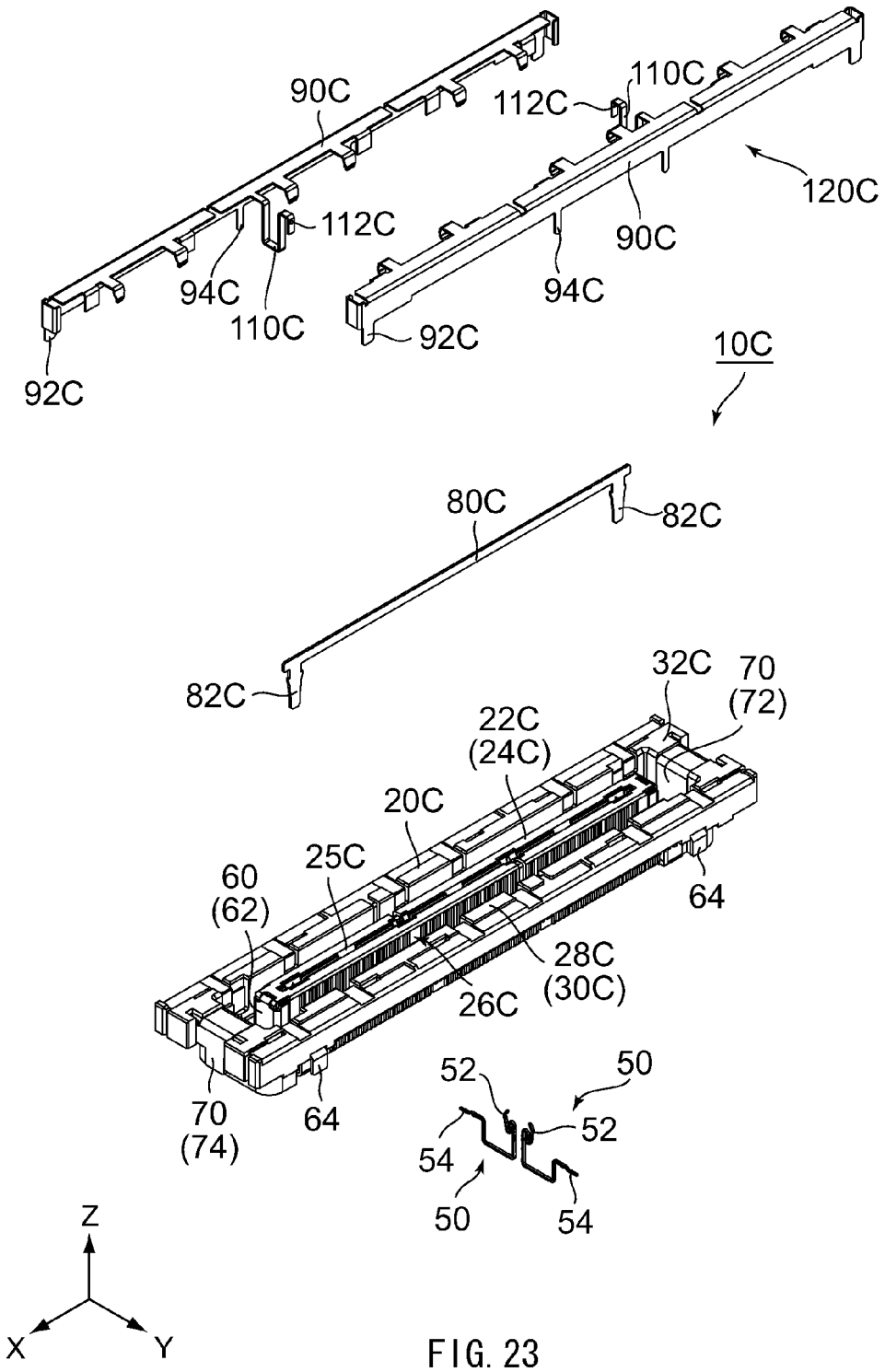
FIG. 23 is a partially exploded, perspective view showing the connector of FIG. 21.
Figure 26:
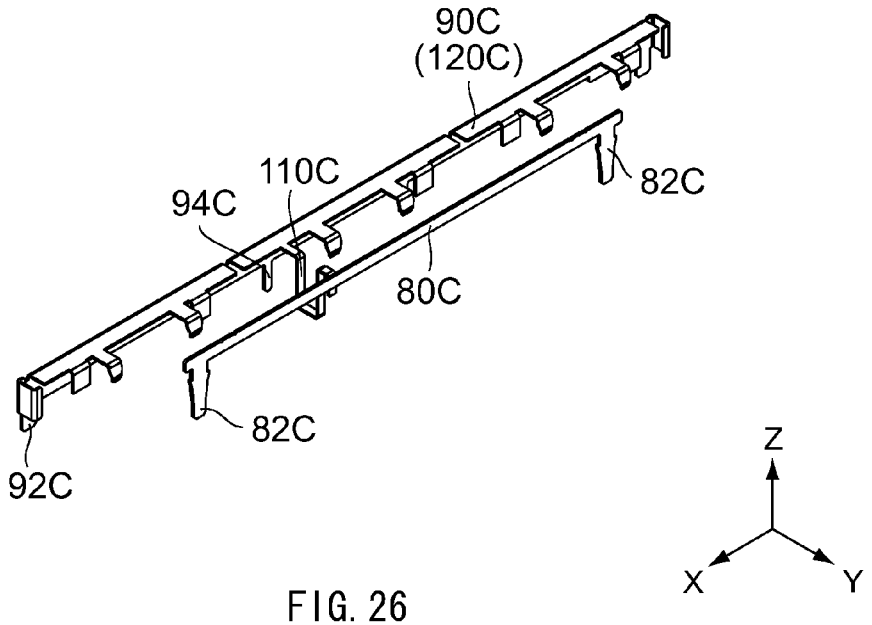
FIG. 26 is a perspective view showing the metal member and a shell of the connector of FIG. 21 in a state where the metal member and the shell are connected to each other.
Figure 27:
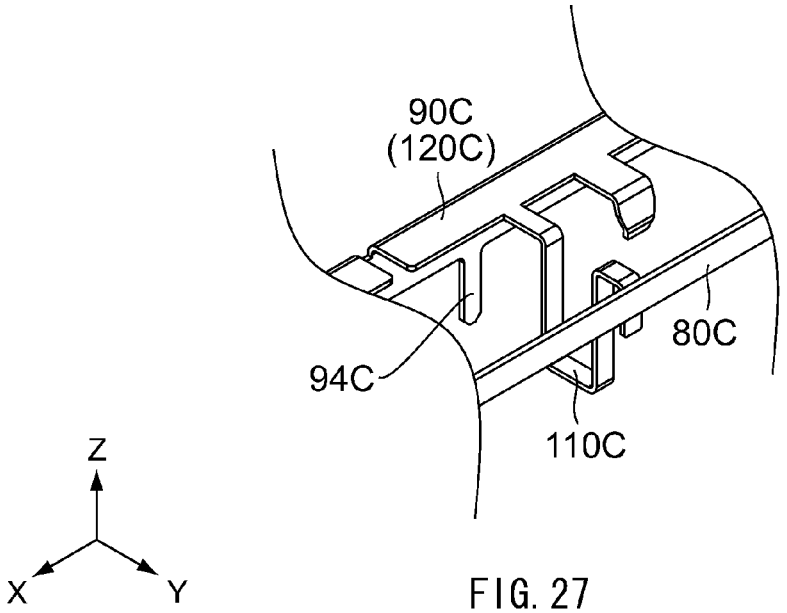
FIG. 27 is a partially enlarged, perspective view showing the metal member and the shell of FIG. 26.

Referring to FIGS. 21, 23 and 26, the connector 10C according to the present embodiment comprises a housing 20C made of an insulating material, a plurality of the signal contacts 50 each made of the conductive material, the power contacts 60 and the power contacts 70 each made of the conductive material, a metal plate 800 and a metal member 120C.

Figure 24:
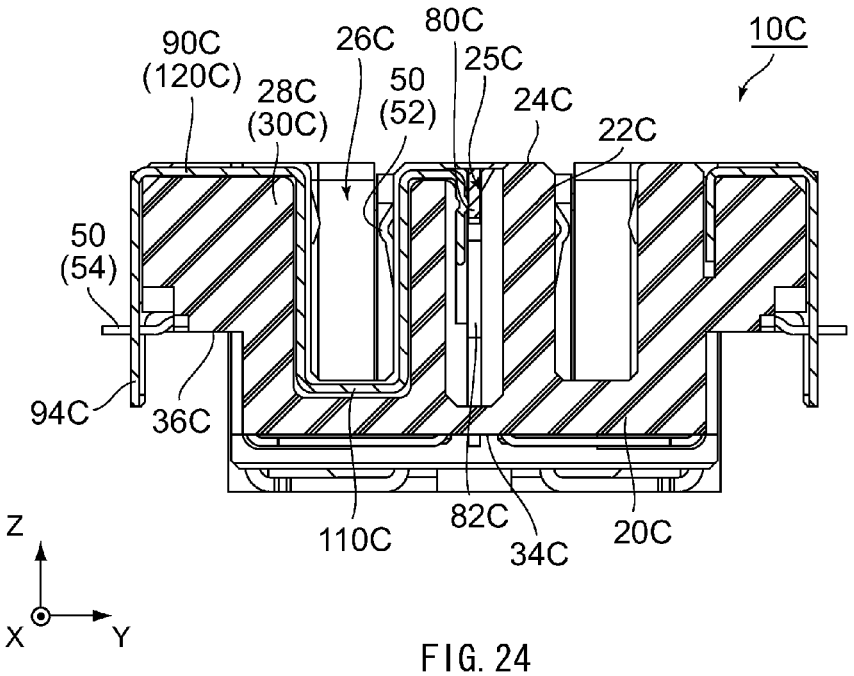
FIG. 24 is a cross-sectional view showing the connector of FIG. 21, taken along C-C lines.
Figure 25:
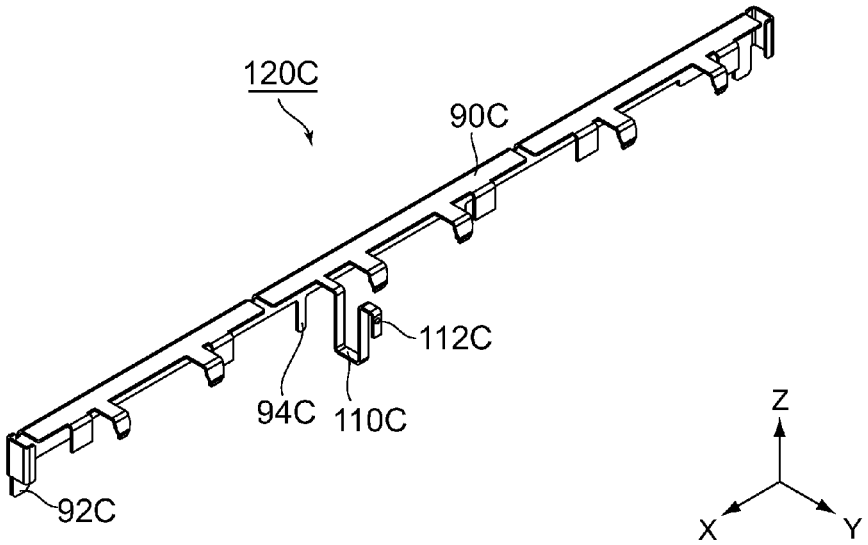
FIG. 25 is a perspective view showing a metal member of the connector of FIG. 21.

As shown in FIGS. 21, 23 and 24, the housing 20C has a land 22C, a recess 26C and a peripheral portion 28C. The land 22C extends long in the X-direction (first direction) while having a mating end 24C in the Z-direction (second direction). The recess 26C is formed so as to surround the land 22C in the XY-plane. The peripheral portion 28C is formed so as to surround the recess 26C in the XY-plane. The land 22C is formed with a slit-like holding portion 25C. The holding portion 25C extends in the X-direction in the mating end 24C while extending from the mating end 24C along the negative Z-direction. The recess 26C is recessed in the negative Z-direction. The peripheral portion 28C has two long walls 300 extending along the X-direction and two short walls 32C extending along the Y-direction (third direction). The recess 26C is located between the long wall 30C and the land 22C in the Y-direction. In other words, the land 22C and the long wall 30C are provided so as to have the recess 26C therebetween in the Y-direction. Similarly, the recess 260 is located between the short wall 32C and the land 22C in the X-direction.

Figure 22:
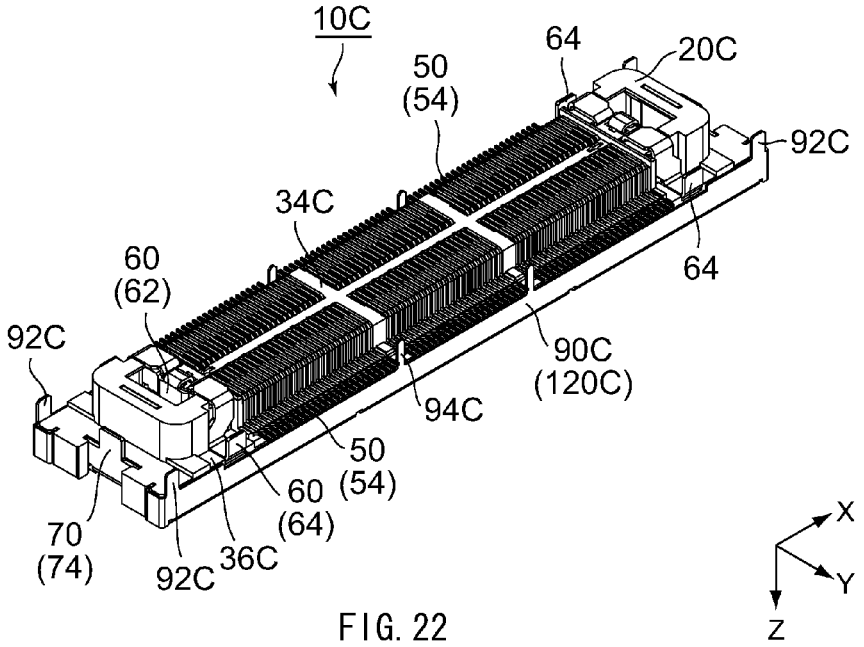
FIG. 22 is a bottom, perspective view showing the connector of FIG. 21.

As can be seen from FIGS. 22 and 24, the housing 20C has a bottom portion which is mostly comprised of a central bottom 34C and a peripheral bottom 36C. The central bottom 34C and the peripheral bottom 36C are located at a lower side of the housing 20C in the Z-direction. The peripheral bottom 36C is located so as to surround the central bottom 34C. As can be seen from FIG. 24, as seen along the Z-direction, the land 22C and the recess 260 are located within a region corresponding to the central bottom 34C.

As shown in FIGS. 21 and 22, the signal contacts 50, the power contacts 60 and the power contacts 70 are held by the housing 20C. The signal contact 50 is press-fitted in the housing 20C from a side opposite to the mating end 24C (i.e. from the bottom portion which is located at the negative Z-side of the housing 20C). The signal contact 50 is held by the housing 20C so that the contact-point part 52 is exposed in the recess 26C. As shown in FIG. 21, the contact-point part 62 of each of the power contacts 60 is provided in the recess 260 so as to cover the end of the land 22C in the X-direction. As shown in FIG. 21, the connector 10C according to the present embodiment comprises the two power contacts 70. The power contacts 70 are provided so as to straddle the short walls 32C, respectively. The contact-point part 72 of the power contact 70 is provided in the recess 26C so as to face the contact-point part 62 of the power contact 60.

As shown in FIG. 23, the metal plate 800 according to the present embodiment has two press-fit portions 820. As shown in FIGS. 21 and 24, the metal plate 800 is press-fitted in the holding portion 25C (i.e. into the land 22C) from the mating end 24C of the housing 200 to be held by the holding portion 250 (i.e. by the land 22C). The metal plate 80C held by the holding portion 25C is visible along the negative Z-direction.

As shown in FIGS. 23 to 27, the metal member 120C according to the present embodiment is comprised of two members having similar shapes to each other. Each of the two members of the metal member 1200 is integrally formed from a coupling member 1100 made of a metal, and a part of a shell (connection member) 900 made of a metal. In other words, the coupling member 1100 according to the present embodiment is integrally formed with the shell (connection member) 900. More specifically, each of the two members constituting the metal member 120C is formed by pressing and bending a single base metal plate. The coupling member 1100 is provided with a dowel 1120. The shell 90C has a plurality of fixed portions 920 and a plurality of fixed portions 94C. When the connector 10C is mounted on and fixed to the circuit board 200, the fixed portions 920 are connected to the through holes 210 (see FIG. 3), respectively, while the fixed portions 940 are connected to the through holes 208 (see FIG. 3), respectively. The metal member 1200 is attached to the housing 20C so that the coupling members 1100 are inserted in the recess 26C while the shells 90C at least partially cover the long walls 300 of the peripheral portion 28C, respectively.

As shown in FIG. 24, the coupling member 110C extends from the shell 90C to the inside of the holding portion 250 of the land 22C while passing through the recess 26C. The dowel 112C of the coupling member 110C is pressed against and brought into contact with the metal plate 800 so that the metal member 120C and the metal plate 800 are electrically connected to each other. Similar to the first embodiment, the metal member 120C and the metal plate 80C are connected at a position which is apart from any one of the opposite ends of the land 220 in a lengthwise direction (the X-direction or the first direction). Accordingly, according to the present embodiment, similar to the first embodiment, it is possible to efficiently use the opposite ends of the land 22C in the lengthwise direction. It is therefore possible to provide the power contacts 60 and the power contacts 70 while preventing the connector 100 becoming large.

According to the aforementioned first, second and third embodiments, the metal plates 80A, 80B and 80C of the connectors 10A, 10B and 10C are electrically connected to the shell (connection member) 90A, 90B and 90C by the coupling member 110A, 110B and 110C, respectively. In other words, the connection member according to the first, second or third embodiments is formed as a part of the shell. However, the connector may be provided with a connection member other than the shell. In other words, the connection member may be formed as a member separate from the shell. In this case, the metal plate may be electrically connected to thus configured connection member by the coupling member.

Fourth Embodiment

Referring to FIGS. 28 to 31, a connector 10D according to a fourth embodiment of the present invention is a so-called drop-in connector fixable to an object. The connector 100 is a modification of the connector 100 according to the aforementioned third embodiment so that the connector 10D has the almost same structure as the connector 100. Accordingly, in Figures and the following description, similar or same reference signs are used to designate the elements of the connector 10D which are similar to or same as the elements of the connector 100, respectively. It is not described or simply described about the similar or same elements in the following description while it is mainly described about differences of the connector 10D from the connector 100.

Figure 28:
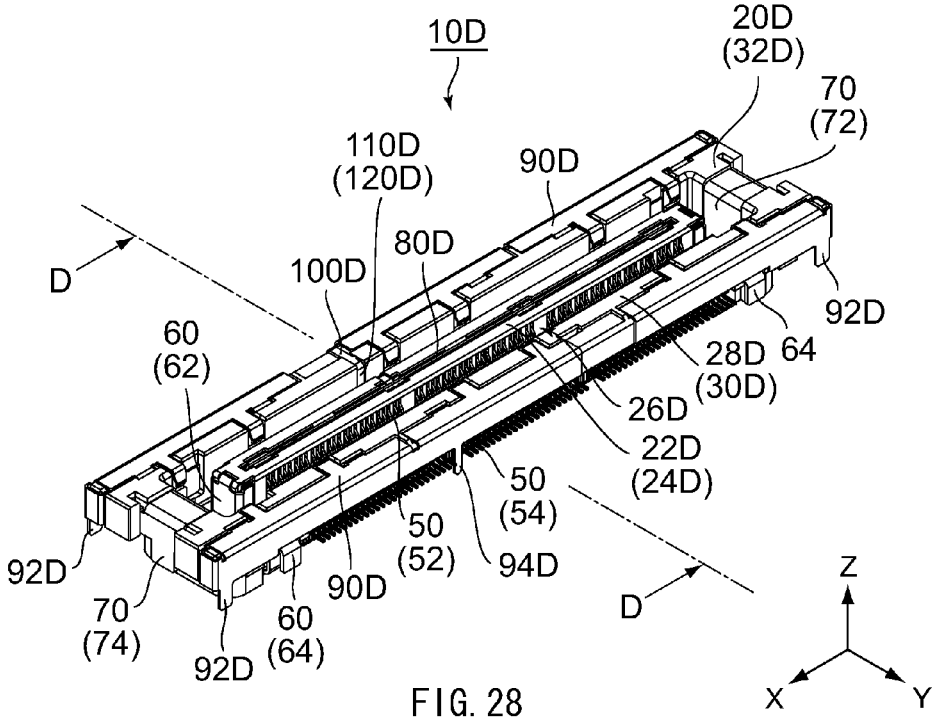
FIG. 28 is a top, perspective view showing a connector according to a fourth embodiment of the present invention.
Figure 30:
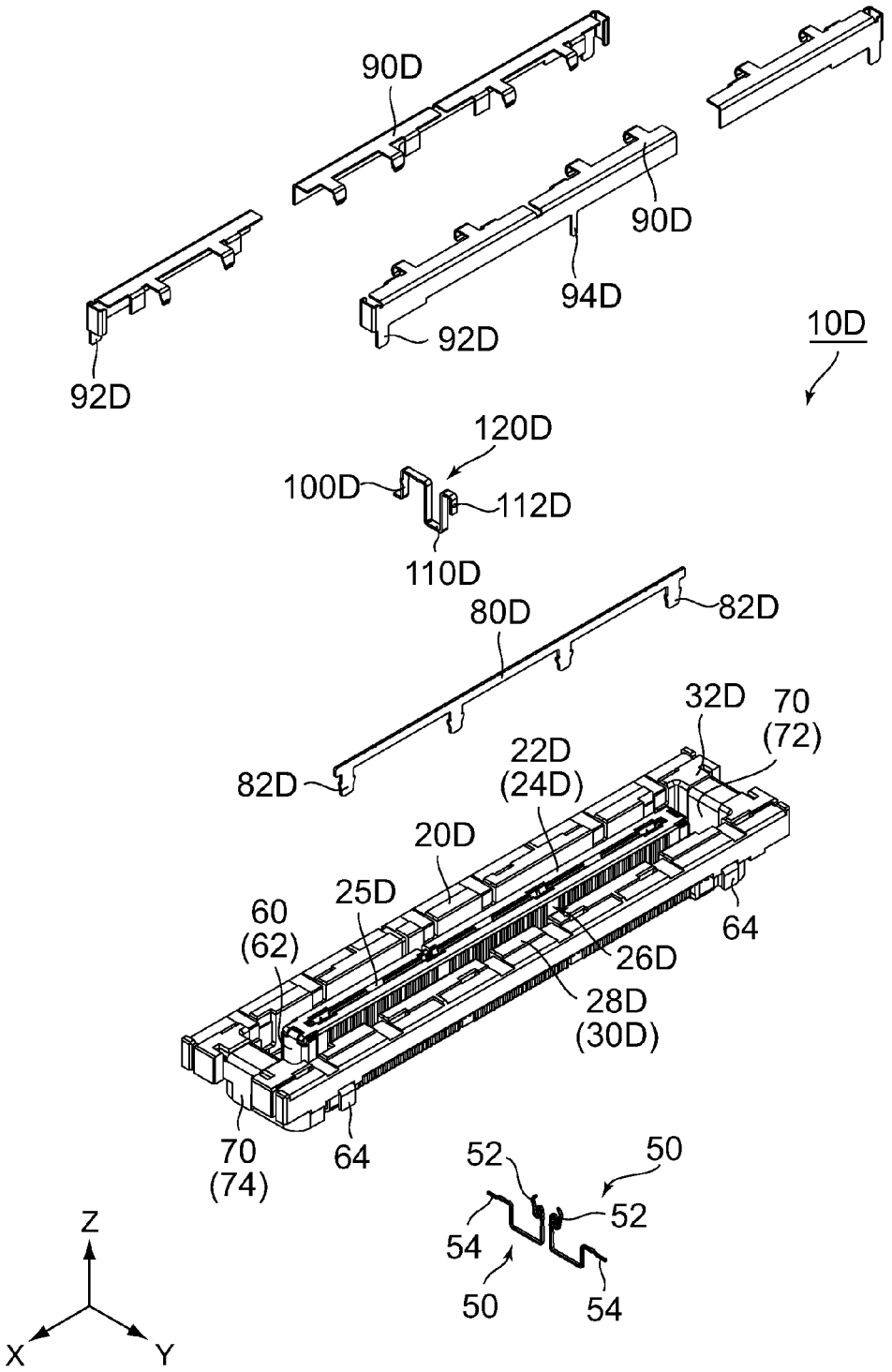
FIG. 30 is a partially exploded, perspective view showing the connector of FIG. 28.
Figure 31:
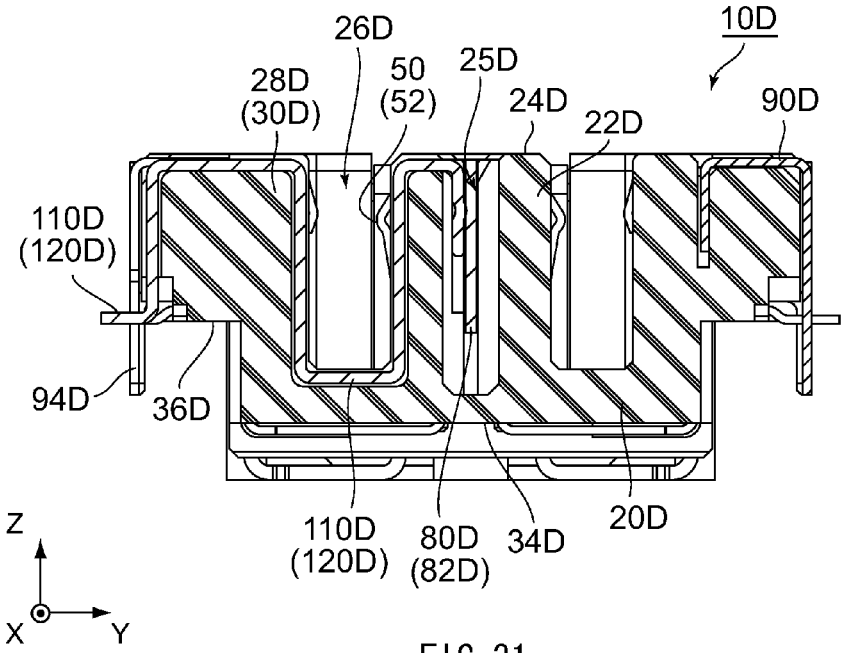
FIG. 31 is a cross-sectional view showing the connector of FIG. 28, taken along D-D lines.
Figure 32:
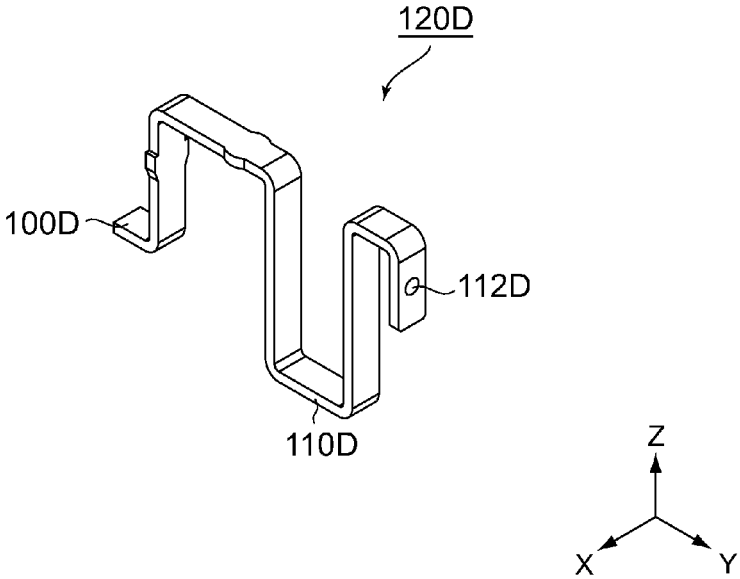
FIG. 32 is a perspective view showing a metal member of the connector of FIG. 28.
Figure 33:
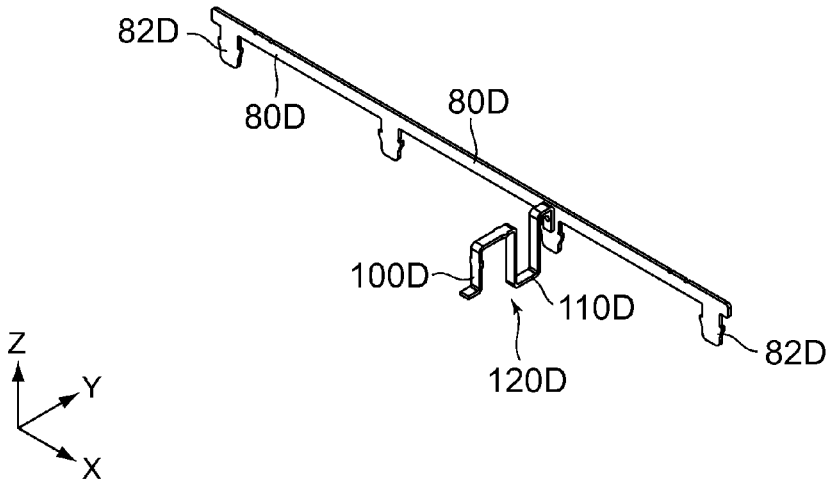
FIG. 33 is a perspective view showing the metal member and a shell of the connector of FIG. 28 in a state where the metal member and the shell are connected to each other.
Figure 34:
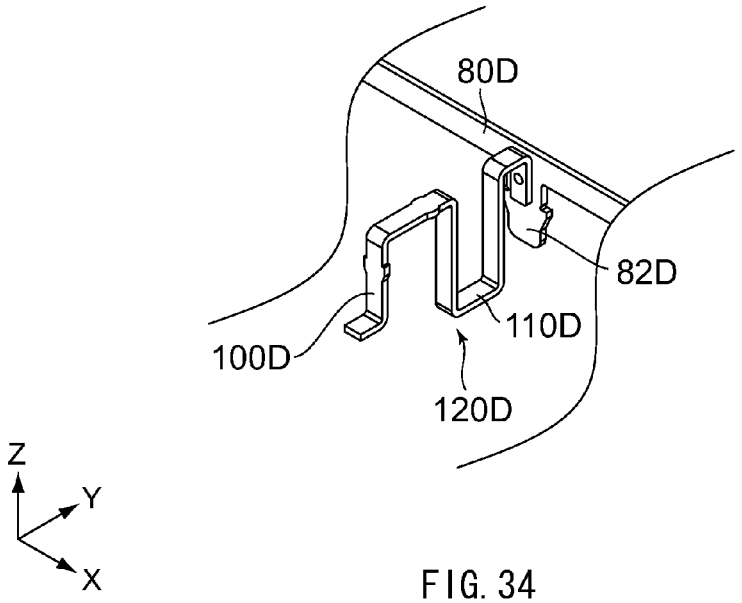
FIG. 34 is a partially enlarged, perspective view showing the metal member and the shell of FIG. 33.

Referring to FIGS. 28, 30 and 31, the connector 10D according to the present embodiment comprises a housing 200 made of an insulating material, a plurality of the signal contacts 50 each made of the conductive material, the power contacts 60 and the power contacts 70 each made of the conductive material, a metal plate 80D, a shell 90D made of a metal and a metal member 120D which is a member other than the shell 90D.

As shown in FIGS. 28, 30 and 31, the housing 20D has a land 22D, a recess 26D and a peripheral portion 28D. The land 22D extends long in the X-direction (first direction) while having a mating end 240 in the Z-direction (second direction). The recess 260 is formed so as to surround the lard 22D in the XY-plane. The peripheral portion 28D is formed so as to surround the recess 26D in the XY-plane. The land 22D is formed with a slit-like holding portion 25D. The holding portion 25D extends in the X-direction in the mating end 24D while extending from the mating end 24D along the negative Z-direction. The recess 26L) is recessed in the negative Z-direction. The peripheral portion 280 has two long walls 30D extending along the X-direction and two short walls 32D extending along the Y-direction (third direction). The recess 26D is located between the long wall 30D and the land 22D in the Y-direction. In other words, the land 22D and the long wall 30D are provided so as to have the recess 26D therebetween in the Y-direction. Similarly, the recess 26D is located between the short wall 32D and the land 22D in the X-direction.

Figure 29:
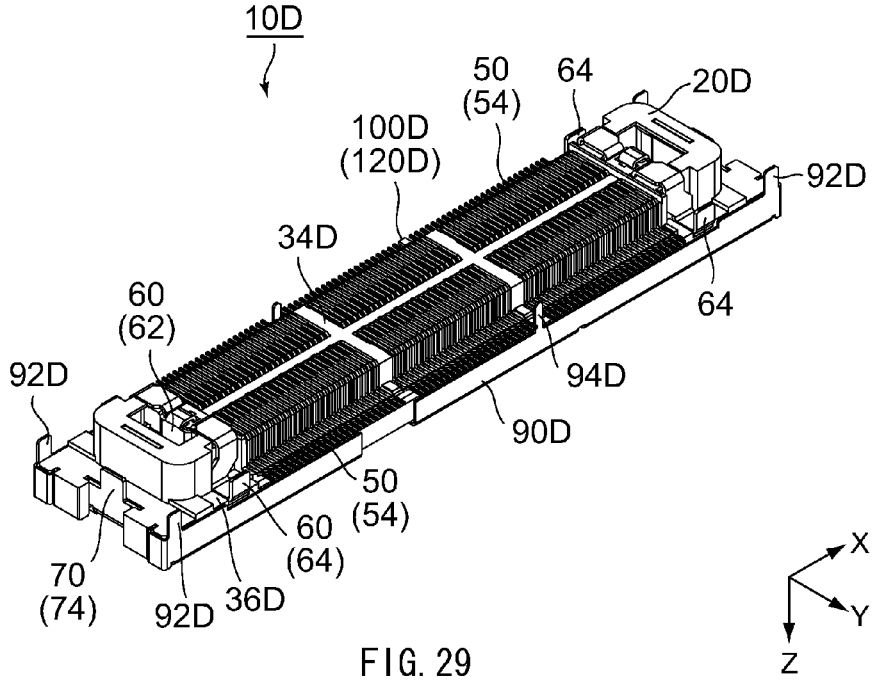
FIG. 29 is a bottom, perspective view showing the connector of FIG. 28.

As can be seen from FIGS. 29 and 31, the housing 200 has a bottom portion which is mostly comprised of a central bottom 340 and a peripheral bottom 360. The central bottom 340 and the peripheral bottom 36D are located at a lower side of the housing 20D in the Z-direction. The peripheral bottom 36D is located so as to surround the central bottom 34D. As can be seen from FIG. 31, as seen along the Z-direction, the land 22D and the recess 260 are located within a region corresponding to the central bottom 34D.

As shown in FIGS. 28 and 29, the signal contacts 50, the power contacts 60 and the power contacts 70 are held by the housing 20D. The signal contact 50 is press-fitted in the housing 20D from a side opposite to the mating end 24D (i.e. from the bottom portion which is located at the negative Z-side of the housing 200). The signal contact 50 is held by the housing 20D so that the contact-point part 52 is exposed in the recess 26D. As shown in FIG. 28, the contact-point part 62 of each of the power contacts 60 is provided in the recess 26D so as to cover the end of the land 22D in the X-direction. As shown in FIG. 28, the connector 10D according to the present embodiment comprises the two power contacts 70. The power contacts 70 are provided so as to straddle the short walls 32D, respectively. The contact-point part 72 of the power contact 70 is provided in the recess 26D so as to face the contact-point part 62 of the power contact 60.

As shown in FIG. 30, the metal plate 80D according to the present embodiment has a plurality of press-fit portions 82D. As shown in FIGS. 28 and 31, the metal plate 800 is press-fitted in the land 220 of the housing 20D from the mating end 24D to be held by the land 220. The metal plate 80D held by the land 22D is visible along the negative Z-direction.

As shown in FIGS. 28 and 30, the shell 90D according to the present embodiment is comprised of a pair of sub-members having similar shapes to each other. Each of the sub-members is comprised of a plurality of metal pieces (according to the present embodiment, two metal pieces). The two sub-members of the shell 90G cover the long walls 300 of the peripheral portion 28D, respectively. In other words, the shell 90G at least partially covers the long wall 30D. The shell 90D is formed with a plurality of fixed portions 920 configured to be connected to the through holes 210 (see FIG. 3), respectively, and a plurality of fixed portions 940 configured to be connected to the through holes 208 (see FIG. 3), respectively.

The two sub-members of the shell 90D according to the present embodiment correspond, for example, to the two members which constitute the shell 90B according to the second embodiment (see FIG. 16). More specifically, each of the two members of the shell 90B has the two fixed portions 94B. The aforementioned member of the shell 90B is divided into two at a part where one of the two fixed portions 94B is formed so that the sub-member of the shell 90D according to the present embodiment is formed.

As shown in FIGS. 30 to 34, the metal member 120D according to the present embodiment is integrally formed from a connection member 100D made of a metal and a coupling member 110D made of a metal. The connection member 100D is provided as a member other than the shell 90D. More specifically, the metal member 120D is formed by pressing and bending a single base metal plate. The coupling member 110D is provided with a dowel 1120 while the connection member 100D is formed with a press-fit protrusion. The metal member 120D is attached to the housing 20D. In detail, the coupling member 110D of the metal member 120D is inserted in the recess 260. The connection member 100D of the metal member 1200 is press-fitted in the long wall 30D of the peripheral portion 28D at a position corresponding to one of the through holes 208 (see FIG. 3).

As shown in FIG. 31, the coupling member 1100 extends from the connection member 100D to the inside of the hoiding portion 25D of the land 22D while passing through the recess 26D. The dowel 1120 of the coupling member 110D is pressed against and brought into contact with the metal plate 800 so that the metal member 120D and the metal plate 80D are electrically connected to each other. Similar to the first embodiment, the metal member 120D and the metal plate 800 are connected at a position which is apart from any one of the opposite ends of the land 220 in a lengthwise direction (the X-direction or the first direction). Accordingly, according to the present embodiment, similar to the first embodiment, it is possible to efficiently use the opposite ends of the land 220 in the lengthwise direction. It is therefore possible to provide the power contacts 60 and the power contacts 70 while preventing the connector 10D becoming large.

Fifth Embodiment

Referring to FIGS. 35 to 38, a connector 10E according to a fifth embodiment of the present invention is a so-called drop-in connector fixable to an object. The connector 10E is a modification of the connector 10D according to the aforementioned fourth embodiment so that the connector 10E has the almost same structure as the connector 10D. Accordingly, in Figures and the following description, similar or same reference signs are used to designate the elements of the connector 10E which are similar to or same as the elements of the connector 10D, respectively. It is not described or simply described about the similar or same elements in the following description while it is mainly described about differences of the connector 10E from the connector 10D.

Figure 35:
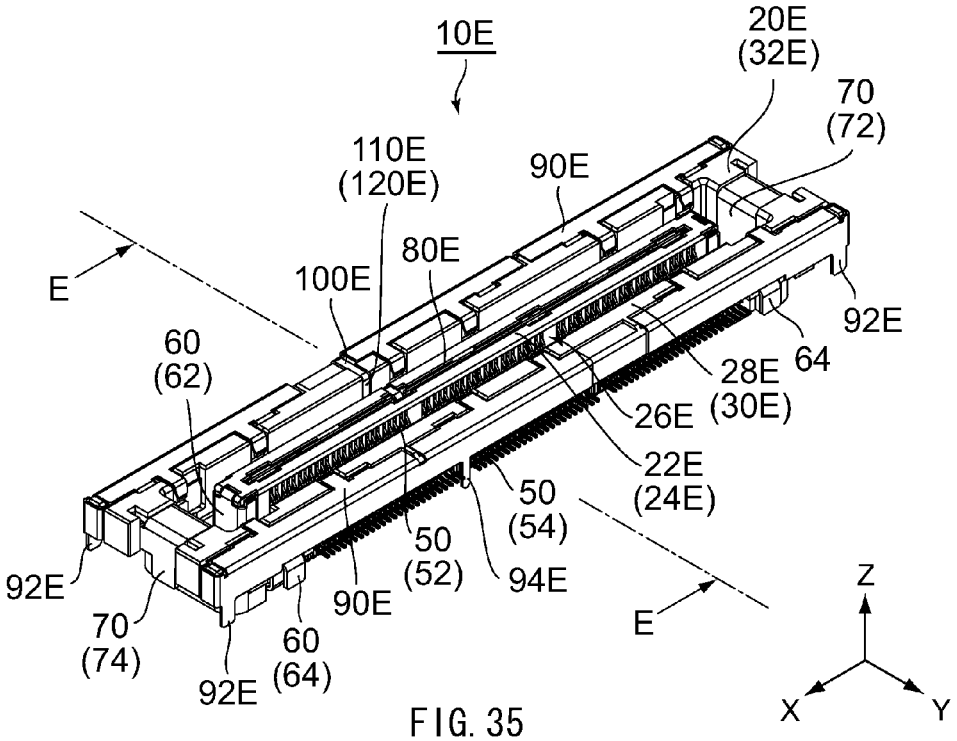
FIG. 35 is a top, perspective view showing a connector according to a fifth embodiment of the present invention.
Figure 37:
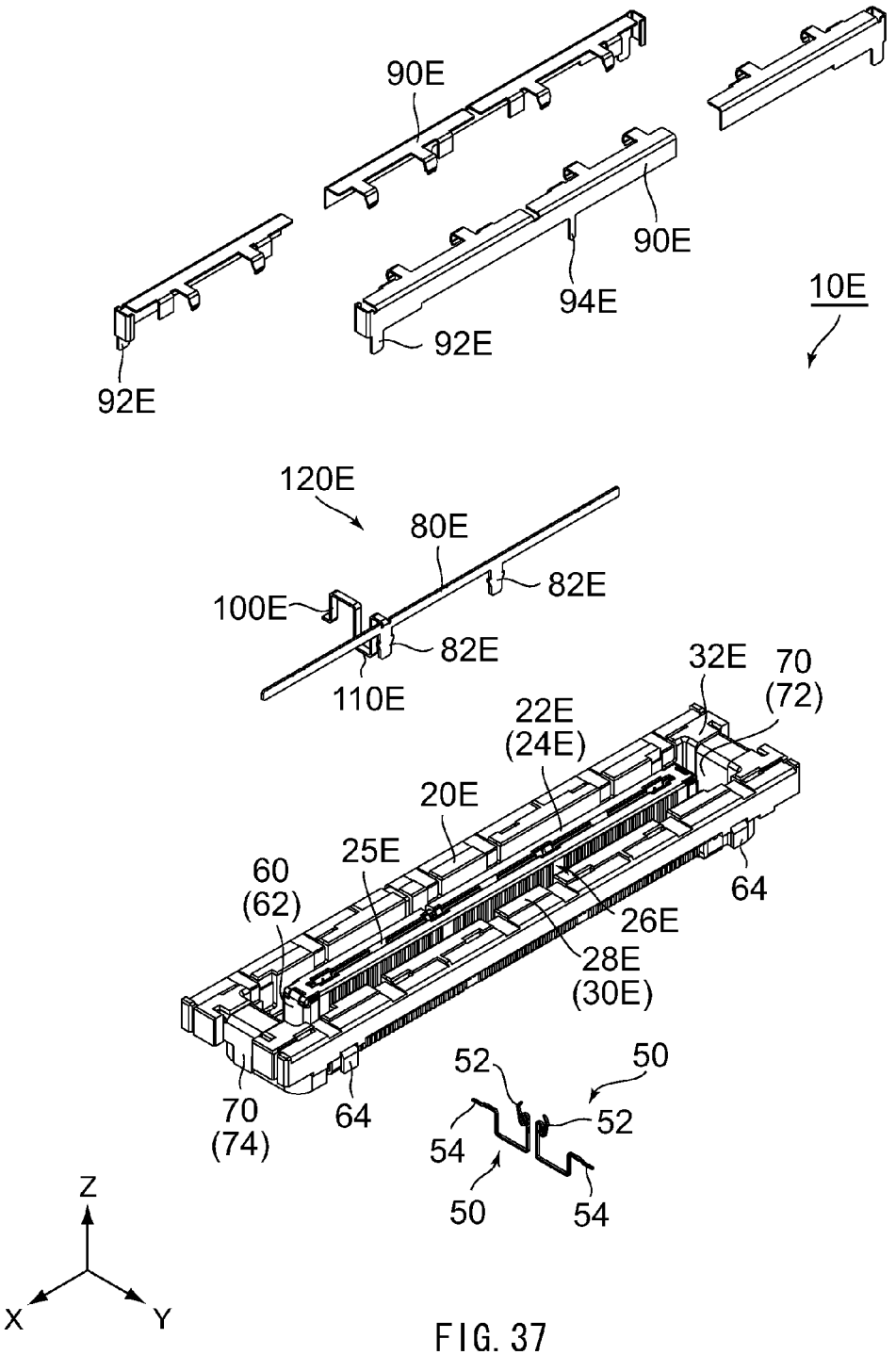
FIG. 37 is a partially exploded, perspective view showing the connector of FIG. 35.
Figure 38:
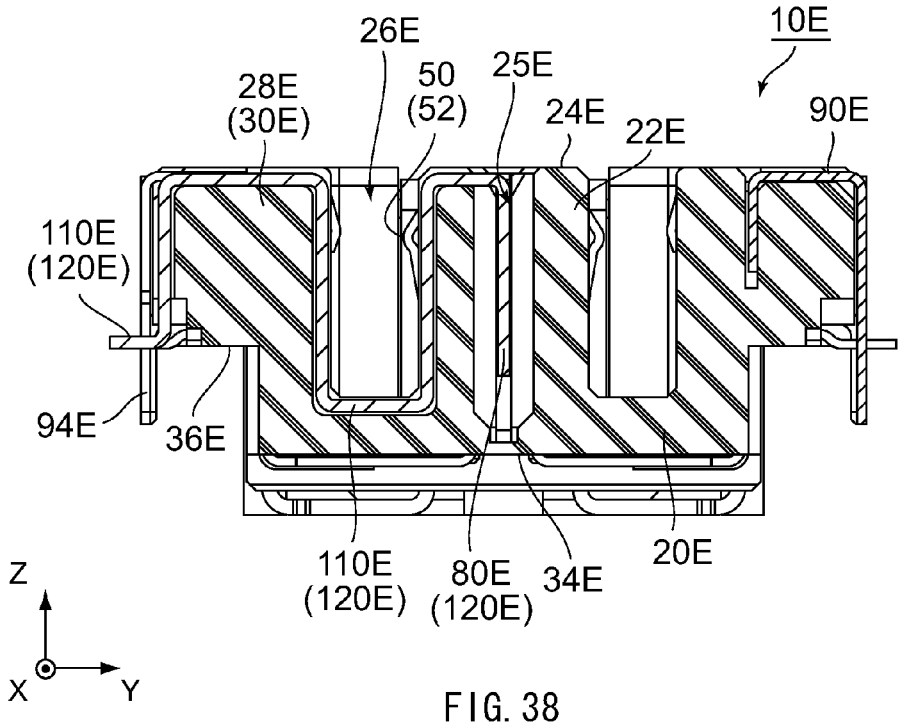
FIG. 38 is a cross-sectional view showing the connector of FIG. 35, taken along E-E lines.

Referring to FIGS. 35, 37 and 38, the connector 10E according to the present embodiment comprises a housing 20E made of an insulating material, a plurality of the signal contacts 50 each made of the conductive material, the power contacts 60 and the power contacts 70 each made of the conductive material, a shell 90E made of a metal and a metal member 120E which is a member other than the shell 90E.

As shown in FIGS. 35, 37 and 38, the housing 20E has a land 22E, a recess 26E and a peripheral portion 28E. The land 22E extends long in the X-direction (first direction) while having a mating end 24E in the Z-direction (second direction). The recess 26E is formed so as to surround the land 22E in the XY-plane. The peripheral portion 28E is formed so as to surround the recess 26E in the XY-plane. The land 22E is formed with a slit-like holding portion 25E. The holding portion 25E extends in the X-direction in the mating end 24E while extending from the mating end 24E along the negative Z-direction. The recess 26E is recessed in the negative Z-direction. The peripheral portion 28E has two long walls 30E extending along the X-direction and two short walls 32E extending along the Y-direction (third direction). The recess 26E is located between the long wall 30E and the land 22E in the Y-direction. In other words, the land 22E and the long wall 30E are provided so as to have the recess 26E therebetween in the Y-direction. Similarly, the recess 26E is located between the short wall 32E and the land 22E in the X-direction.

Figure 36:
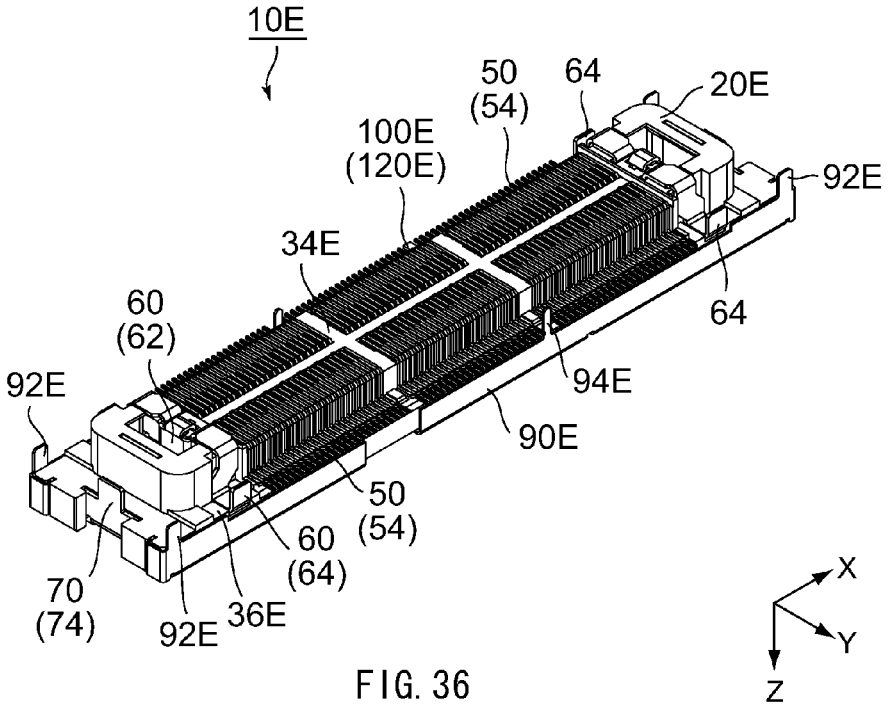
FIG. 36 is a bottom, perspective view showing the connector of FIG. 35.

As can be seen from FIGS. 36 and 38, the housing 20E has a bottom portion which is mostly comprised of a central bottom 34E and a peripheral bottom 36E. The central bottom 34E and the peripheral bottom 36E are located at a lower side of the housing 20E in the Z-direction. The peripheral bottom 36E is located so as to surround the central bottom 34E. As can be seen from FIG. 38, as seen along the Z-direction, the land 22E and the recess 26E are located within a region corresponding to the central bottom 34E.

As shown in FIGS. 35 and 36, the signal contacts 50, the power contacts 60 and the power contacts 70 are held by the housing 20E. The signal contact 50 is press-fitted in the housing 20E from a side opposite to the mating end 24E (i.e. from the bottom portion which is located at the negative Z-side of the housing 20E). The signal contact 50 is held by the housing 20E so that the contact-point part 52 is exposed in the recess 26E. As shown in FIG. 35, the contact-point part 62 of each of the power contacts 60 is provided in the recess 26E so as to cover the end of the land 22E in the X-direction. As shown in FIG. 35, the connector 10E according to the present embodiment comprises the two power contacts 70. The power contacts 70 are provided so as to straddle the short walls 32E, respectively. The contact-point part 72 of the power contact 70 is provided in the recess 26E so as to face the contact-point part 62 of the power contact 60.

As shown in FIGS. 35 and 37, similar to the shell 90D according to the fourth embodiment, the shell 90E according to the present embodiment is comprised of a pair of sub-members having similar shapes to each other. The two sub-members of the shell 90E cover the long walls 30E of the peripheral portion 28E, respectively. The shell 90E is formed with a plurality of fixed portions 92E configured to be connected to the through holes 210 (see FIG. 3), respectively, and a plurality of fixed portions 94E configured to be connected to the through holes 208 (see FIG. 3), respectively.

Figure 39:
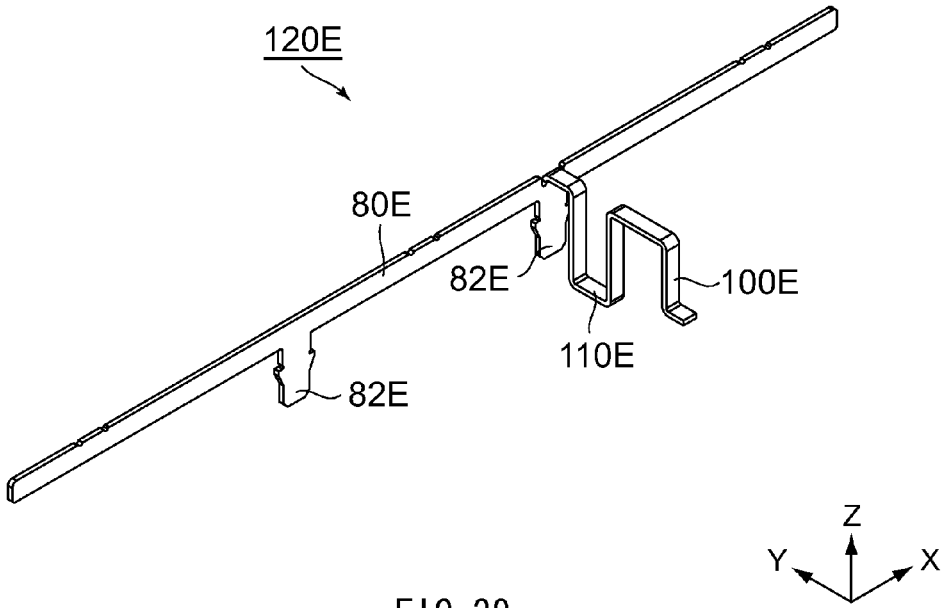
FIG. 39 is a perspective view showing a metal member of the connector of FIG. 35.

As shown in FIGS. 37 to 39, the metal member 120E according to the present embodiment is integrally formed from a connection member 100E made of a metal, a metal plate 80E and a coupling member 110E made of a metal. The connection member 100E is provided as a member other than the shell 90E. More specifically, the metal member 120E is formed by pressing and bending a single base metal plate.

As shown in FIGS. 37 and 39, the metal plate 80E, has a plurality of press-fit portions 82E. As shown in FIGS. 35, 37 and 38, the metal plate 80E is press-fitted in the land 22E of the housing 20E from the mating end 24E to be held by the land 22E. The metal plate 80E held by the land 22E is visible along the negative Z-direction. The coupling member 110E is inserted in the recess 26E. The connection member 100E is attached to the long wall 30E of the peripheral portion 28E at a position corresponding to one of the through holes 208 (see FIG. 3). The metal member 120E is attached to the housing 20E in the manner as described above.

As shown in FIG. 38, the metal plate 80E, the connection member 100E and the coupling member 110E of the metal member 120E constitute an electric path which extends from the inside of the holding portion 25E of the land 22E to the outside of the long wall 30E of the peripheral portion 28E. The coupling member 110E and the connection member 100E of the metal member 120E are attached to the housing 20E at a position which is apart from any one of the opposite ends of the land 22E in a lengthwise direction (the X-direction or the first direction). Accordingly, according to the present embodiment, it is also possible to efficiently use the opposite ends of the land 22E in the lengthwise direction. It is therefore possible to provide the power contacts 60 and the power contacts 70 while preventing the connector 10E becoming large.

According to the aforementioned first to fifth embodiments, the coupling members 110A to 110E of the connectors 10A to 10E are inserted in the recesses 26A to 26E from the mating ends 24A to 24E (i.e. from the positive Z-side) so as to be held by the housings 20A to 20E, respectively. However, the connector may be configured differently. For example, the coupling member may be inserted in the housing from a side opposite to the mating end (i.e. from the bottom portion which is located at the negative Z-side of the housing) so that the coupling member may be held by the housing.

Sixth Embodiment

Referring to FIGS. 40 to 44, a connector 10F according to a sixth embodiment of the present invention is a so-called drop-in connector fixable to an object. The connector 10F is a modification of the connector 10A according to the previously described first embodiment so that the connector 10F has the almost same structure as the connector 10A. Accordingly, in Figures and the following description, similar or same reference signs are used to designate the elements of the connector 10F which are similar to or same as the elements of the connector 10A, respectively. It is not described or simply described about the similar or same elements in the following description while it is mainly described about differences of the connector 10F from the connector 10A.

Figure 40:
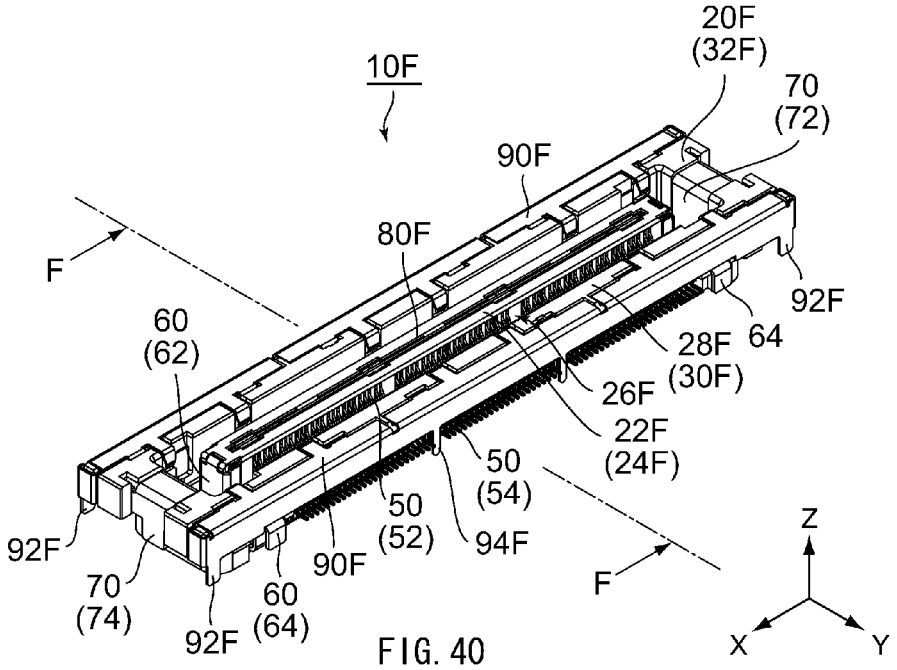
FIG. 40 is a top, perspective view showing a connector according to a sixth embodiment of the present invention.
Figure 43:
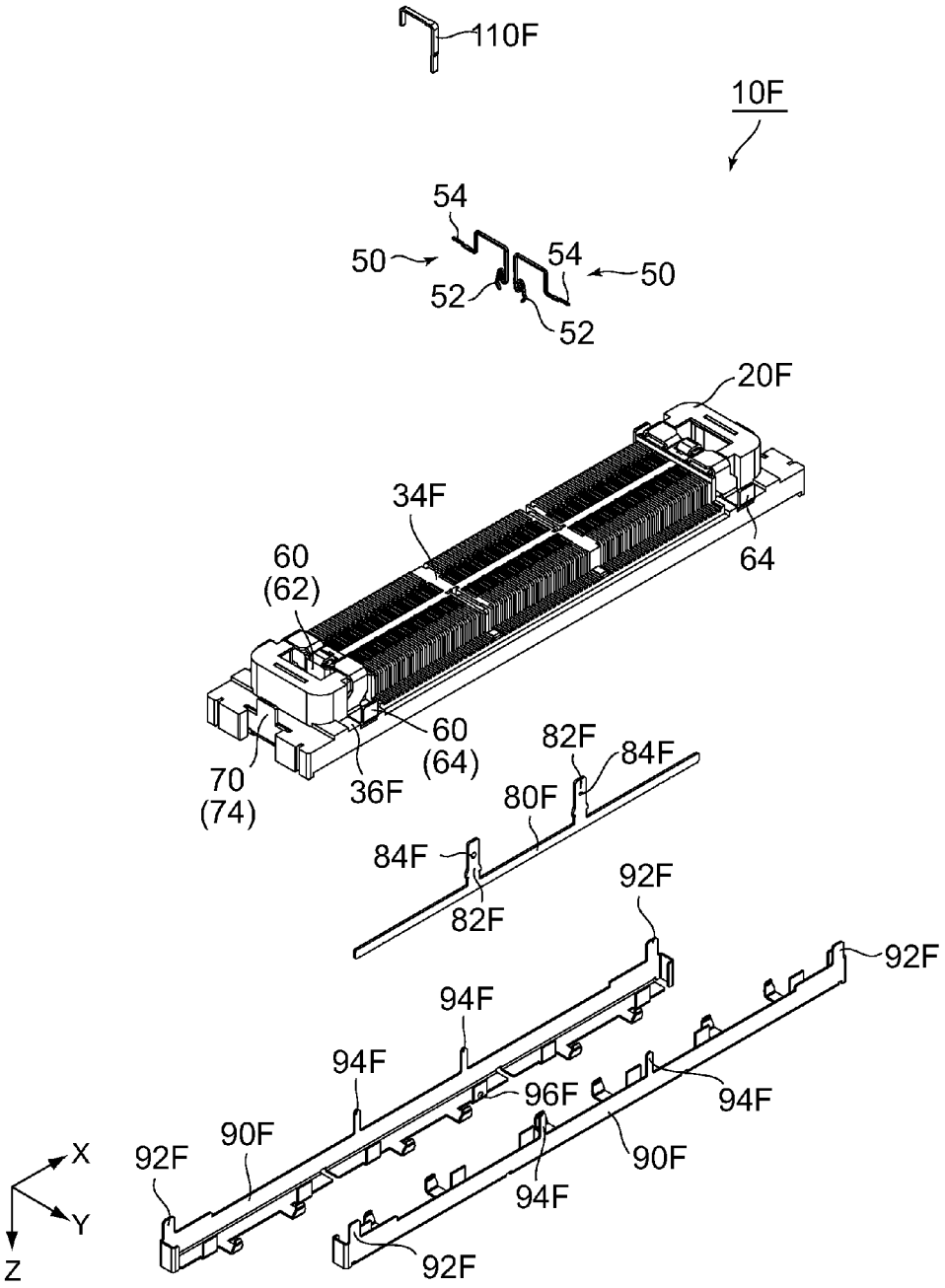
FIG. 43 is a partially exploded, perspective view showing the connector of FIG. 41.
Figure 44:
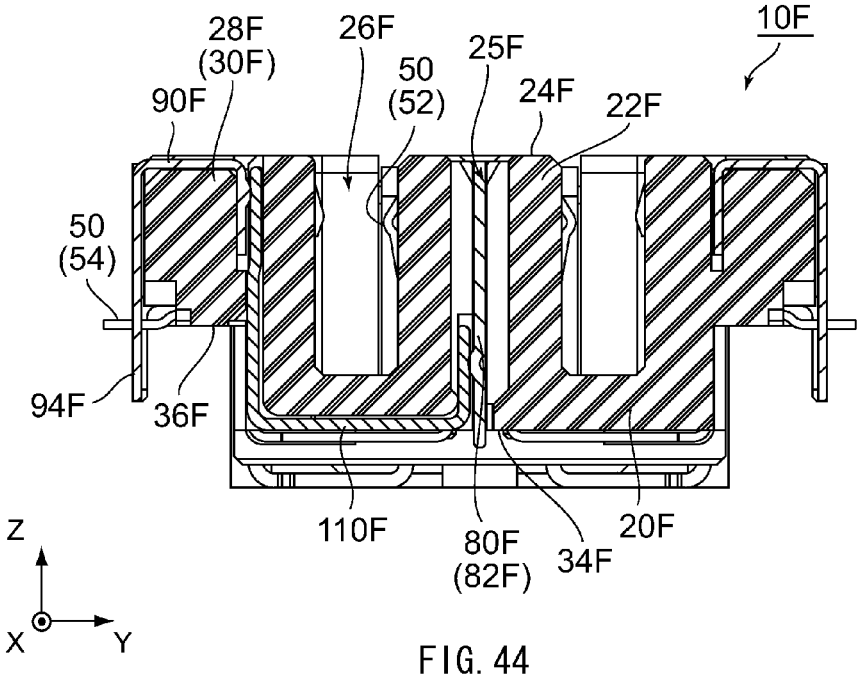
FIG. 44 is a cross-sectional view showing the connector of FIG. 40, taken along F-F lines.

Referring to FIGS. 40, 43 and 44, the connector 10F according to the present embodiment comprises a housing 20F made of an insulating material, a plurality of the signal contacts 50 each made of the conductive material, the power contacts 60 and the power contacts 70 each made of the conductive material, a metal plate 80F for ESD protection, a shell (connection member) 90F made of a metal and a coupling member 110F made of a metal.

As shown in FIGS. 40 and 44, the housing 20F has a land 22F, a recess 26F and a peripheral portion 28F. The land 22F extends long in the X-direction (first direction) while having a mating end 24F in the Z-direction (second direction). The recess 26F is formed so as to surround the land 22F in the XY-plane. The peripheral portion 28F is formed so as to surround the recess 26F in the XY-plane. The land 22F is formed with a slit-like holding portion 25F. The holding portion 25F extends in the X-direction in the mating end 24F while extending from the mating end 24F along the negative Z-direction. The recess 26F is recessed in the negative Z-direction. The peripheral portion 28F has two long walls 30F extending along the X-direction and two short walls 32F extending along the Y-direction (third direction). The recess 26 located between the long wall 30F and the land 22F in the Y-direction. In other words, the land 22F and the long wall 30F are provided so as to have the recess 26F therebetween in the Y-direction. Similarly, the recess 26F is located between the short wall 32F and the land 22F in the X-direction.

Figure 41:
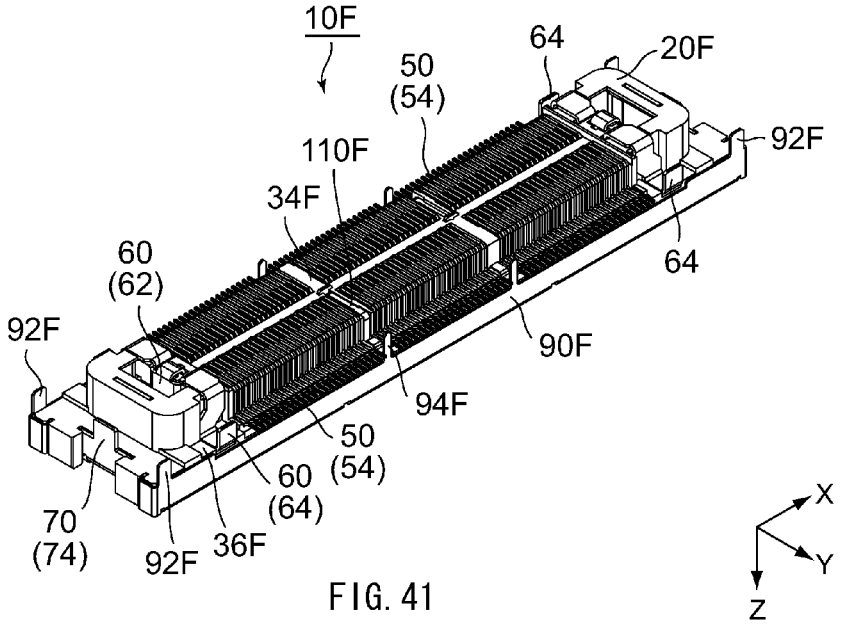
FIG. 41 is a bottom, perspective view showing the connector of FIG. 40.
Figure 42:
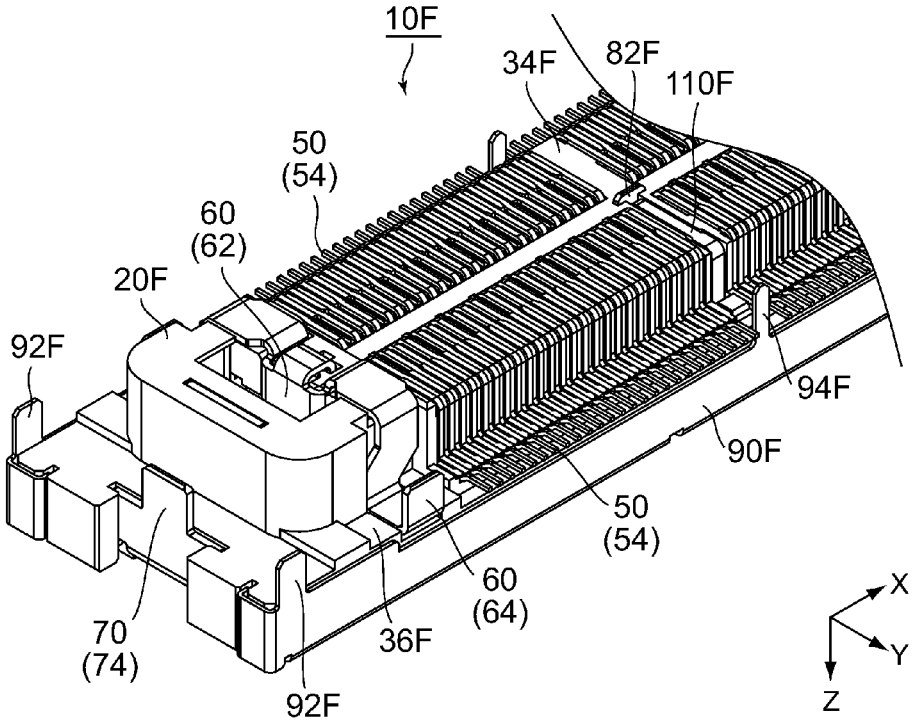
FIG. 42 is a partially-enlarged, bottom, perspective view showing the connector of FIG. 41.

As can be seen from FIGS. 41, 42 and 44, the housing 20F has a bottom portion which is mostly comprised of a central bottom 34F and a peripheral bottom 36F. The central bottom 34F and the peripheral bottom 36F are located at a lower side of the housing 20F in the Z-direction. The peripheral bottom 36F is located so as to surround the central bottom 34F. As can be seen from FIG. 44, as seen along the Z-direction, the land 22F and the recess 26F are located within a region corresponding to the central bottom 34F.

As shown in FIGS. 40 and 41, the signal contacts 50, the power contacts 60 and the power contacts 70 are held by the housing 20F. The signal contact 50 is press-fitted in the housing 20F from a side opposite to the mating end 24F (i.e. from the bottom portion which is located at the negative Z-side of the housing 20F). The signal contact 50 is held by the housing 20F so that the contact-point part 52 is exposed in the recess 26F. As shown in FIG. 40, the contact-point part 62 of each of the power contacts 60 is provided in the recess 26F so as to cover the end of the land 22F in the X-direction. As shown in FIG. 40, the connector 10F according to the present embodiment comprises the two power contacts 70. The power contacts 70 are provided so as to straddle the short walls 32F, respectively. The contact-point part 72 of the power contact 70 is provided in the recess 26F so as to face the contact-point part 62 of the power contact 60.

Figure 45:
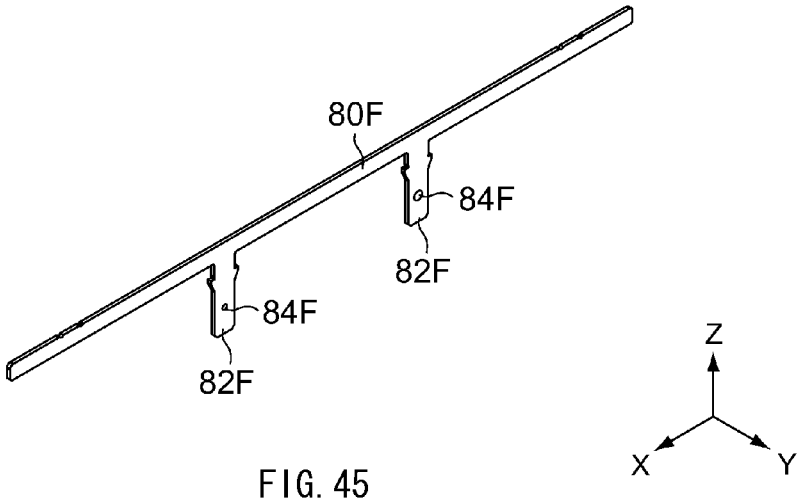
FIG. 45 is a perspective view showing a metal plate of the connector of FIG. 40.

As shown in FIGS. 42 and 45, the metal plate 80F according to the present embodiment has two press-fit portions 82F. Each of the press-fit portions 82F is formed with one dowel 84F. Accordingly, the metal plate 80F has the two dowels 84F. The dowels 84F project in different directions from each other. In detail, the dowels 84F according to the present embodiment project in opposite directions to each other in the Y-direction. As shown in FIGS. 40 and 44, the metal plate 80F is press-fitted in the land 22F of the housing 20F from the mating end 24F to be held by the land 22F. The metal plate 80F held by the land 22F is visible along the negative Z-direction. As shown in FIG. 42, the metal plate 80F according to the present embodiment protrudes slightly in the negative Z-direction from the central bottom 34F of the housing 20F.

Figure 46:
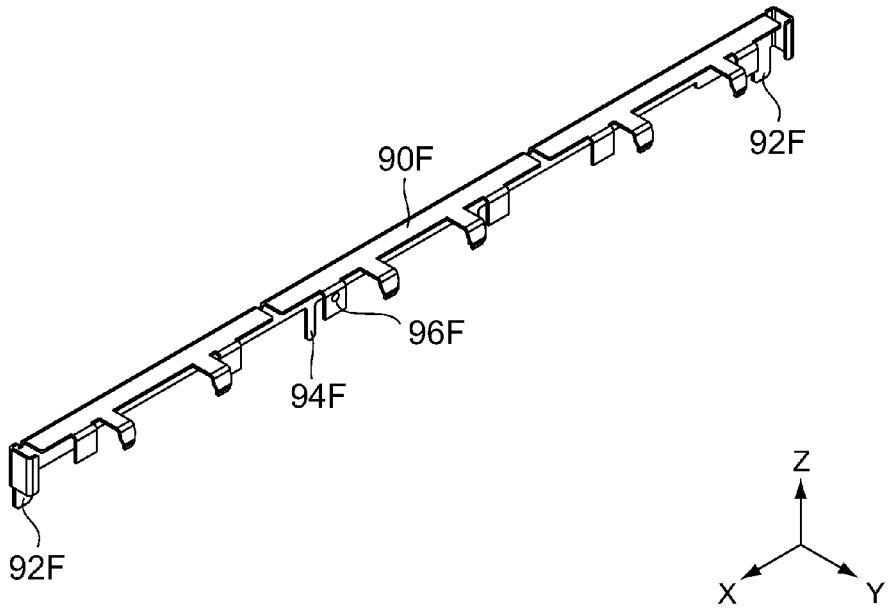
FIG. 46 is a perspective view showing a shell of the connector of FIG. 40.

As shown in FIGS. 40 and 43, the shell (connection member) 90F according to the present embodiment is comprised of two members having similar shapes to each other. The two members of the shell 90F cover the long walls 30F of the peripheral portion 28F, respectively. The shell 90F has a plurality of fixed portions 92F configured to be connected to the through holes 210 (see FIG. 3), respectively, and a plurality of fixed portions 94F configured to be connected to the through holes 208 (see FIG. 3), respectively. As shown in FIG. 46, the shell 90F according to the present embodiment further has a dowel 96F. As can be seen from FIGS. 46, 48 and 49, the dowel 96F is formed at a part of the shell 90F which is connected to the coupling member 110F as described later.

Figure 47:
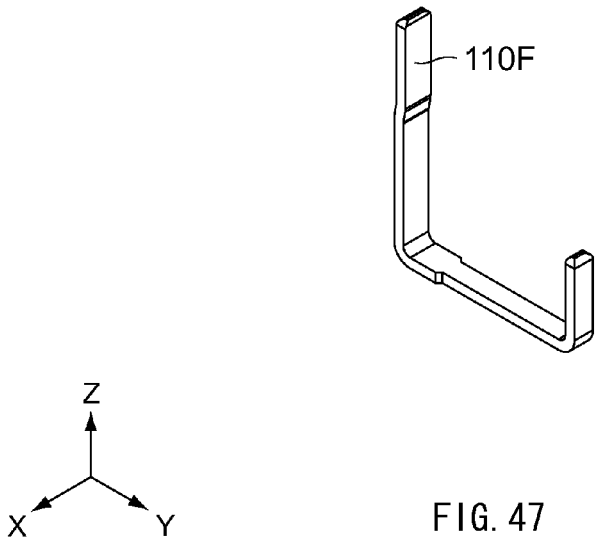
FIG. 47 is a perspective view showing a coupling member of the connector of FIG. 40.

As shown in FIGS. 43 and 47, the coupling member 110F according to the present embodiment has a Γ-like shape. As shown in FIGS. 41 and 42, the coupling member 110F is inserted in the housing 20F from a side opposite to the mating end 24F (i.e. from the negative Z-side of the housing 20F) so that the coupling member 110F is held by the housing 20F. As can be seen from FIGS. 41 and 42, the coupling member 110F is boated far apart from the power contacts 60 and the power contacts 70. As can be seen from FIGS. 41 and 42, the coupling member 110F is also insulated from the signal contacts 50.

Figure 48:
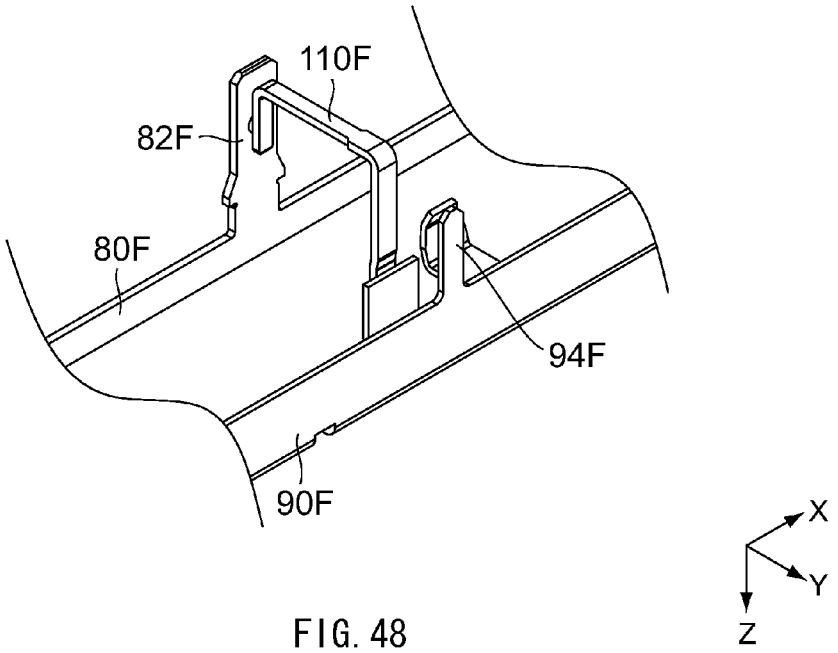
FIG. 48 is a partially enlarged, perspective view showing the metal plate, the shell and the coupling member of the connector of FIG. 41 in a state where the metal member, the shell and the coupling member are connected to one another.
Figure 49:
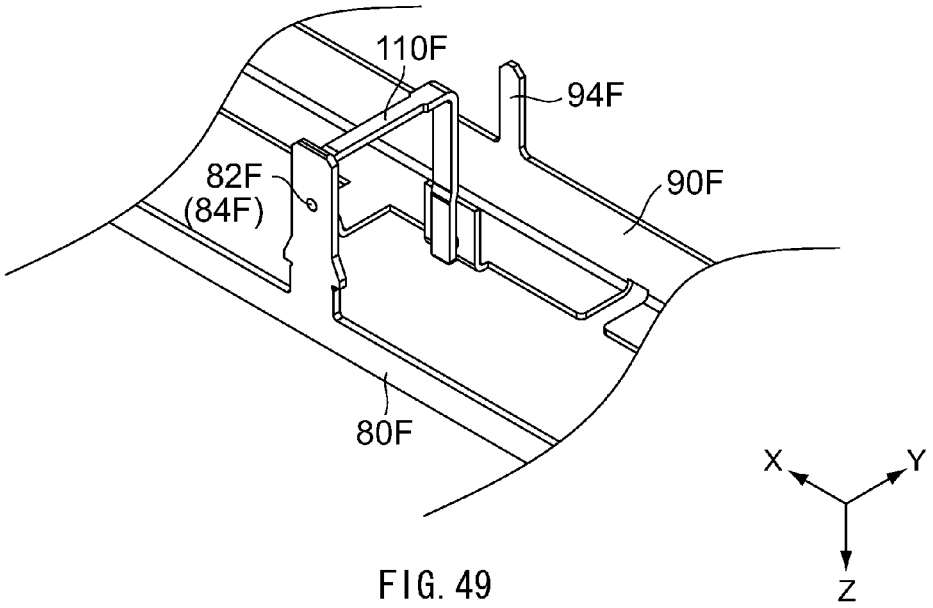
FIG. 49 is a perspective view showing the metal plate, the shell and the coupling member of FIG. 48 along another direction.

As shown in FIGS. 44, 48 and 49, the coupling member 110F couples the metal plate 80F and the shell (connection member) 90F with each other in the Y-direction. More specifically, the coupling member 110F couples the metal plate 80F with the shell (connection member) 90F while extending along the central bottom 34F (see FIG. 44). According to the present embodiment, the dowels 84F of the metal plate 80F are formed between the metal plate 90F and the coupling member 110F while the dowels 96F of the shell 90F are formed between the shell 90F and the coupling member 110F. Accordingly, it is possible to secure a sufficient contact pressure not only between the coupling member 110F and the metal plate 80F but also between the coupling member 110F and the shell 90F.

As shown in FIGS. 41 and 42, the coupling member 110F according to the present embodiment couples the metal plate 80F and the shell 90F with each other at a position apart from the opposite ends of the land 22F in the X-direction (lengthwise direction). Accordingly, according to the present embodiment, it is also possible to efficiently use the opposite ends of the land 22F in the lengthwise direction. It is therefore possible to provide the power contacts 60 and the power contacts 70 while preventing the connector 10F becoming large.

Seventh Embodiment

Referring to FIGS. 50 to 53, a connector 10G according to a seventh embodiment of the present invention is a so-called drop-in connector fixable to an object. The connector 10G is a modification of the connector 10F according to the aforementioned sixth embodiment so that the connector 10G has the almost same structure as the connector 10F. Accordingly, in Figures and the following description, similar or same reference signs are used to designate the elements of the connector 10G which are similar to or same as the elements of the connector 10F, respectively. It is not described or simply described about the similar or same elements in the following description while it is mainly described about differences of the connector 100 from the connector 10F.

Figure 50:
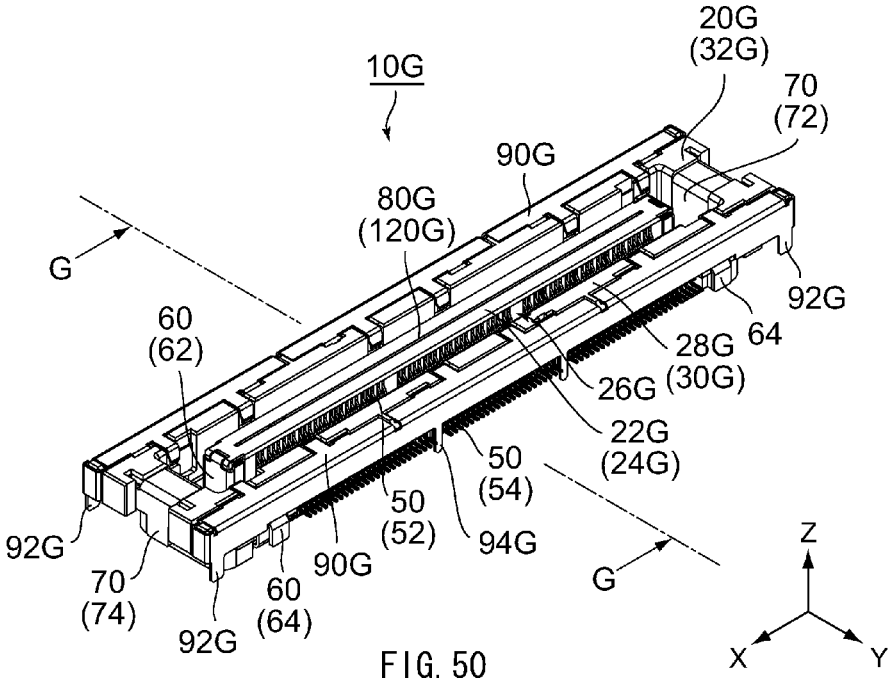
FIG. 50 is a top, perspective view showing a connector according to a seventh embodiment of the present invention.
Figure 52:
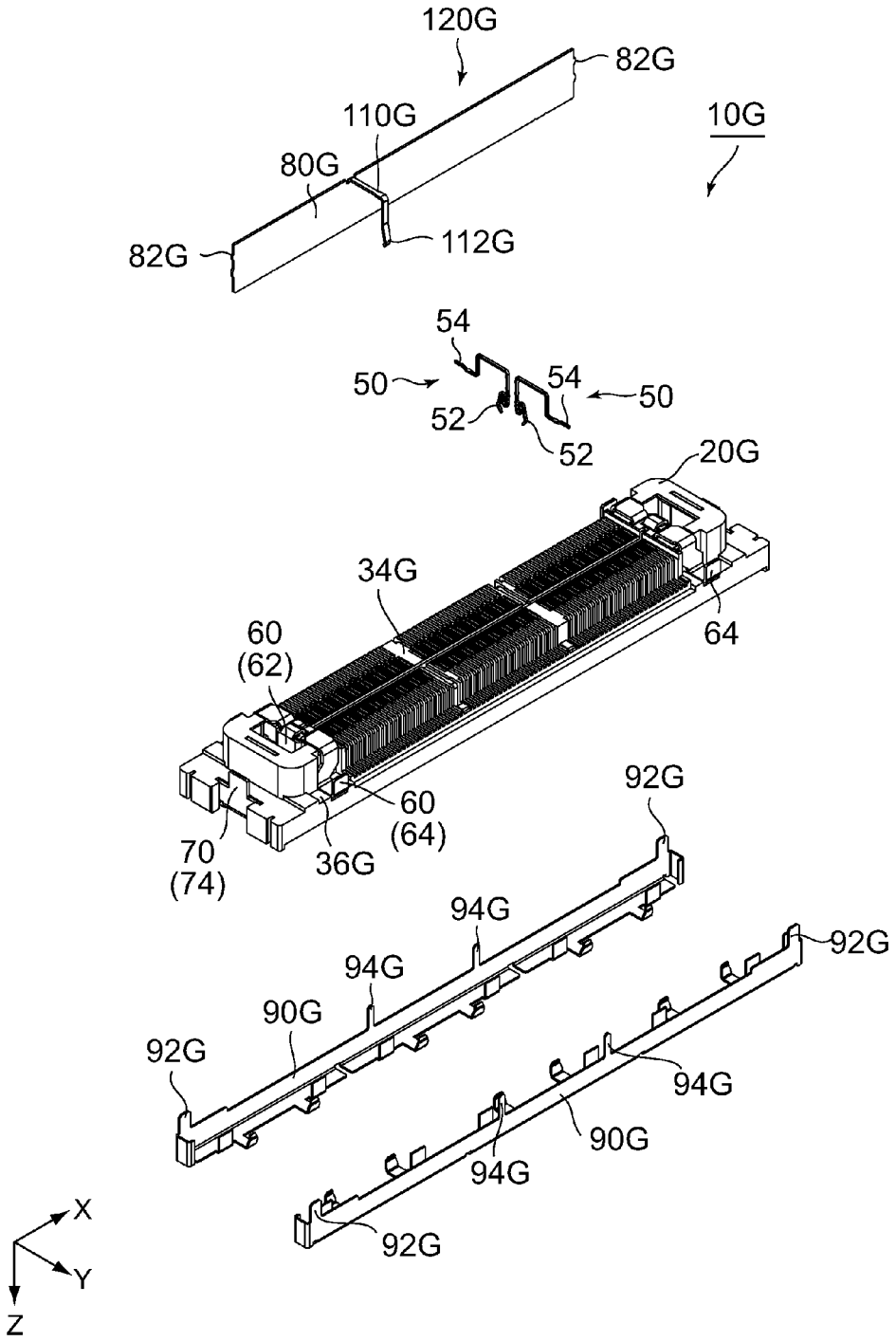
FIG. 52 is a partially exploded, perspective view showing the connector of FIG. 51.
Figure 53:
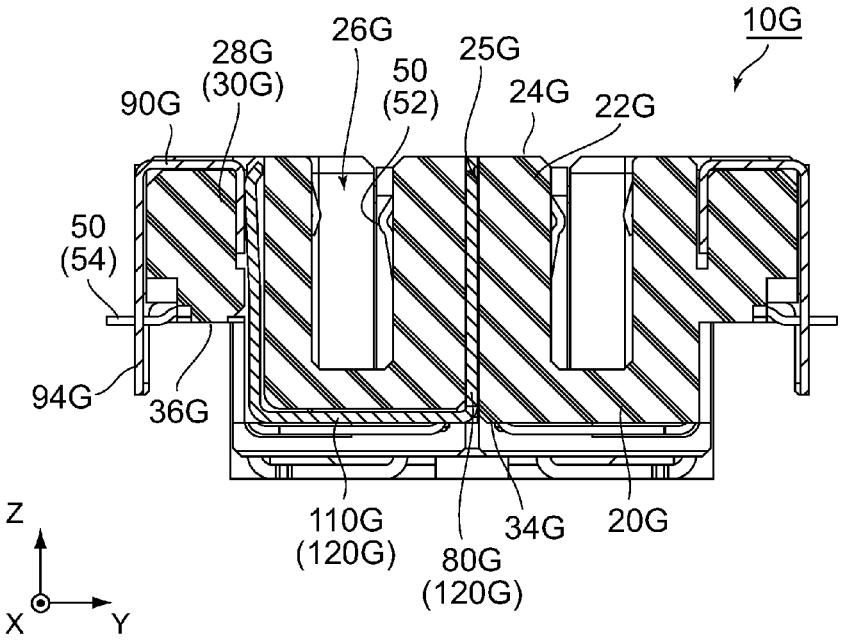
FIG. 53 is a cross-sectional view showing the connector of FIG. 50, taken along G-G lines.

Referring to FIGS. 50, 52 and 53, the connector 10G according to the present embodiment comprises a housing 20G made of an insulating material, a plurality of the signal contacts 50 each made of the conductive material, the power contacts 60 and the power contacts 70 each made of the conductive material, a metal member 120G and a shell (connection member) 90G made of a metal.

As shown in FIGS. 50 and 53, the housing 200 has a land 22G, a recess 26G and a peripheral portion 28G. The land 22G extends long in the X-direction (first direction) while having a mating end 24G in the Z-direction (second direction). The recess 26G is formed so as to surround the land 22G in the XY-plane. The peripheral portion 28G is formed so as to surround the recess 26G in the XY-plane. The land 22G is formed with a slit-like holding portion 25G. The holding portion 25G extends in the X-direction in the mating end 24G while extending from the mating end 24G along the negative Z-direction. The recess 26G is recessed in the negative Z-direction. The peripheral portion 28G has two long walls 30G extending along the X-direction and two short walls 32G extending along the Y-direction (third direction). The recess 26G is located between the long wall 30G and the land 22G in the Y-direction. In other words, the land 22G and the long wall 30G are provided so as to have the recess 26G therebetween in the Y-direction. Similarly, the recess 26G is located between the short wall 32G and the land 22G in the X-direction.

Figure 51:
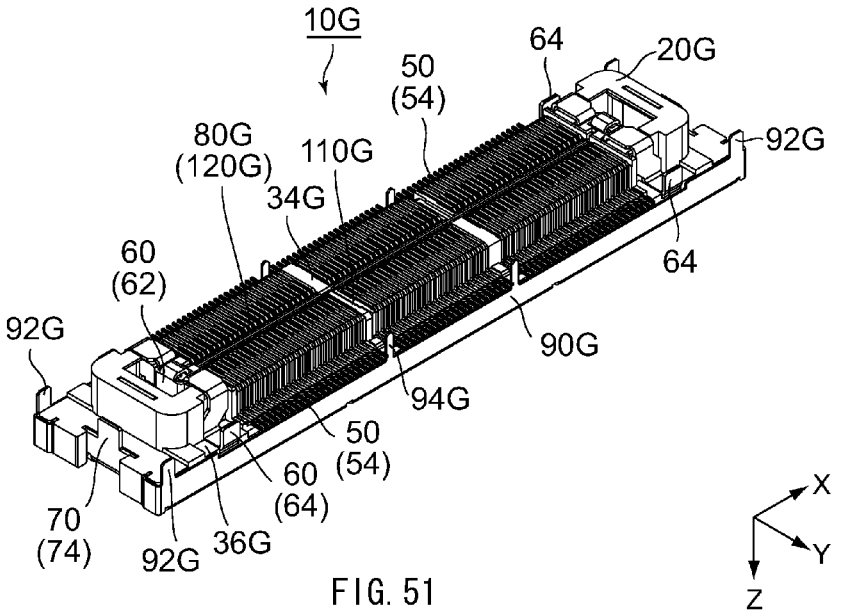
FIG. 51 is a bottom, perspective view showing the connector of FIG. 50.

As can be seen from FIGS. 51 to 53, the housing 20G has a bottom portion which is mostly comprised of a central bottom 34G and a peripheral bottom 36G. The central bottom 34G and the peripheral bottom 36G are located at a lower side of the housing 20G in the Z-direction. The peripheral bottom 36G is located so as to surround the central bottom 34G. As can be seen from FIG. 53, as seen along the Z-direction, the land 22G and the recess 26G are located within a region corresponding to the central bottom 34G.

As shown in FIGS. 50 and 51, the signal contacts 50, the power contacts 60 and the power contacts 70 are held by the housing 20G. The signal contact 50 is press-fitted in the housing 20G from a side opposite to the mating end 24G (i.e. from the bottom portion which is located at the negative Z-side of the housing 20G). The signal contact 50 is held by the housing 20G so that the contact-point part 52 is exposed in the recess 26G. As shown in FIG. 50, the contact-point part 62 of each of the power contacts 60 is provided in the recess 26G so as to cover the end of the land 22G in the X-direction. As shown in FIG. 50, the connector 10G according to the present embodiment comprises the two power contacts 70. The power contacts 70 are provided so as to straddle the short walls 32G, respectively. The contact-point part 72 of the power contact 70 is provided in the recess 26G so as to face the contact-point part 62 of the power contact 60.

Figure 54:
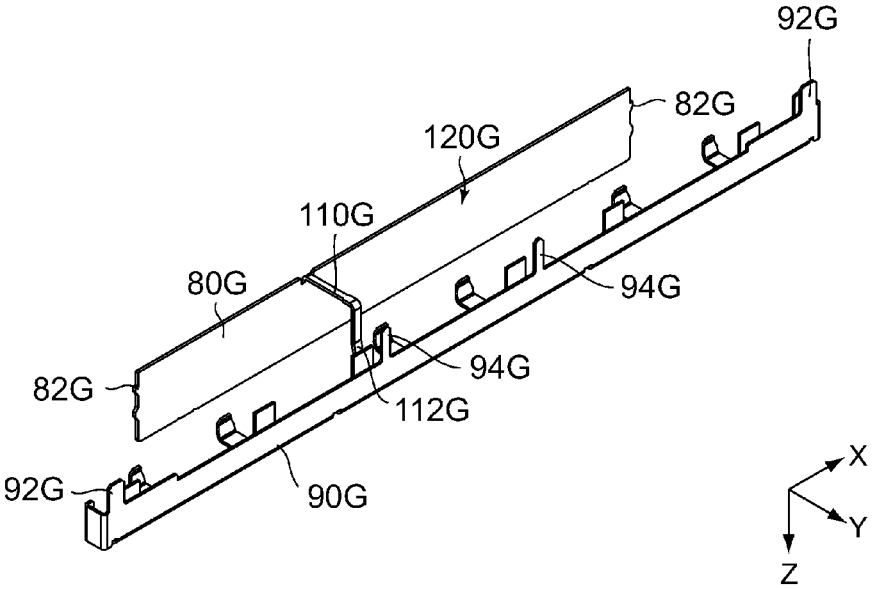
FIG. 54 is a perspective view showing a metal member and a shell of the connector of FIG. 51 in a state where the metal member and the shell are connected to each other.

As shown in FIGS. 52 to 54, the metal member 1200 according to the present embodiment is integrally formed from a metal plate 80G for ESD protection and a coupling member 110G made of a metal. More specifically, the metal member 120G is formed by pressing and bending a single base metal plate. The metal plate 80G is provided with a plurality of press-fit portions 82G. The coupling member 110G is provided with a contact portion 112G which has a resilience. As can be seen from FIGS. 52 and 53, the metal member 120G is press-fitted in the housing 20G from the side opposite to the mating end 24G (i.e. from the bottom portion which is located at the negative Z-side of the housing 20G) to be held by the housing 20G. In detail, the metal plate 80G is held by the land 22G so as to be visible from both the mating end 24G and the central bottom 34G. The coupling member 110G extends to the long wall 30G of the peripheral portion 28G along the central bottom 34G.

As shown in FIGS. 50 and 52, the shell (connection member) 90G according to the present embodiment is comprised of two members having similar shapes to each other. The two members of the shell 90G cover the long walls 30G of the peripheral portion 28G, respectively. The shell 90G has a plurality of fixed portions 92G configured to be connected to the through holes 210 (see FIG. 3), respectively, and a plurality of fixed portions 94G configured to be connected to the through holes 208 (see FIG. 3), respectively.

As shown in FIGS. 51, 53 and 54, the metal member 120G and the shell 90G are connected to each other. More specifically, the contact portion 112G of the coupling member 110G of the metal member 120G is pressed against and brought into contact with the shell 90G so that the metal member 120G and the shell 90G are electrically connected to each other. Similar to the first embodiment, a connected position where the metal member 120G is connected to the shell 90G is apart from the opposite ends of the land 22G in a lengthwise direction (the X-direction or the first direction). More specifically, the aforementioned connected position is located in near the middle part of the long wall 30G in the lengthwise direction. Accordingly, according to the present embodiment, it is also possible to efficiently use the opposite ends of the land 22G in the lengthwise direction. It is therefore possible to provide the power contacts 60 and the power contacts 70 while preventing the connector 10G becoming large.

Eighth Embodiment

Referring to FIGS. 55 to 58, a connector 10H according to an eighth embodiment of the present invention is a so-called drop-in connector fixable to an object. The connector 10H is a modification of the connector 10F according to the previously described sixth embodiment so that the connector 10H has the almost same structure as the connector 10F. Accordingly, in Figures and the following description, similar or same reference signs are used to designate the elements of the connector 10H which are similar to or same as the elements of the connector 10F, respectively. It is not described or simply described about the similar or same elements in the following description while it is mainly described about differences of the connector 10H from the connector 10F.

Figure 55:
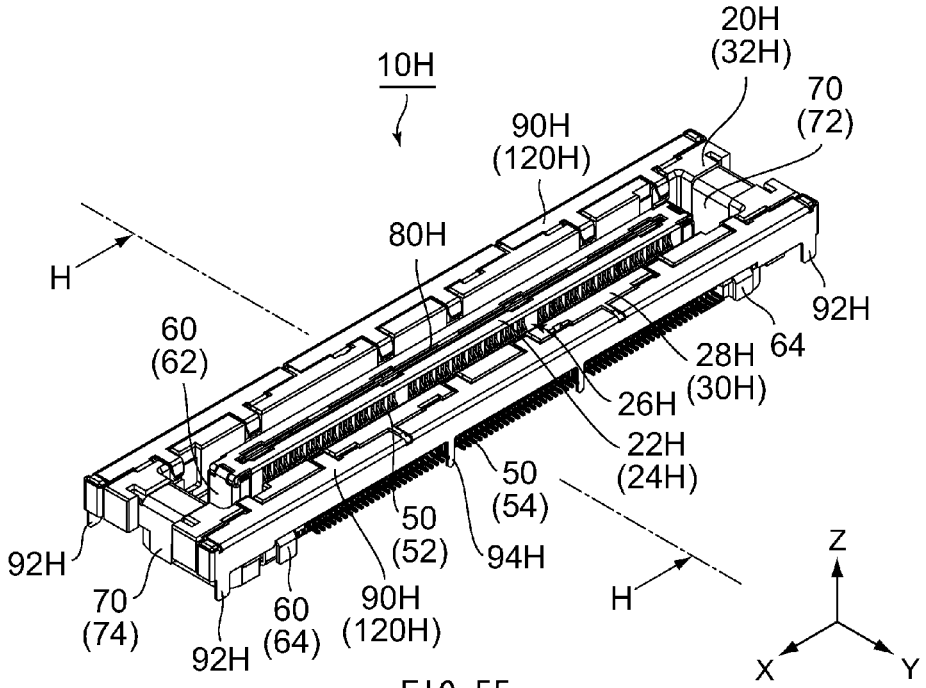
FIG. 55 is a top, perspective view showing a connector according to an eighth embodiment of the present invention.
Figure 57:
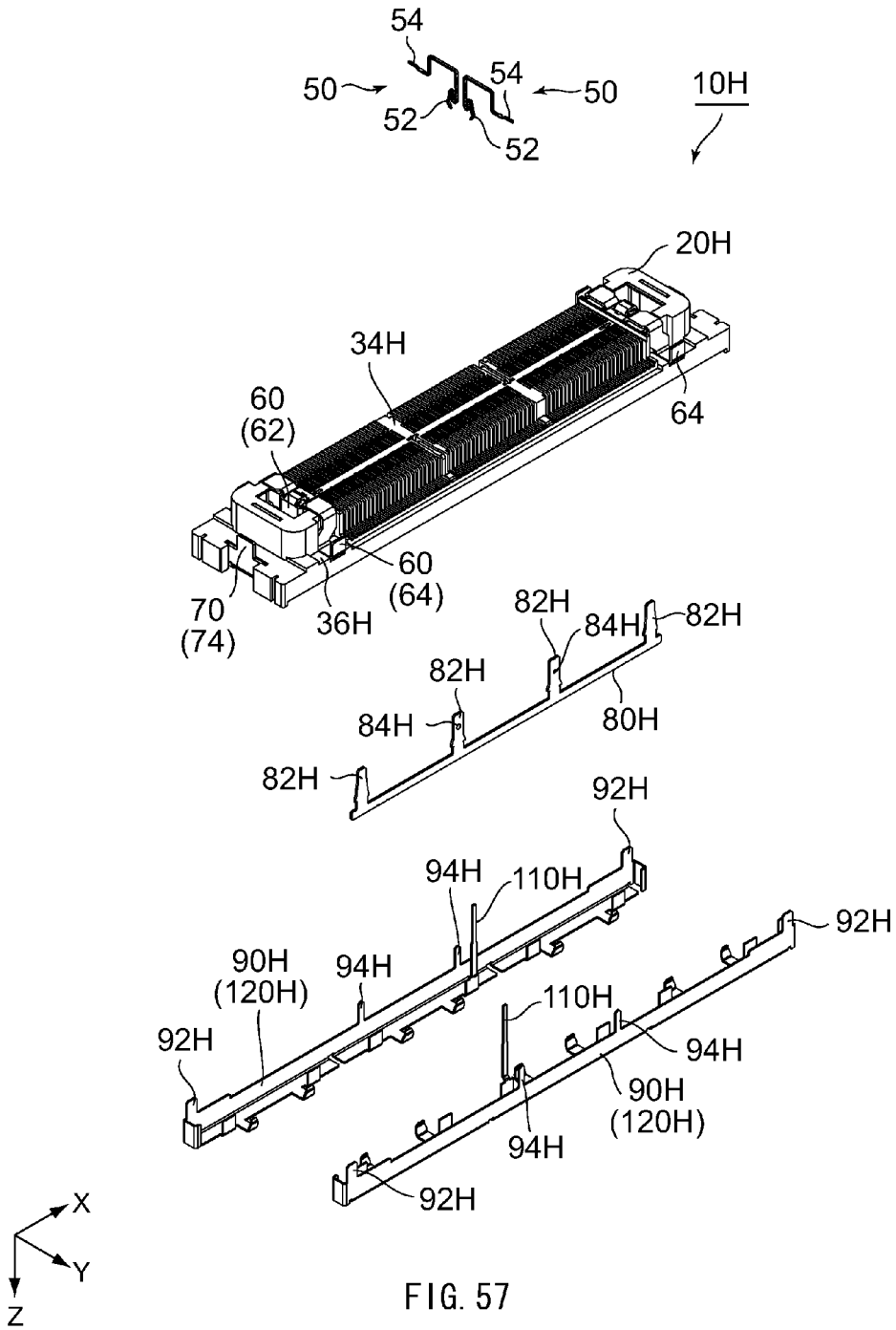
FIG. 57 is a partially exploded, perspective view showing the connector of FIG. 56.
Figure 58:
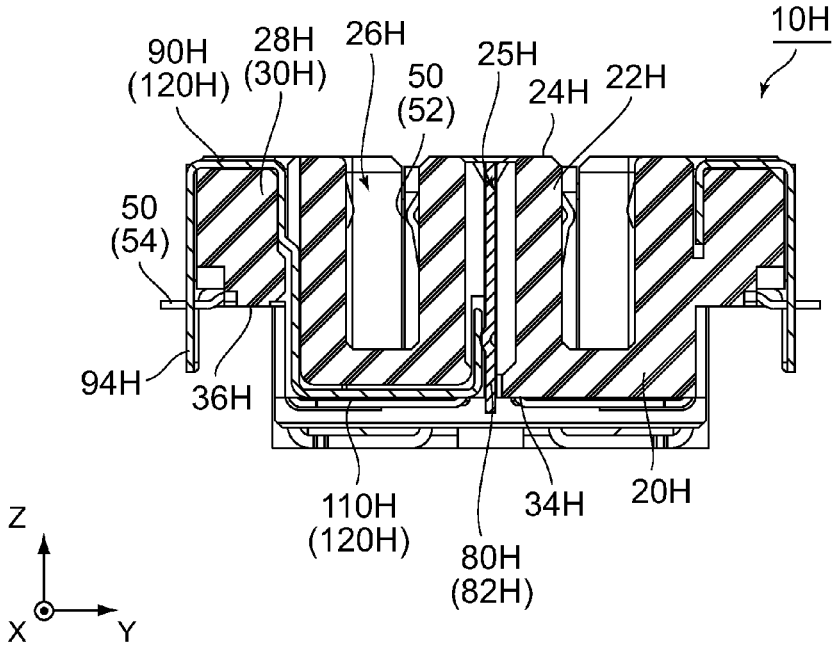
FIG. 58 is a cross-sectional view showing the connector of FIG. 55, taken along H-H lines.

Referring to FIGS. 55, 57 and 58, the connector 10H according to the present embodiment comprises a housing 20H made of an insulating material, a plurality of the signal contacts 50 each made of the conductive material, the power contacts 60 and the power contacts 70 each made of the conductive material, a metal plate 80H and a metal member 120H.

As shown in FIGS. 55 and 57, the housing 20H has a land 22H, a recess 26H and a peripheral portion 28H. The land 22H extends long in the X-direction (first direction) while having a mating end 24H in the Z-direction (second direction). The recess 26H is formed so as to surround the land 22H in the XY-plane. The peripheral portion 28H is formed so as to surround the recess 26H in the XY-plane. The land 22H is formed with a slit-like holding portion 25H. The holding portion 25H extends in the X-direction in the mating end 24H while extending from the mating end 24H along the negative Z-direction. The recess 26H is recessed in the negative Z-direction. The peripheral portion 28H has two long walls 30H extending along the X-direction and two short walls 32H extending along the Y-direction (third direction). The recess 26H is located between the long wall 30H and the land 22H in the Y-direction. In other words, the land 22H and the long wall 30H are provided so as to have the recess 26H therebetween in the Y-direction. Similarly, the recess 26H is located between the short wall 32H and the land 22H in the X-direction.

Figure 56:
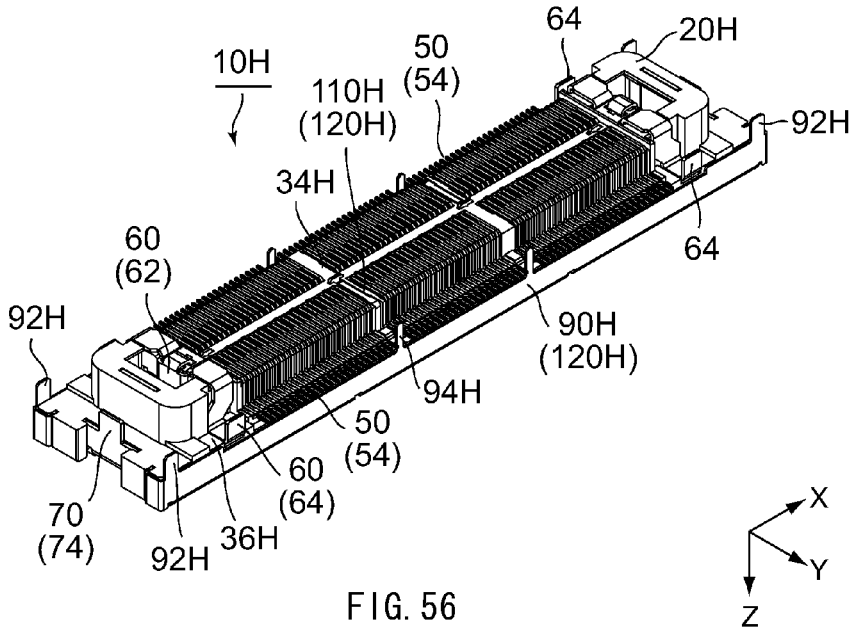
FIG. 56 is a bottom, perspective view showing the connector of FIG. 55.

As can be seen from FIGS. 56 to 58, the housing 20H has a bottom portion which is mostly comprised of a central bottom 34H and a peripheral bottom 36H. The central bottom 34H and the peripheral bottom 36H are located at a lower side of the housing 20H in the Z-direction. The peripheral bottom 36H is located so as to surround the central bottom 34H. As can be seen from FIG. 58, as seen along the Z-direction, the land 22H and the recess 26H are located within a region corresponding to the central bottom 34H.

As shown in FIGS. 55 and 56, the signal contacts 50, the power contacts 60 and the power contacts 70 are held by the housing 20H. The signal contact 50 is press-fitted in the housing 20H from a side opposite to the mating end 24H (i.e. from the bottom portion which is located at the negative Z-side of the housing 20H). The signal contact 50 is held by the housing 20H so that the contact-point part 52 is exposed in the recess 26H. As shown in FIG. 55, the contact-point part 62 of each of the power contacts 60 is provided in the recess 26H so as to cover the end of the land 22H in the X-direction. As shown in FIG. 55, the connector 10H according to the present embodiment comprises the two power contacts 70. The power contacts 70 are provided so as to straddle the short walls 32H, respectively. The contact-point part 72 of the power contact 70 is provided in the recess 26H so as to face the contact-point part 62 of the power contact 60.

As shown in FIG. 57, the metal plate 80H according to the present embodiment has four press-fit portions 82H. The four press-fit portions 82H are comprised of two inside press-fit portions 82H located inward in the X-direction and two outside press-fit portions 82H located outward in the X-direction. Each of the two inside press-fit portions 82H is formed with one dowel 84H. Accordingly, the metal plate 80H has the two dowels 84H. The dowels 84H project in different directions from each other. As shown in FIGS. 55 and 58, the metal plate 80H is press-fitted in the land 22H of the housing 20H from the mating end 24H to be held by the land 22H. The metal plate 80H held by the land 22H is visible along the negative Z-direction.

Figure 59:
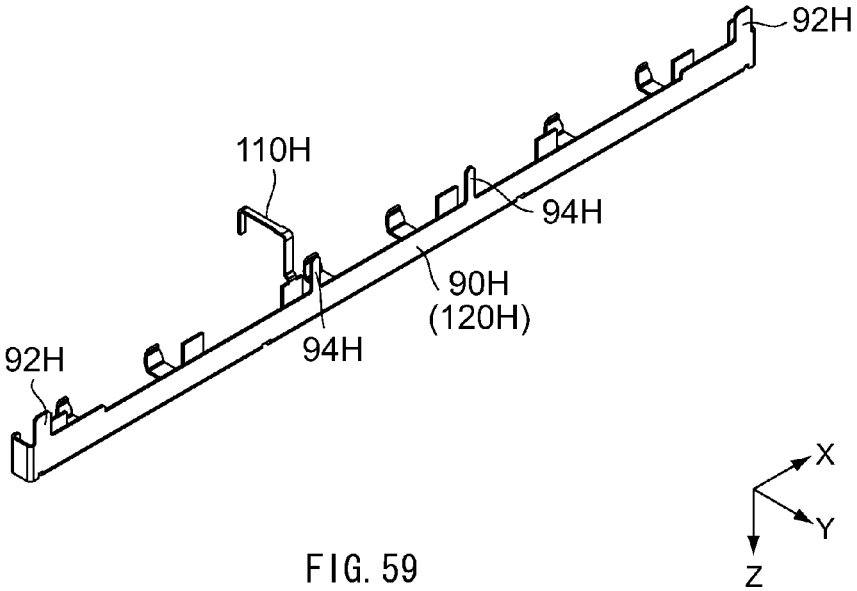
FIG. 59 is a perspective view showing a metal member of the connector of FIG. 56.

As shown in FIGS. 57 to 60, the metal member 120H according to the present embodiment is comprised of two members having similar shapes to each other. Each of the two members of the metal member 120H is integrally formed from a coupling member 110H made of a metal, and a part of a shell (connection member) 90H made of a metal. More specifically, each of the two members constituting the metal member 120H is formed by pressing and bending a single base metal plate. The shell 90H has a plurality of fixed portions 92H configured to be connected to the through holes 210 (see FIG. 3), respectively, and a plurality of fixed portions 94H configured to be connected to the through holes 208 (see FIG. 3), respectively. As shown in FIG. 57, the coupling member 110H extends in the negative Z-direction before attached to the housing 20H. As shown in FIGS. 56 and 58, the metal member 120H is attached to the housing 20H in a manner described below. At first, the shell 90H is attached to the housing 20H under a state where the coupling member 110H extends in the negative Z-direction so that the shell 90H covers the long wall 30H of the peripheral portion 28H. Then, as shown in FIG. 59, the coupling member 110H is bent so that the metal member 120H is attached to the housing 20H.

Figure 60:
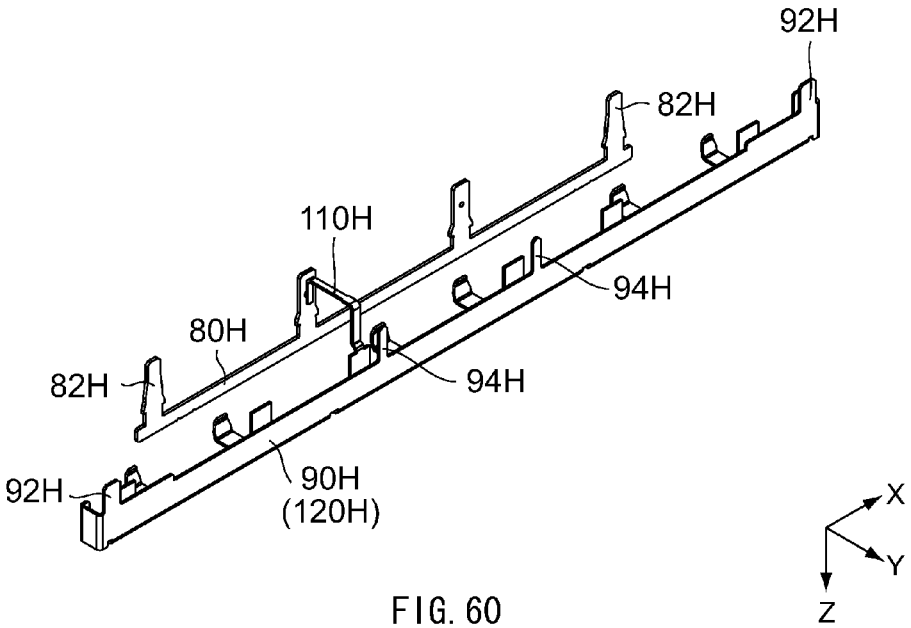
FIG. 60 is a perspective view showing a metal plate and the metal member of the connector of FIG. 55 in a state where the metal plate and the metal member are connected to each other.

As shown in FIGS. 58 and 60, the coupling member 110H extends from the long wall 30H of the peripheral portion 28H to the metal plate 80H along the central bottom 34H. The dowel 84H of the metal plate 80H is pressed against and brought into contact with the coupling member 110H so that the metal member 120H and the metal plate 80H are electrically connected to each other. Similar to the first embodiment, a connected position where the metal member 120H is connected to the metal plate 80H is apart from the opposite ends of the land 22H in a lengthwise direction (the X-direction or the first direction). Accordingly, according to the present embodiment, it is also possible to efficiently use the opposite ends of the land 22H in the lengthwise direction. It is therefore possible to provide the power contacts 60 and the power contacts 70 while preventing the connector 10H becoming large.

According to the aforementioned sixth to eighth embodiments, similar to the first to third embodiments, the metal plates 80F to 80H of the connectors 10F to 10H are electrically connected to the shells (connection members) 90F to 90H by the coupling members 110F to 110H, respectively. However, the connector may be configured differently. For example, similar to the fourth and fifth embodiments, the connector may be provided with a connection member other than the shell. In this case, the metal plate may be electrically connected to thus configured connection member by the coupling member.

Ninth Embodiment

Referring to FIGS. 61 to 64, a connector 10*i* according to a ninth embodiment of the present invention is a so-called drop-in connector fixable to an object. The connector 10*i* is a modification of the connector 10H according to the aforementioned eighth embodiment so that the connector 10*i* has the almost same structure as the connector 10H. Accordingly, in Figures and the following description, similar or same reference signs are used to designate the elements of the connector 10*i* which are similar to or same as the elements of the connector 10H, respectively. It is not described or simply described about the similar or same elements in the following description while it is mainly described about differences of the connector 10*i* from the connector 10H.

Figure 61:
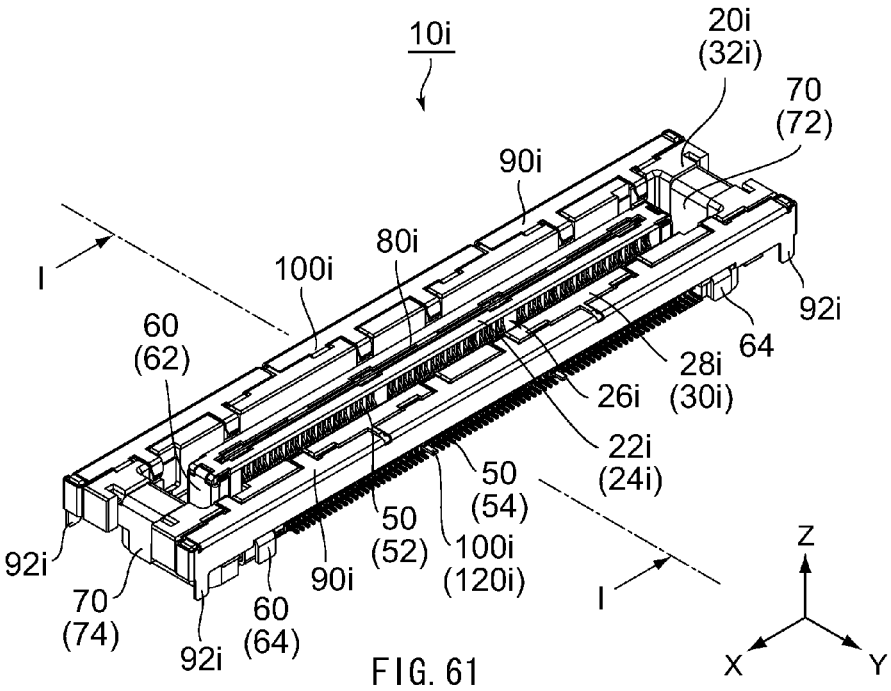
FIG. 61 is a top, perspective view showing a connector according to a ninth embodiment of the present invention.
Figure 63:
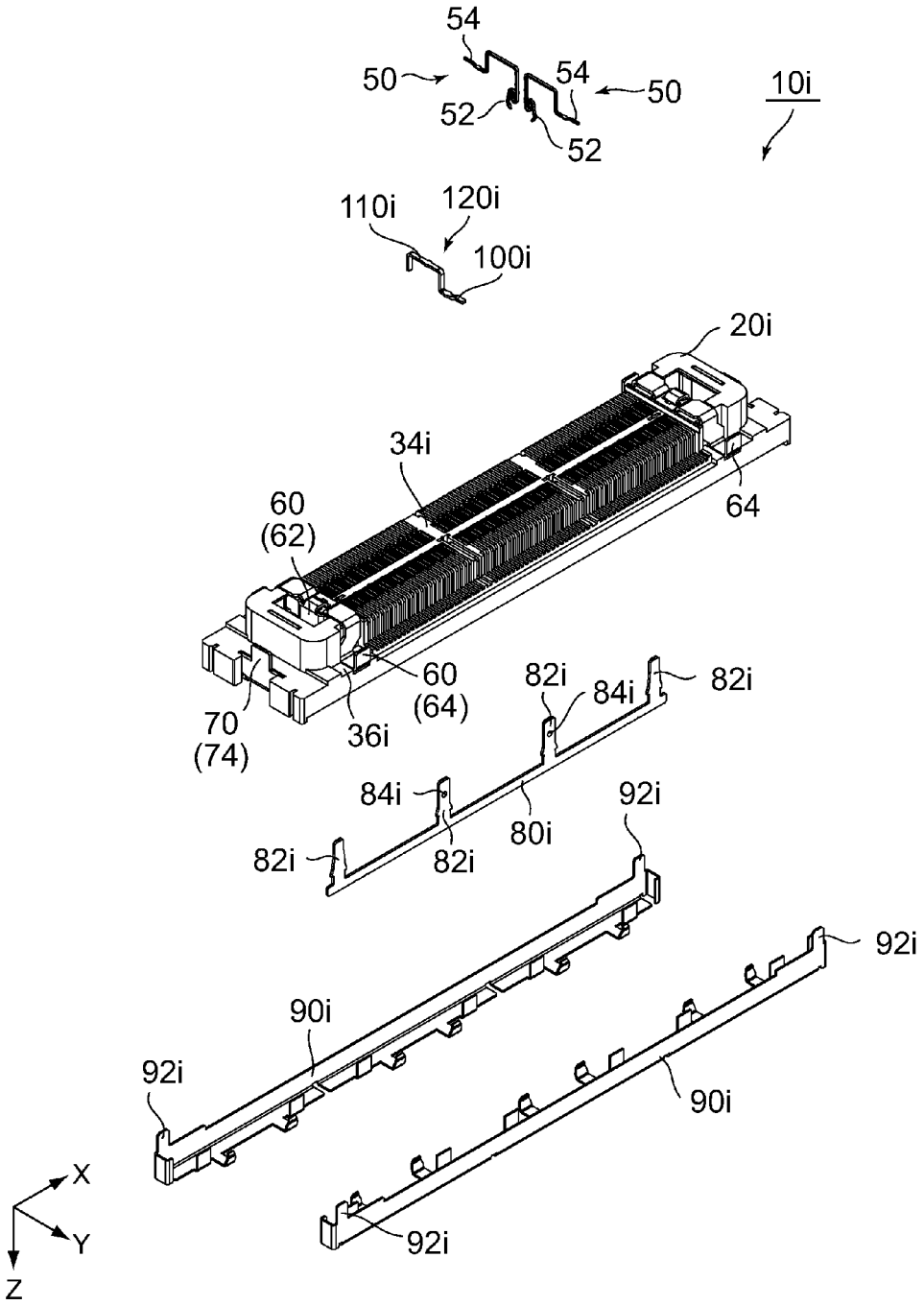
FIG. 63 is a partially exploded, perspective view showing the connector of FIG. 62.
Figure 64:
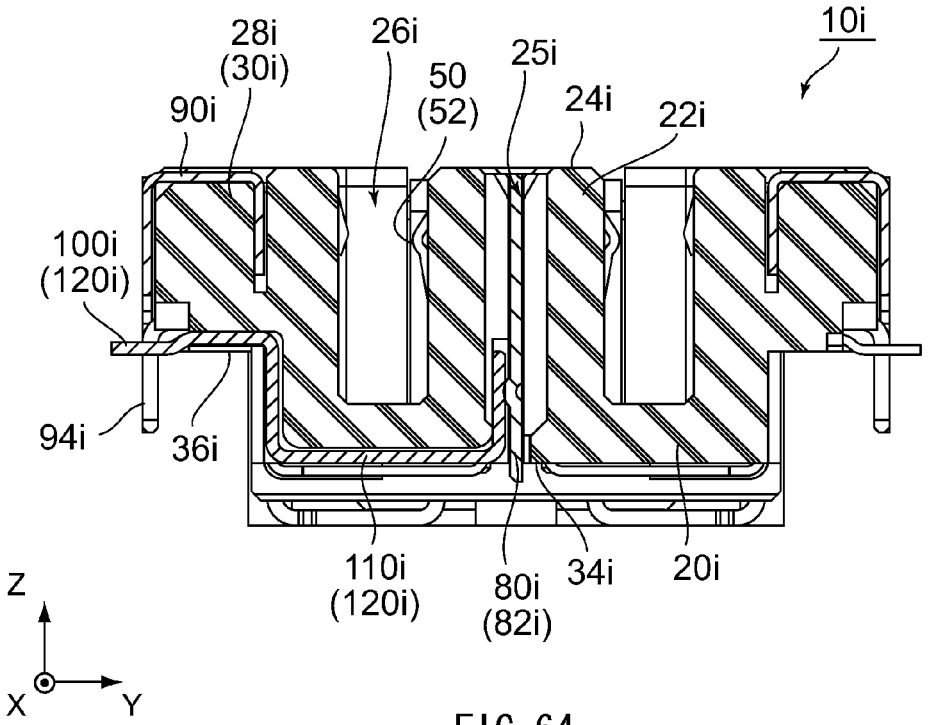
FIG. 64 is a cross-sectional view showing the connector of FIG. 61, taken along I-I lines.

Referring to FIGS. 61, 63 and 64, the connector 10*i* according to the present embodiment comprises a housing 20*i* made of an insulating material, a plurality of the signal contacts 50 each made of the conductive material, the power contacts 60 and the power contacts 70 each made of the conductive material, a metal plate 80*i*, a shell 90*i* made of a metal and a metal member 120*i* which is a member other than the shell 90*i*.

As shown in FIGS. 61 and 64, the housing 20*i* has a land 22*i*, a recess 26*i* and a peripheral portion 28*i*. The land 22*i* extends long in the X-direction (first direction) while having a mating end 24*i* in the Z-direction (second direction). The recess 26*i* is formed so as to surround the land 22*i* in the XY-plane. The peripheral portion 28*i* is formed so as to surround the recess 26*i* in the XY-plane. The land 22*i* is formed with a slit-like holding portion 25*i*. The holding portion 25*i* extends in the X-direction in the mating end 24*i* while extending from the mating end 24*i* along the negative Z-direction. The recess 26*i* is recessed in the negative Z-direction. The peripheral portion 28*i* has two long walls 30*i* extending along the X-direction and two short walls 32*i* extending along the Y-direction (third direction). The recess 26*i* is located between the long wall 30*i* and the land 22*i* in the Y-direction. In other words, the land 22*i* and the long wall 30*i* are provided so as to have the recess 26*i* therebetween in the Y-direction. Similarly, the recess 26*i* is located between the short wall 32*i* and the land 22*i* in the X-direction.

Figure 62:
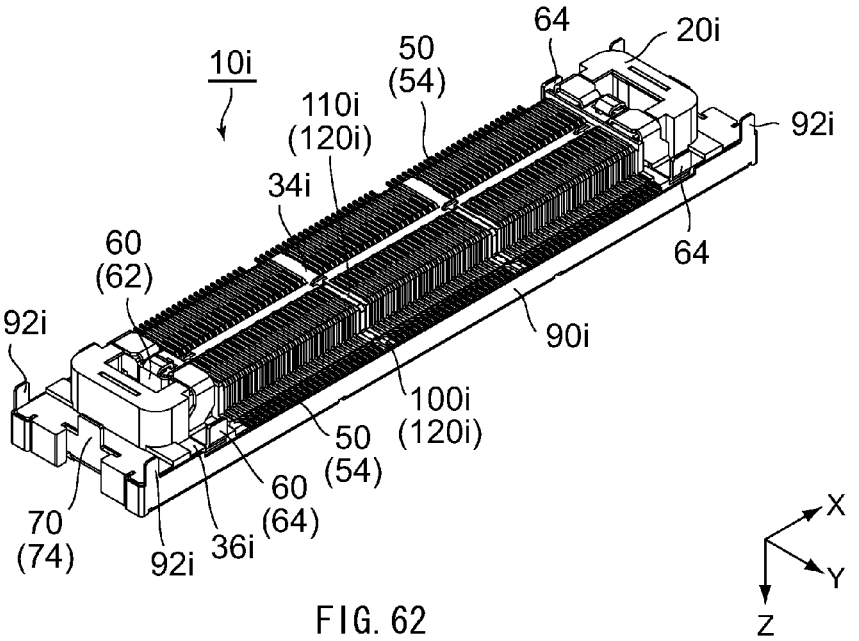
FIG. 62 is a bottom, perspective view showing the connector of FIG. 61.

As can be seen from FIGS. 62 to 64, the housing 20*i* has a bottom portion which is mostly comprised of a central bottom 34*i* and a peripheral bottom 36*i*. The central bottom 34*i* and the peripheral bottom 36*i* are located at a lower side of the housing 20*i* in the Z-direction. The peripheral bottom 36*i* is located so as to surround the central bottom 34*i*. As can be seen from FIG. 64, as seen along the Z-direction, the land 22*i* and the recess 26*i* are located within a region corresponding to the central bottom 34*i*.

As shown in FIGS. 61 and 62, the signal contacts 50, the power contacts 60 and the power contacts 70 are held by the housing 20*i*. The signal contact 50 is press-fitted in the housing 20*i* from a side opposite to the mating end 24*i* (i.e. from the bottom portion which is located at the negative Z-side of the housing 20*i*). The signal contact 50 is held by the housing 20*i* so that the contact-point part 52 is exposed in the recess 26*i*. As shown in FIG. 61, the contact-point part 62 of each of the power contacts 60 is provided in the recess 26*i* so as to cover the end of the land 22*i* in the X-direction. As shown in FIG. 61, the connector 10*i* according to the present embodiment comprises the two power contacts 70. The power contacts 70 are provided so as to straddle the short walls 32*i*, respectively. The contact-point part 72 of the power contact 70 is provided in the recess 26*i* so as to face the contact-point part 62 of the power contact 60.

As shown in FIG. 63, the metal plate 80*i* according to the present embodiment has four press-fit portions 82*i*. The four press-fit portions 82*i* are comprised of two inside press-fit portions 82*i* located inward in the X-direction and two outside press-fit portions 82*i* located outward in the X-direction. Each of the inside press-fit portions 82*i* is formed with a dowel 84*i* projecting in the positive Y-direction. As shown in FIGS. 61 and 64, the metal plate 80*i* is press-fitted in the land 22*i* of the housing 20*i* from the mating end 24*i* to be held by the land 22*i*. The metal plate 80*i* held by the land 22*i* is visible along the negative Z-direction.

As shown in FIGS. 61 and 63, the shell 90*i* according to the present embodiment is comprised of two members having similar shapes to each other. The two members of the shell 90*i* cover the long walls 30*i* of the peripheral portion 28*i*, respectively. The shell 90*i* according to the present embodiment is formed with a plurality of fixed portions 92*i* configured to be connected to the through holes 210 (see FIG. 3), respectively, while not formed with a fixed portion configured to be connected to the through hole 208 (see FIG. 3).

Figure 65:
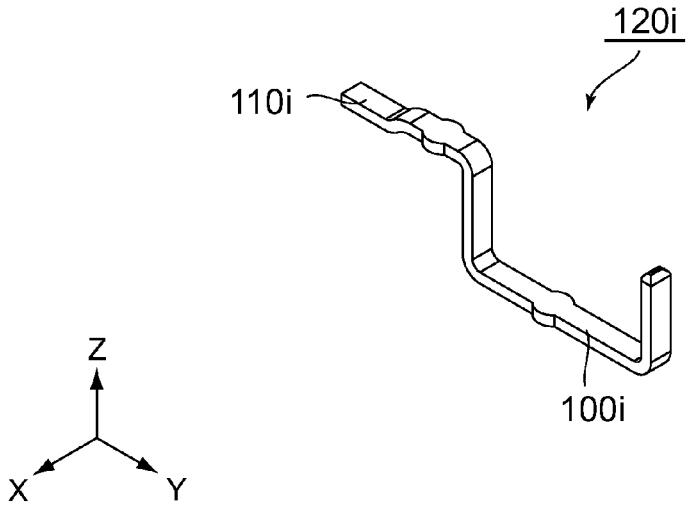
FIG. 65 is a perspective view showing a metal member of the connector of FIG. 61.

As shown in FIG. 63, the metal member 120*i* according to the present embodiment is integrally formed from a connection member 100*i* made of a metal and a coupling member 110*i* made of a metal. The connection member 100*i* is provided as a member other than the shell 90*i*. More specifically, the metal member 120*i* is formed by pressing and bending a single base metal plate. As shown in FIG. 65, the metal member 120*i* is partially formed with a broad portion having a large size in the X-direction. The broad portion is press-fitted in the housing 20*i* so that the metal member 120*i* is attached and fixed to the housing 20*i*.

Figure 66:
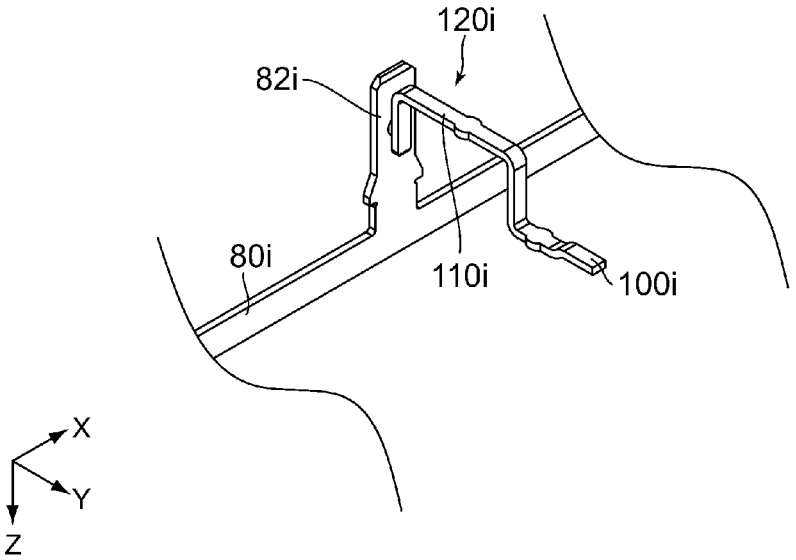
FIG. 66 is a partially enlarged, perspective view showing a metal plate and the metal member of the connector of FIG. 62 in a state where the metal plate and the metal member are connected to each other.

As shown in FIGS. 64 and 66, the coupling member 110*i* extends from the long wall 30*i* of the peripheral portion 28*i* to the metal plate 80*i* along the central bottom 34*i*. The dowel 84*i* of the metal plate 80*i* is pressed against and brought into contact with the coupling member 110*i* so that the metal member 120*i* and the metal plate 80*i* are electrically connected to each other. Similar to the first embodiment, a connected position where the metal member 120*i* is connected to the metal plate 80*i* is apart from the opposite ends of the land 22*i* in a lengthwise direction (the X-direction or the first direction). Accordingly, according to the present embodiment, it is also possible to efficiently use the opposite ends of the land 22*i* in the lengthwise direction. It is therefore possible to provide the power contacts 60 and the power contacts 70 while preventing the connector 10*i* becoming large.

Tenth Embodiment

Referring to FIGS. 67 to 70, a connector 10J according to a tenth embodiment of the present invention is a so-called drop-in connector fixable to an object. The connector 10J is a modification of the connector 10*i* according to the aforementioned ninth embodiment so that the connector 10J has the almost same structure as the connector 10*i*. Accordingly, in Figures and the following description, similar or same reference signs are used to designate the elements of the connector 10J which are similar to or same as the elements of the connector 10*i*, respectively. It is not described or simply described about the similar or same elements in the following description while it is mainly described about differences of the connector 10J from the connector 10*i*.

Figure 67:
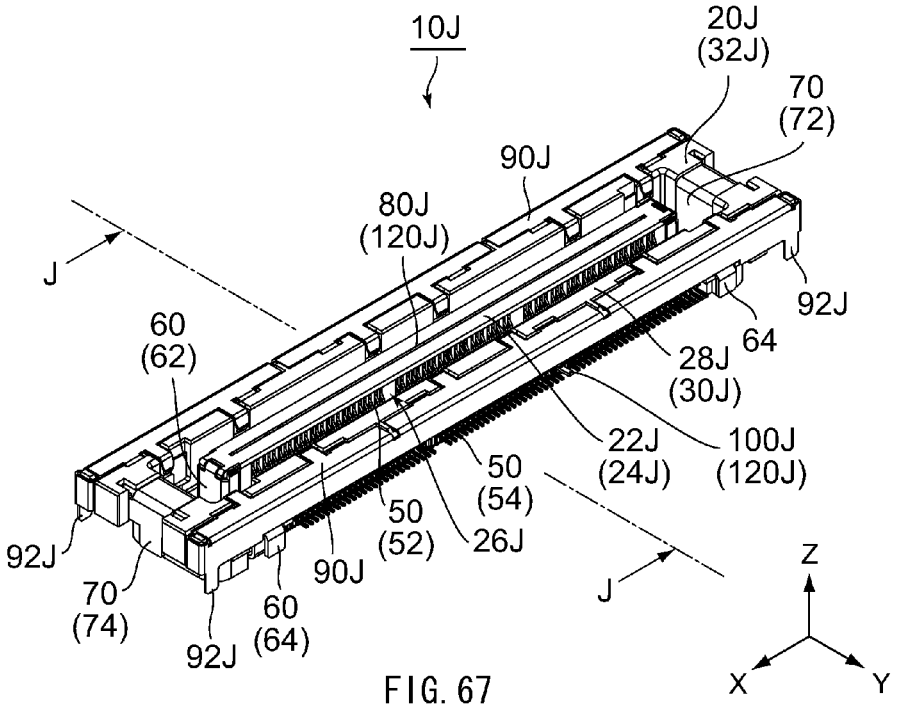
FIG. 67 is a top, perspective view showing a connector according to a tenth embodiment of the present invention.
Figure 69:
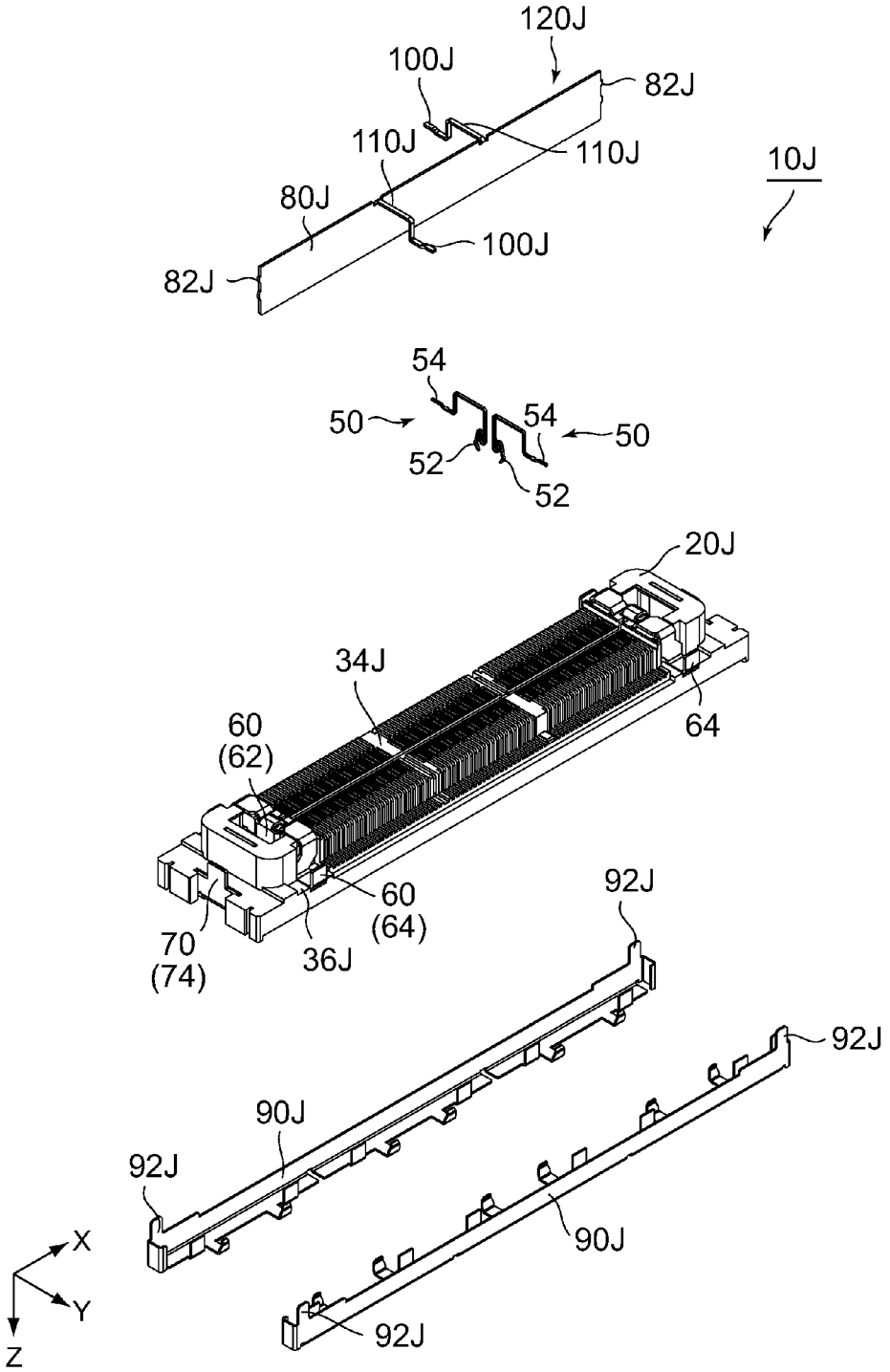
FIG. 69 is a partially exploded, perspective view showing the connector of FIG. 68.
Figure 70:
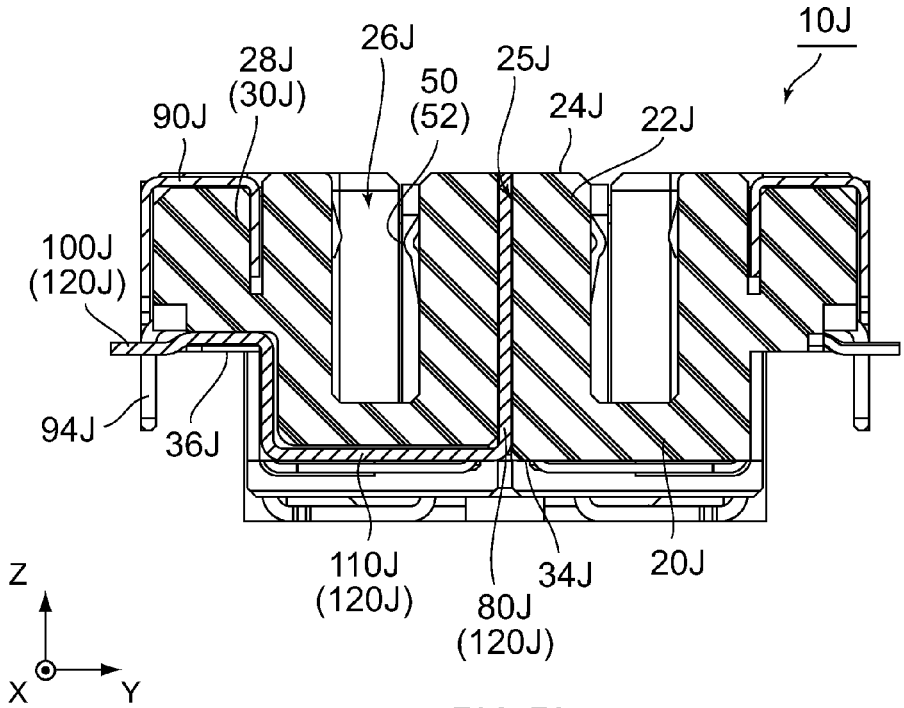
FIG. 70 is a cross-sectional view showing the connector of FIG. 67, taken along J-J lines.

Referring to FIGS. 67, 69 and 70, the connector 10J according to the present embodiment comprises a housing 20J made of an insulating material, a plurality of the signal contacts 50 each made of the conductive material, the power contacts 60 and the power contacts 70 each made of the conductive material, a shell 90J made of a metal and a metal member 120J which is a member other than the shell 90J.

As shown in FIGS. 67 and 70, the housing 20J has a land 22J, a recess 26J and a peripheral portion 28J. The land 22J extends long in the X-direction (first direction) while having a mating end 24J in the Z-direction (second direction). The recess 26J is formed so as to surround the land 22J in the XY-plane. The peripheral portion 28J is formed so as to surround the recess 26J in the XY-plane. The land 22J is formed with a slit-like holding portion 25J. The holding portion 25J extends in the X-direction in the mating end 24J while extending from the mating end 24J along the negative Z-direction. The recess 26J is recessed in the negative Z-direction. The peripheral portion 28J has two long walls 30J extending along the X-direction and two short walls 32J extending along the Y-direction (third direction). The recess 26J is located between the long wall 30J and the land 22J in the Y-direction. In other words, the land 22J and the long wall 30J are provided so as to have the recess 26J therebetween in the Y-direction. Similarly, the recess 26J is located between the short wall 32J and the land 22J in the X-direction.

Figure 68:
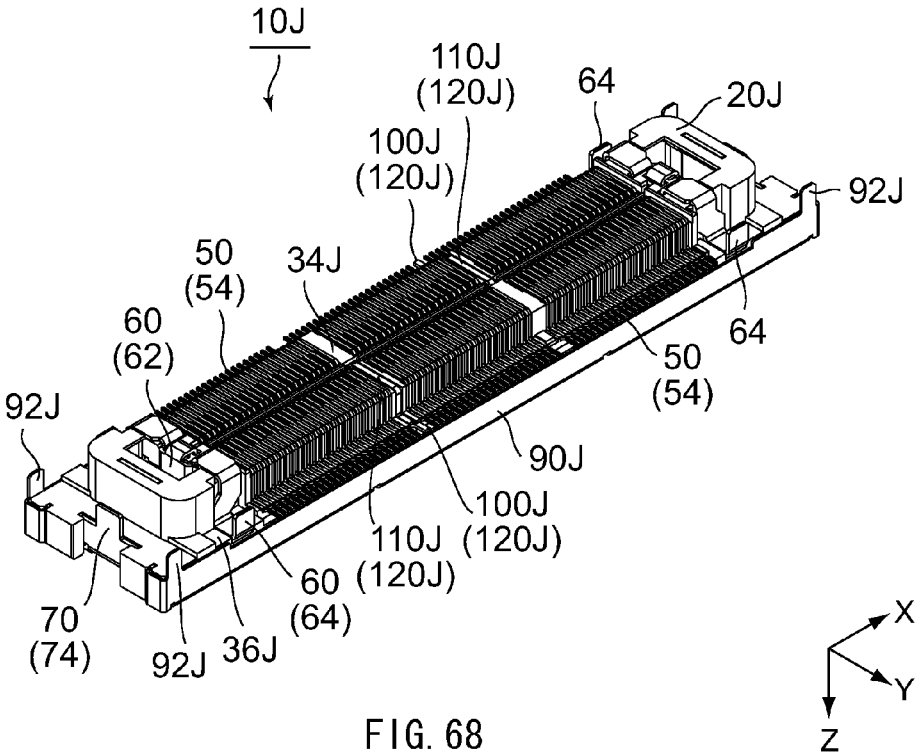
FIG. 68 is a bottom, perspective view showing the connector of FIG. 67.

As can be seen from FIGS. 68 to 70, the housing 20J has a bottom portion which is mostly comprised of a central bottom 34J and a peripheral bottom 36J. The central bottom 34J and the peripheral bottom 36J are located at a lower side of the housing 20J in the Z-direction. The peripheral bottom 36J is located so as to surround the central bottom 34J. As can be seen from FIG. 70, as seen along the Z-direction, the land 22J and the recess 26J are located within a region corresponding to the central bottom 34J.

As shown in FIGS. 67 and 68, the signal contacts 50 the power contacts 60 and the power contacts 70 are held by the housing 20J. The signal contact 50 is press-fitted in the housing 20J from a side opposite to the mating end 24J (i.e. from the bottom portion which is located at the negative Z-side of the housing 20J). The signal contact 50 is held by the housing 20J so that the contact-point part 52 is exposed in the recess 26J. As shown in FIG. 67, the contact-point part 62 of each of the power contacts 60 is provided in the recess 26J so as to cover the end of the land 22J in the X-direction. As shown in FIG. 67, the connector 10J according to the present embodiment comprises the two power contacts 70. The power contacts 70 are provided so as to straddle the short walls 32J, respectively. The contact-point part 72 of the power contact 70 is provided in the recess 26J so as to face the contact-point part 62 of the power contact 60.

As shown in FIGS. 67 and 69, the shell 90J according to the present embodiment is comprised of two members having similar shapes to each other. The two members of the shell 90J cover the long walls 30J of the peripheral portion 28J, respectively. The shell 90J is formed with a plurality of fixed portions 92J configured to be connected to the through holes 210 (see FIG. 3), respectively, while not formed with a fixed portion configured to be connected to the through hole 208 (see FIG. 3).

As shown in FIGS. 69 and 70 the metal member 120J according to the present embodiment is integrally formed from a connection member 100J made of a metal, a metal plate 80J and a coupling member 110J made of a metal. The connection member 100J is provided as a member other than the shell 90J. More specifically, the metal member 120J is formed by pressing and bending a single base metal plate. As shown in FIG. 69, the metal plate 80J is provided with a plurality of press-fit portions 82J. The metal member 120J is press-fitted in the land 22J of the housing 20J from the mating end 24J (i.e. from the bottom portion of the housing 20J) to be held by the land 22J. The metal plate 80J held by the land 22J is visible along the negative Z-direction (i.e. from the mating end 24J).

As shown in FIGS. 68 and 70, the coupling member 110J extends along the central bottom 34J. The connection member 100J is attached to the long wall 30J of the peripheral portion 28J at a position corresponding to one of the through holes 208 (see FIG. 3). Accordingly, the metal plate 80J, the connection member 100J and the coupling member 110J of the metal member 120J constitute an electric path which extends from the inside of the holding portion 25J of the land 22J to the outside of the long wall 30J of the peripheral portion 28J. An attached position where the coupling member 110J and the connection member 100J of the metal member 120J are attached to the housing 20J is apart from the opposite ends of the land 22J in a lengthwise direction (the X-direction or the first direction). Accordingly, according to the present embodiment, it is also possible to efficiently use the opposite ends of the land 22J in the lengthwise direction. It is therefore possible to provide the power contacts 60 and the power contacts 70 while preventing the connector 10J becoming large.

Figure 71:
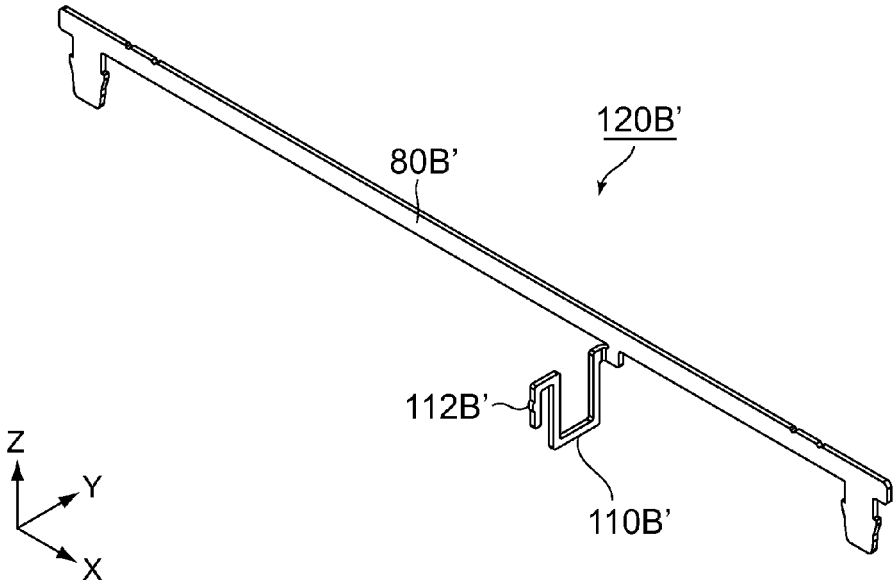
FIG. 71 is a perspective view showing a modification of the metal member of the connector of FIG. 16.
Figure 72:
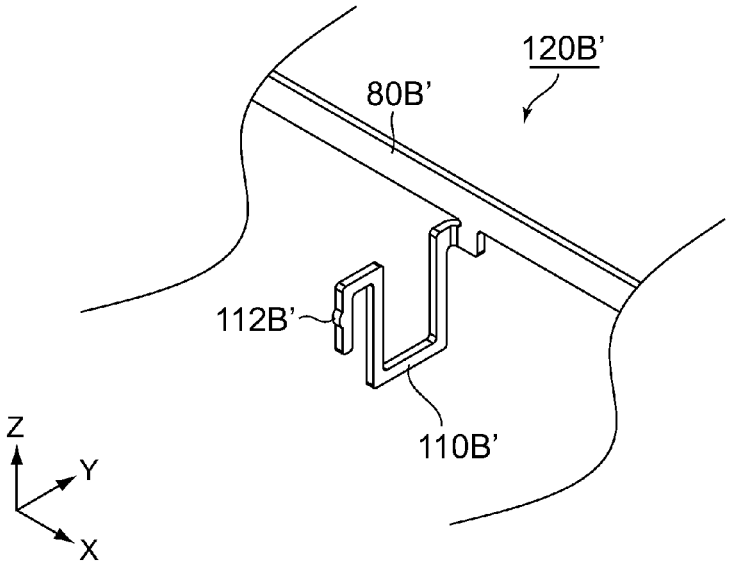
FIG. 72 is a partially enlarged, perspective view showing the metal member of FIG. 71.

According to the aforementioned first to tenth embodiments, each of the coupling members 110A to 110J is formed from the base metal plate so as to have a contact part which is brought into contact with the other member. The contact part is formed from a surface of the base metal plate. However, the contact part may be formed differently. For example, the contact part may be an edge which is formed when the base metal plate is pressed. For example, as shown in FIGS. 71 and 72, the metal member 120B (see FIG. 16) may be modified to a metal member 120B'. The metal member 120B has a coupling member 110B' and a metal plate 80B' The coupling member 110B' extends in a plane perpendicular to the metal member 120B'. The coupling member 110B' has a protrusion 112B' instead of a dowel. The protrusion 112B' is formed by using the edge when the base metal plate is pressed.

The central bottoms 34A to 34J of the housings 20A to 20J according to the aforementioned first to tenth embodiments are exposed on the lower surface 200L of the circuit board 200. However, the central bottoms 34A to 34J may be configured differently. For example, each of the central bottoms 34A to 34J may be covered with a bottom cover. Thus configured bottom cover is capable of preventing the member made of the metal (for example, the metal plates 80A to 80J and the signal contacts 50) from being brought into contact with outer conductive body (not shown).

Eleventh Embodiment

Referring to FIGS. 73 to 80, a connector 10K according to an eleventh embodiment of the present invention is a so-called drop-in connector fixable to an object. The connector 10K is a modification of the connector 10A according to the previously described first embodiment so that the connector 10K has the almost same structure as the connector 10A. More specifically, the connector 10K is formed by covering the most part of the central bottom 34A of the connector 10A with a bottom cover. The connector 10K is comprised of thus modified part and other parts similar to the connector 10A. Accordingly, in Figures and the following description, similar or same reference signs are used to designate the elements of the connector 10K which are similar to or same as the elements of the connector 10A, respectively. It is not described or simply described about the similar or same elements in the following description while it is mainly described about differences of the connector 10K from the connector 10A.

Referring to FIGS. 73, 74, 77 and 78, the connector 10K according to the present embodiment comprises a housing 20K made of an insulating material, a plurality of the signal contacts 50 each made of the conductive material, the power contacts 60 and the power contacts 70 each made of the conductive material, a metal plate 80K for ESD protection, a shell (connection member) 90K made of a metal, a coupling member 110K made of a metal and a bottom cover 140K made of an insulating material.

Figure 73:
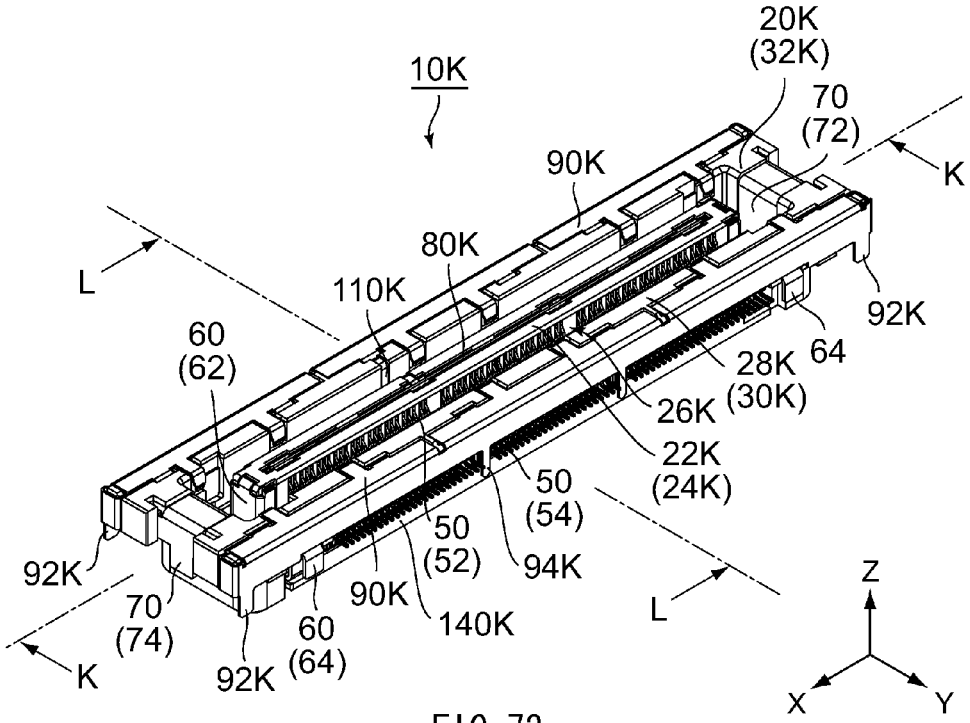
FIG. 73 is a top, perspective view showing a connector according to an eleventh embodiment of the present invention.
Figure 74:
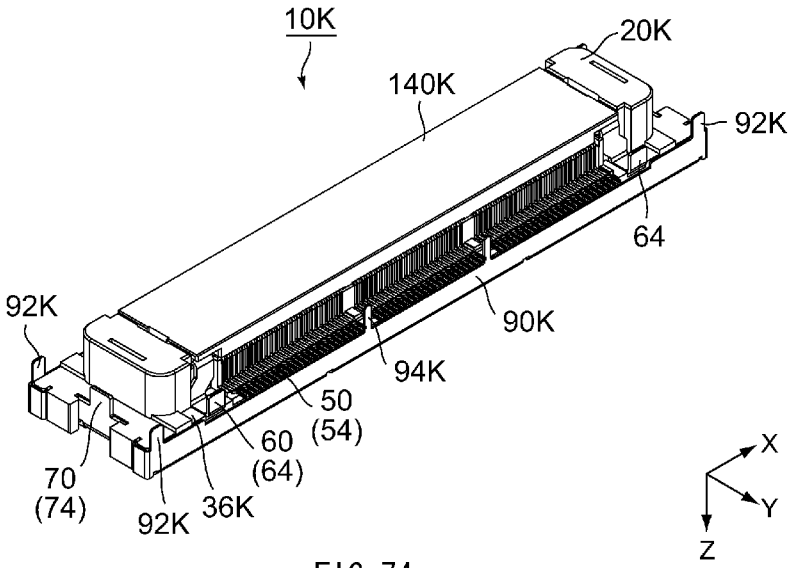
FIG. 74 is a bottom, perspective view showing the connector of FIG. 73.
Figure 75:
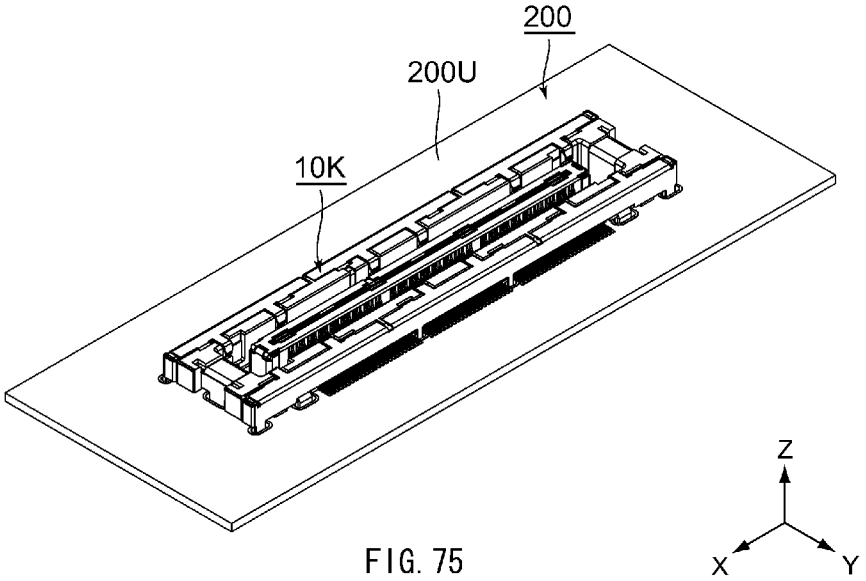
FIG. 75 is a top, perspective view showing the connector of FIG. 73 mounted on the circuit board of FIG. 3.
Figure 76:
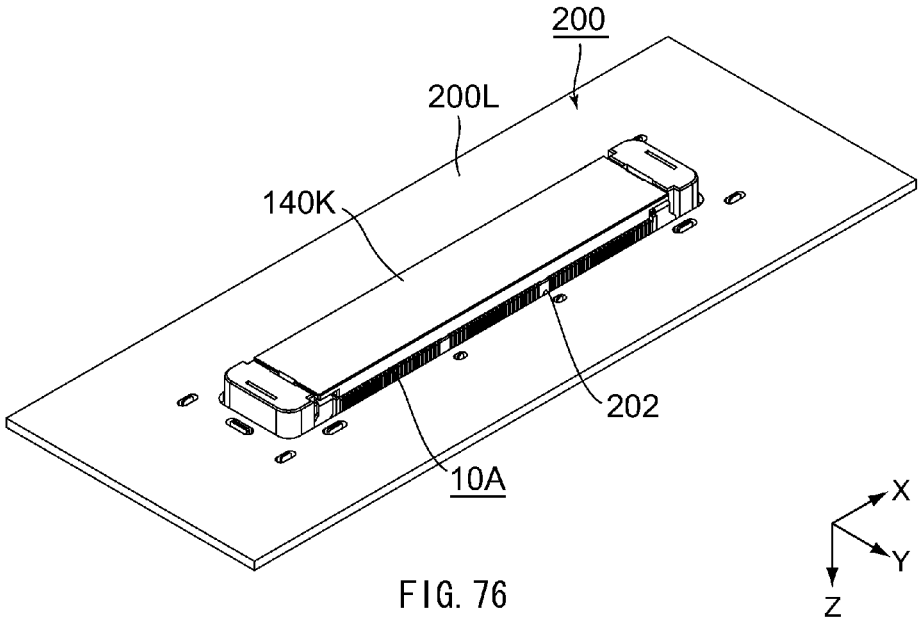
FIG. 76 is a bottom, perspective view showing the connector of FIG. 73 mounted on the circuit board of FIG. 3.
Figure 77:
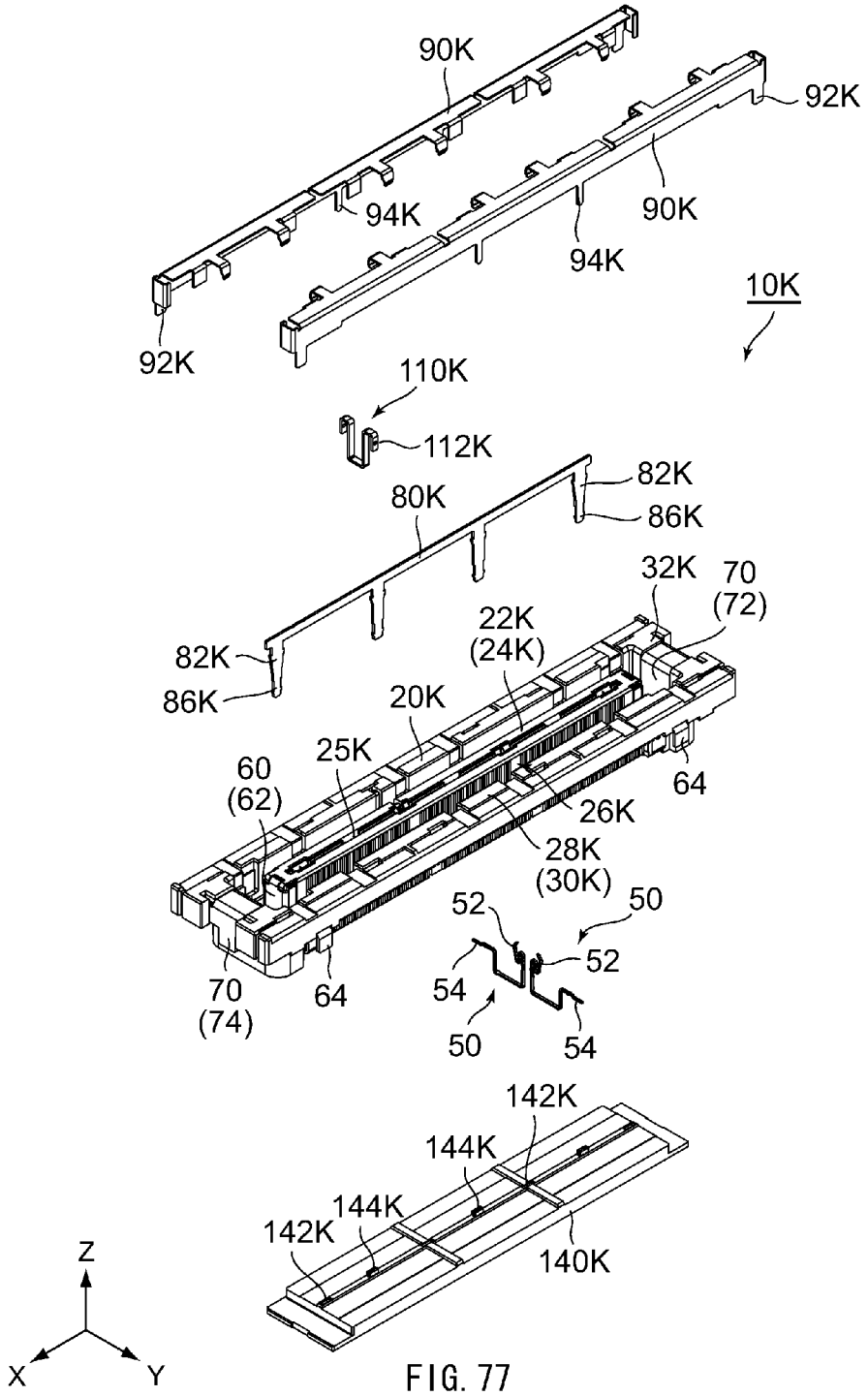
FIG. 77 is a partially exploded, top, perspective view showing the connector of FIG. 73.
Figure 80:
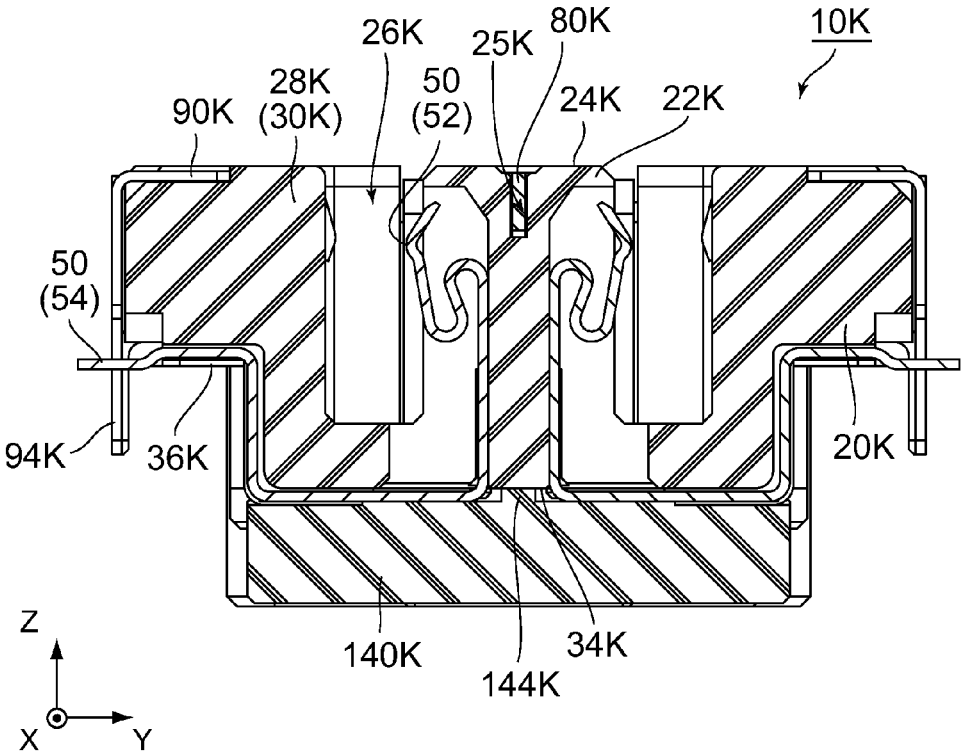
FIG. 80 is a cross-sectional view showing the connector of FIG. 73, taken along L-L lines.

As shown in FIGS. 73, 77 and 80, the housing 20K has a land 22K, a recess 26K and a peripheral portion 28K. The land 22K extends long in the X-direction (first direction) while having a mating end 24K in the Z-direction (second direction). The recess 26K is formed so as to surround the land 22K in the XY-plane. The peripheral portion 23K is formed so as to surround the recess 26K in the XY-plane. The land 22K is formed with a slit-like holding portion 25K. The holding portion 25K extends in the X-direction in the mating end 24K while extending from the mating end 24K along the negative Z-direction. The recess 26K is recessed in the negative Z-direction. The peripheral portion 28K has two long walls 30K extending along the X-direction and two short walls 32K extending along the Y-direction (third direction). The recess 26K is located between the long wall 30K and the land 22K in the Y-direction. In other words, the land 22K and the long wall 30K are provided so as to have the recess 26K therebetween in the Y-direction. Similarly, the recess 26K is located between the short wall 32K and the land 22K in the X-direction.

Figure 78:
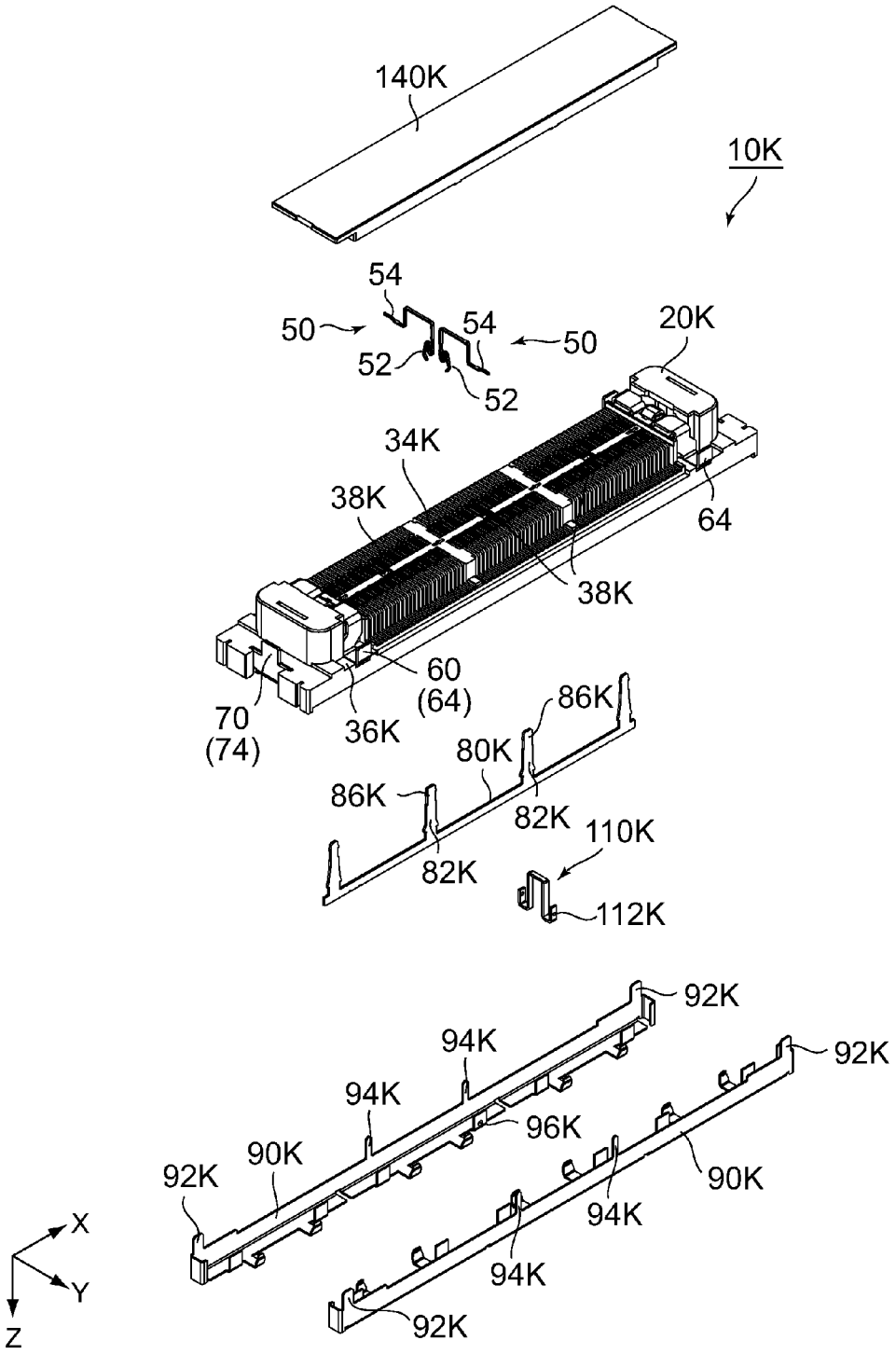
FIG. 78 is a partially exploded, bottom, perspective view showing the connector of FIG. 73.
Figure 79:
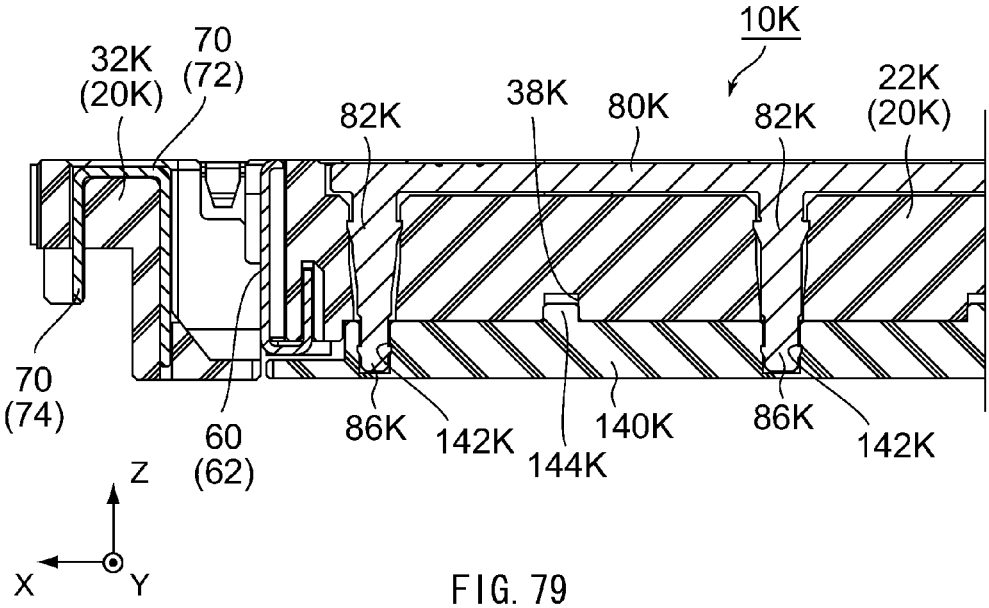
FIG. 79 is a cross-sectional view showing the connector of FIG. 73, taken along K-K lines.

As can be seen from FIGS. 78 to 80, the housing 20K has a bottom portion which is mostly comprised of a central bottom 34K and a peripheral bottom 36K. The central bottom 34K and the peripheral bottom 36K are located at a lower side of the housing 20K in the Z-direction. The peripheral bottom 36K is located so as to surround the central bottom 34K. As can be seen from FIG. 70, as seen along the Z-direction, the land 22K and the recess 26K are located within a region corresponding to the central bottom 34K.

As shown in FIGS. 78 to 80, the central bottom 34K of the housing 20K according to the present embodiment is formed with a plurality of first fixing portions 38K. The first fixing portion 38K according to the present embodiment is a depression depressed in the positive Z-direction.

As shown in FIGS. 73 and 78, the signal contacts 50, the power contacts 60 and the power contacts 70 are held by the housing 20K. The signal contact 50 is press-fitted in the housing 20K from a side opposite to the mating end 24K (i.e. from the bottom portion which is located at the negative Z-side of the housing 20K). The signal contact 50 is held by the housing 20K so that the contact-point part 52 is exposed in the recess 26K. As shown in FIG. 73, the contact-point part 62 of each of the power contacts 60 is provided in the recess 26K so as to cover the end of the land 22K in the X-direction. As shown in FIG. 73, the connector 10K according to the present embodiment comprises the two power contacts 70. The power contacts 70 are provided so as to straddle the short walls 32K, respectively. The contact-point part 72 of the power contact 70 is provided in the recess 26K so as to face the contact-point part 62 of the power contact 60.

As shown in FIGS. 77 and 78, the metal plate 80K according to the present embodiment has a plurality of press-fit portions 82K. The press-fit portion 82K is longer than the press-fit portion 82A (see FIG. 6) according to the first embodiment. The metal plate 80K has a plurality of outer press-fit portions 86K each provided at tip of the press-fit portion 82K. As shown in FIGS. 73 and 79, the metal plate 80K is press-fitted in the land 22K of the housing 20K from the mating end 24K to be held by the land 22K. In the meantime, the outer press-fit portion 86K projects from the central bottom 34K of the housing 20K. The metal plate 80K held by the land 22K is visible along the negative Z-direction.

As shown in FIGS. 73, 77 and 78, the shell (connection member) 90K according to the present embodiment is comprised of two members having similar shapes to each other. The two members of the shell 90K cover the long walls 30K of the peripheral portion 28K, respectively. The shell 90K has a plurality of fixed portions 92K configured to be connected to the through holes 210 (see FIG. 3), respectively, and a plurality of fixed portions 94K configured to be connected to the through holes 208 (see FIG. 3), respectively.

As shown in FIGS. 73, 77 and 78, the coupling member 110K according to the present embodiment is inserted in the housing 20K from the mating end 24K (i.e., from the positive Z-side of the housing 20K) so that the coupling member 110K is held by the housing 20K. As can be seen from FIG. 73, the coupling member 110K is located far apart from the power contacts 60 and the power contacts 70. As shown in FIGS. 77 and 78, the coupling member 110K has a dowel 112K.

As shown in FIG. 73, the coupling member 110K couples the metal plate 80K and the shell (connection member) 90K with each other in the Y-direction at a position which is apart from the opposite ends of the land 22K in a lengthwise direction (the X-direction or the first direction). Accordingly, according to the present embodiment, it is also possible to efficiently use the opposite ends of the land 22K in the lengthwise direction. It is therefore possible to provide the power contacts 60 and the power contacts 70 while preventing the connector 10K becoming large.

As shown in FIGS. 77 and 79, the bottom cover 140K according to the present embodiment is formed with a plurality of press-fitted portions 142K and a plurality of second fixing portions 144K. The second fixing portion 144K according to the present embodiment is a protrusion protruding in the positive Z-direction. The press-fitted portion 142K is depressed in the negative Z-direction. However, the press-fitted portion 142K does not reach at the negative Z-side surface of the bottom cover 140K. The outer press-fit portions 86K of the metal plate 80K are press-fitted in the respective press-fitted portions 142K so that the bottom cover 140K is attached to the central bottom 34K. According to the present embodiment, the bottom cover 140K is attached to the housing 20K so as to cover the most part of the central bottom 34K. In other words, the bottom cover 140K at least partially covers the central bottom 34K of the housing 20K. According to the present embodiment, the first fixing portion 38K and the second fixing portion 144K are mated with each other so that the bottom cover 140K is more securely attached to the central bottom 34K.

The connector 10K according to the present embodiment comprises thus configured bottom cover 140K so that it is possible to prevent the conductive component such as the signal contact 50 from being brought into contact with outer conductive body (not shown).

According to the aforementioned eleventh embodiment, the first fixing portion 38K is a depression while the second fixing portion 144K is a protrusion. However, the first fixing portion 38K and the second fixing portion 144K may be configured differently, provided that the first fixing portion 38K and the second fixing portion 144K are mateable with each other. For example, the first fixing portion 38K may be a protrusion while the second fixing portion 144K may be a depression.

Moreover, the bottom cover 140K may be attached to the housing 20K only by the outer press-fit portions 86K of the metal plate 80K and the press-fitted portions 142K of the bottom cover 140K. On the contrary, the bottom cover 140K may be attached to the housing 20K only by the first fixing portions 38K of the housing 20K and the second fixing portions 144K of the bottom cover 140K.

Figure 81:
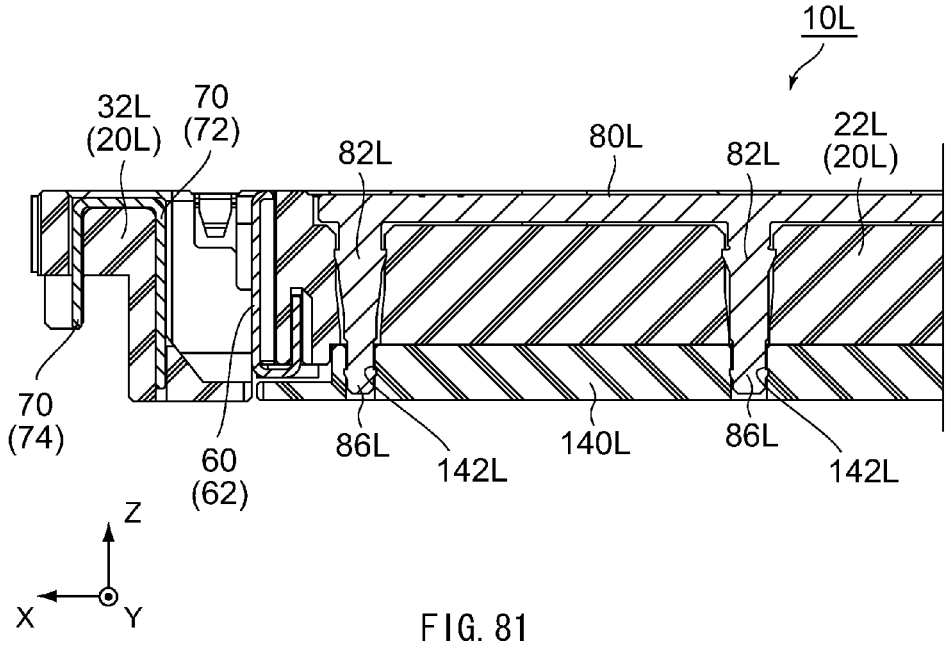
FIG. 81 is a cross-sectional view showing a modification of the connector of FIG. 79.

As shown in FIG. 81, the connector 10L according to a modification of the eleventh embodiment comprises a housing 20L, a metal plate 80L and a bottom cover 140L instead of the housing 20K, the metal plate 80K and the bottom cover 140K, respectively. The housing 20L has a land 22L and short walls 32L configured similar to the land 22K and the short walls 32K while not having a first fixing portion. The power contacts 70 are provided so as to straddle the short walls 32L, respectively. The bottom cover 140L is provided with a plurality of press-fitted portions 142L while not provided with a second fixing portion. The metal plate 80L has a plurality of press-fit portions 82L each having an outer press-fit portion 86L. The press-fit portion 82L of the metal plate 80L is press-fitted in the land 22L of the housing 20L so that the outer press-fit portion 86L extends over the land 22L to be press-fitted in the press-fitted portion 142L of the bottom cover 140L.

Figure 82:
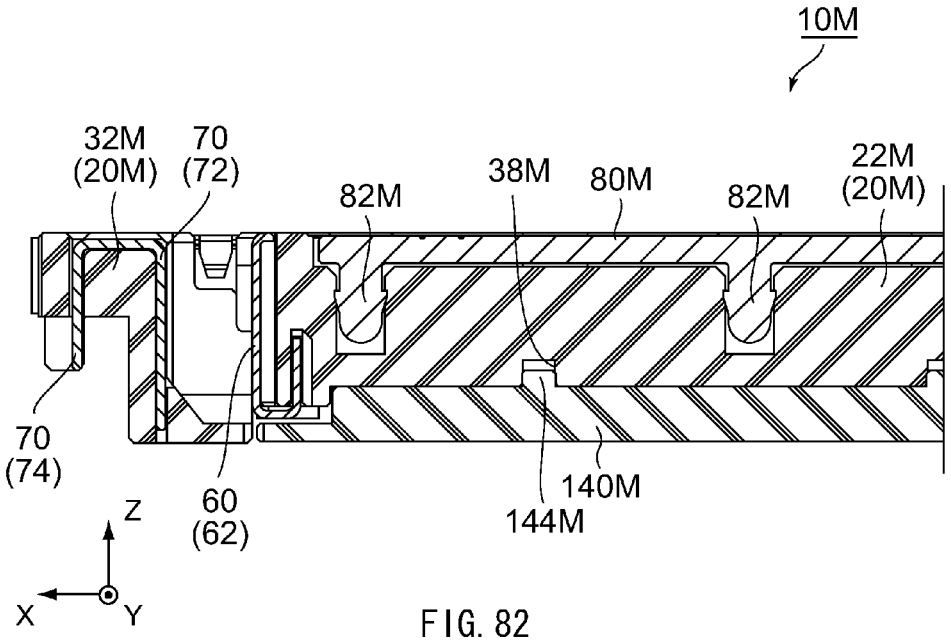
FIG. 82 is a cross-sectional view showing another modification of the connector of FIG. 79.

As shown in FIG. 82, the connector 10M according to another modification of the eleventh embodiment comprises a housing 20M, a metal plate 80M and a bottom cover 140M instead of the housing 20K, the metal plate 80K and the bottom cover 140K, respectively. The housing 20M has a land 22M and short walls 32M configured similar to the land 22K and the short walls 32K. The power contacts 70 are provided so as to straddle the short walls 32M, respectively. The metal plate 80M has a plurality of press-fit portions 82M while having no outer press-fit portion. Although the press-fit portion 82M of the metal plate 80M is press-fitted in the land 22M of the housing 20M, the press-fit portion 82M does not reach at the bottom cover 140M. The housing 20M is formed with a plurality of first fixing portions 38M while the bottom cover 140M is formed with a plurality of second fixing portions 144M. According to the present modification, the first fixing portion 38M is a depression while the second fixing portion 144M is a protrusion. The first fixing portion 38M and the second fixing portion 144M are mated with each other so that the bottom cover 140M is attached to the housing 20M.

An embodiment of the present invention is not limited to the aforementioned embodiments. For example, each of the connectors 10A to 10M according to the aforementioned embodiments is of a type which is partially received in the opening 202 formed in the circuit board 200. However, the connector may be of a type which is received not in an opening but in a recess formed at an end of a circuit board. Moreover, the connector may not be of a drop-in type. For example, the connector may be of a type which is mounted on and fixed to a circuit board not having an opening and a recess.

The present application is based on a Japanese patent applications of JP2012-126886 filed before the Japan Patent Office on Jun. 4, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector fixable to an object, the connector comprising:

a housing having a land and a long wall, the land extending long in a first direction while having a mating end in a second direction perpendicular to the first direction, the land and the long wall being provided so as to have a recess therebetween in a third direction perpendicular to both the first direction and the second direction;

a signal contact having a contact-point part, the signal contact being held by the housing so that the contact-point part is exposed in the recess;

a power contact provided at an end of the land in the first direction, the power contact having a contact-point part which covers the end of the land from outside of the land in the first direction;

a metal plate for Electro-Static Discharge (ESD) protection, the metal plate being (i) insulated from the signal contact and the power contact, and (ii) at least partially inserted in and held by the land so that a part of the metal plate, which is located on or in the mating end, is visible when seen along the second direction;

a connection member configured to be fixed and connected to the object outside of the recess in the third direction; and a coupling member coupling the metal plate and the connection member with each other while being insulated from the signal contact; and wherein: the housing has a central bottom and a peripheral bottom, the central bottom and the peripheral bottom being located at a lower side of the housing in the second direction, the central bottom being located below an upper surface of the object when the connector is fixed to the object, and the peripheral bottom being located above the upper surface of the object when the connector is fixed to the object; and as seen along the second direction, the land and the recess are located within a region corresponding to the central bottom and the power contact.

2. The connector as recited in claim 1, wherein the signal contact is press-fitted in the housing from a side opposite to the mating end so that the signal contact is held by the housing.

3. The connector as recited in claim 1, wherein the contact-point part of the power contact is located between opposite ends of the land in the third direction.

4. The connector as recited in claim 1, wherein the coupling member is integrally formed with at least one of the metal plate and the connection member.

5. The connector as recited in claim 1, wherein the coupling member is inserted in the housing from the mating end so that the coupling member is held by the housing.

6. The connector as recited in claim 1, wherein the coupling member is inserted in the housing from a side opposite to the mating end so that the coupling member is held by the housing.

7. The connector as recited in claim 1, further comprising:

a shell at least partially covering the long wall, the connection member being formed as a part of the shell.

8. The connector as recited in claim 1, further comprising:

a shell at least partially covering the long wall, the connection member being formed as a member separate from the shell.

9. The connector as recited in claim 1, further comprising:

a bottom cover at least partially covering the central bottom of the housing.

10. The connector as recited in claim 9, wherein:

the metal plate has an outer press-fit portion which projects from the central bottom of the housing:

the bottom cover is formed with a press-fitted portion; and the outer press-fit portion is press-fitted in the press-fitted portion so that the bottom cover is attached to the central bottom.

11. The connector as recited in claim 9, wherein:

the central bottom is formed with a first fixing portion, the first fixing portion being one of a depression and a protrusion;

the bottom cover is formed with a second fixing portion, the second fixing portion being the other one of the protrusion and the depression; and the first fixing portion and the second first fixing portion are mated with each other so that the bottom cover is attached to the central bottom.

* * * * *